US010089938B2

(12) United States Patent
Takasaki et al.

(10) Patent No.: US 10,089,938 B2
(45) Date of Patent: Oct. 2, 2018

(54) DISPLAY DEVICE WITH SIDELIGHT ILLUMINATION AND LUMINANCE CORRECTION

(71) Applicant: Japan Display Inc., Tokyo (JP)

(72) Inventors: Naoyuki Takasaki, Tokyo (JP); Tsutomu Harada, Tokyo (JP); Kazuhiko Sako, Tokyo (JP)

(73) Assignee: Japan Display Inc., Tokyo (JP)

( * ) Notice: Subject to any disclaimer, the term of this patent is extended or adjusted under 35 U.S.C. 154(b) by 241 days.

(21) Appl. No.: 15/168,890

(22) Filed: May 31, 2016

(65) Prior Publication Data

US 2016/0358558 A1 Dec. 8, 2016

(30) Foreign Application Priority Data

Jun. 3, 2015 (JP) ..... 2015-113449
Jan. 7, 2016 (JP) ..... 2016-002087

(51) Int. Cl.
*G09G 3/34* (2006.01)
*G09G 3/36* (2006.01)

(52) U.S. Cl.
CPC ..... *G09G 3/342* (2013.01); *G09G 3/3648* (2013.01); *G09G 3/3666* (2013.01); *G09G 2300/0452* (2013.01); *G09G 2320/0233* (2013.01); *G09G 2320/0242* (2013.01); *G09G 2320/0646* (2013.01); *G09G 2360/16* (2013.01)

(58) Field of Classification Search
None
See application file for complete search history.

(56) References Cited

U.S. PATENT DOCUMENTS

2009/0322802 A1 12/2009 Noguchi
2010/0039368 A1 2/2010 Kim
2010/0253696 A1* 10/2010 Choi ..... G09G 3/3426 345/589
2015/0109352 A1 4/2015 Takasaki et al.
2015/0379943 A1* 12/2015 Katsu ..... G09G 3/3426 345/88

FOREIGN PATENT DOCUMENTS

JP 2010-033014 2/2010
JP 2010-044389 2/2010
JP 2015-108818 6/2015

* cited by examiner

*Primary Examiner* — Amare Mengistu
*Assistant Examiner* — Sarvesh J Nadkarni
(74) *Attorney, Agent, or Firm* — K&L Gates LLP

(57) ABSTRACT

According to an aspect, a display device includes an image display panel; a planar light source including a light guide plate, a first sidelight light source, and a second sidelight light source; and a control unit. The control unit sets first luminance determination blocks in a first display surface of the image display panel and identifies a first luminance determination block to be a target of luminance correction by referring to luminance information on the light sources. The control unit sets second luminance determination blocks in a second display surface of the image display panel and identifies a second luminance determination block to be a target of luminance correction by referring to the luminance information on the light sources. The control unit controls light source lighting amounts of the respective light sources to satisfy luminance of the identified first luminance determination block and the identified second luminance determination block.

11 Claims, 34 Drawing Sheets

LINEAR INTERPOLATION

POLYNOMIAL INTERPOLATION

FIG.28

| LIGHT SOURCE | LIGHT SOURCE LIGHTING AMOUNT [%] |
|---|---|
| 56A | 24 |
| 56B | 25 |
| 56C | 25 |
| 56D | 149 |
| 56E | 25 |
| 56F | 98 |

FIG.29

| | PEAK CURRENT OF LIGHT SOURCE [mA] | LIGHT SOURCE LIGHTING DISTRIBUTION [%] |
|---|---|---|
| COMPARATIVE EXAMPLE | 20 | 100 |
| EMBODIMENT | 40 x2 | 50 x1/2 |

DISPLAY DEVICE WITH SIDELIGHT ILLUMINATION AND LUMINANCE CORRECTION

CROSS-REFERENCE TO RELATED APPLICATIONS

This application claims priority from Japanese Application No. 2015-113449, filed on Jun. 3, 2015 and Japanese Application No. 2016-002087, filed on Jan. 7, 2016, the contents of which are incorporated by reference herein in its entirety.

BACKGROUND

1. Technical Field

The present invention relates to a display device.

2. Description of the Related Art

There have recently been an increasing demand for display devices designed for mobile apparatuses and the like, such as mobile phones and electronic paper. In such display devices, each pixel includes a plurality of sub-pixels that output light of respective colors. The display devices switch on and off the display in the sub-pixels, thereby causing each pixel to display various colors. Display characteristics, such as resolution and luminance, of the display devices have been improved year by year. An increase in the resolution, however, reduces the aperture ratio. To achieve high luminance, it is necessary to increase the luminance of a backlight, resulting in increased power consumption of the backlight. To address this, there has been developed a technology of adding a white pixel serving as the fourth sub-pixel to the conventional red, green, and blue sub-pixels (e.g., Japanese Patent Application Laid-open Publication No. 2010-33014). Because the white pixel increases the luminance, the technology reduces the current value of the backlight, thereby reducing the power consumption.

Japanese Patent Application Laid-open Publication No. 2010-44389 (JP-A-2010-44389) discloses a light source local dimming control method for controlling dimming of a light source module including a light source block provided with a light source that supplies light to a plurality of image regions. In the method, duty ratios of a first light source and a second light source are primarily determined using a first target luminance value of a first image region closest to a first light source and a second target luminance value of a second image region closest to a second light source adjacent to the first light source. The primarily determined duty ratios are compensated using a target luminance value of a remaining image region excluding the first and the second image regions out of the image regions that receive the light from the first and the second light sources. The first and the second light sources are driven by drive signals resulting from compensation of the primarily determined duty ratios.

Let us assume a case where the technology disclosed in JP-A-2010-44389 is applied to a sidelight light source including a plurality of light sources at a position facing an incident surface corresponding to at least one side surface of a light guide plate. In this case, the luminance distribution of a backlight may possibly vary in a complicated manner, resulting in unnecessary power consumption.

For the foregoing reasons, there is a need for a display device that controls the luminance of light sources of a sidelight light source individually, thereby reducing power consumption of the light sources.

SUMMARY

According to an aspect, a display device includes an image display panel; a planar light source including a light guide plate that irradiates the image display panel from a back surface of the image display panel and includes a first side surface serving as a first incident surface and a second side surface serving as a second incident surface and opposite to the first side surface, a first sidelight light source that is disposed at a position facing the first incident surface of the light guide plate and includes a plurality of light sources, and a second sidelight light source that is disposed at a position facing the second incident surface of the light guide plate and includes a plurality of light sources; and a control unit that controls luminance of the light sources of the first sidelight light source individually and luminance of the light sources of the second sidelight light source individually. The control unit divides a whole display surface of the image display panel into a first display surface and a second display surface, sets first luminance determination blocks by dividing the first display surface into a plurality of portions in a light source array direction in which the light sources of the first sidelight light source are aligned and in a light incident direction orthogonal to the light source array direction, identifies a first luminance determination block having highest luminance out of the first luminance determination blocks present at the same position in the light source array direction in an image to be displayed based on information of an input signal of the image, identifies a first luminance determination block to be a target of luminance correction by referring to luminance information on the light sources, and controls light source lighting amounts of the respective light sources so as to satisfy luminance of the identified first luminance determination block. The control unit sets second luminance determination blocks by dividing the second display surface into a plurality of portions in the light source array direction and the light incident direction, identifies a second luminance determination block having highest luminance out of the second luminance determination blocks present at the same position in the light source array direction in the image to be displayed based on information of the input signal of the image, identifies a second luminance determination block to be a target of luminance correction by referring to the luminance information on the light sources, and controls the light source lighting amounts of the respective light sources so as to satisfy luminance of the identified second luminance determination block.

BRIEF DESCRIPTION OF THE DRAWINGS

FIG. 28 is a diagram for explaining the light source lighting amount of the light sources according to the present embodiment;

FIG. 29 is a diagram for explaining the duty ratio of the light sources according to the present embodiment;

DETAILED DESCRIPTION

Figure 1:
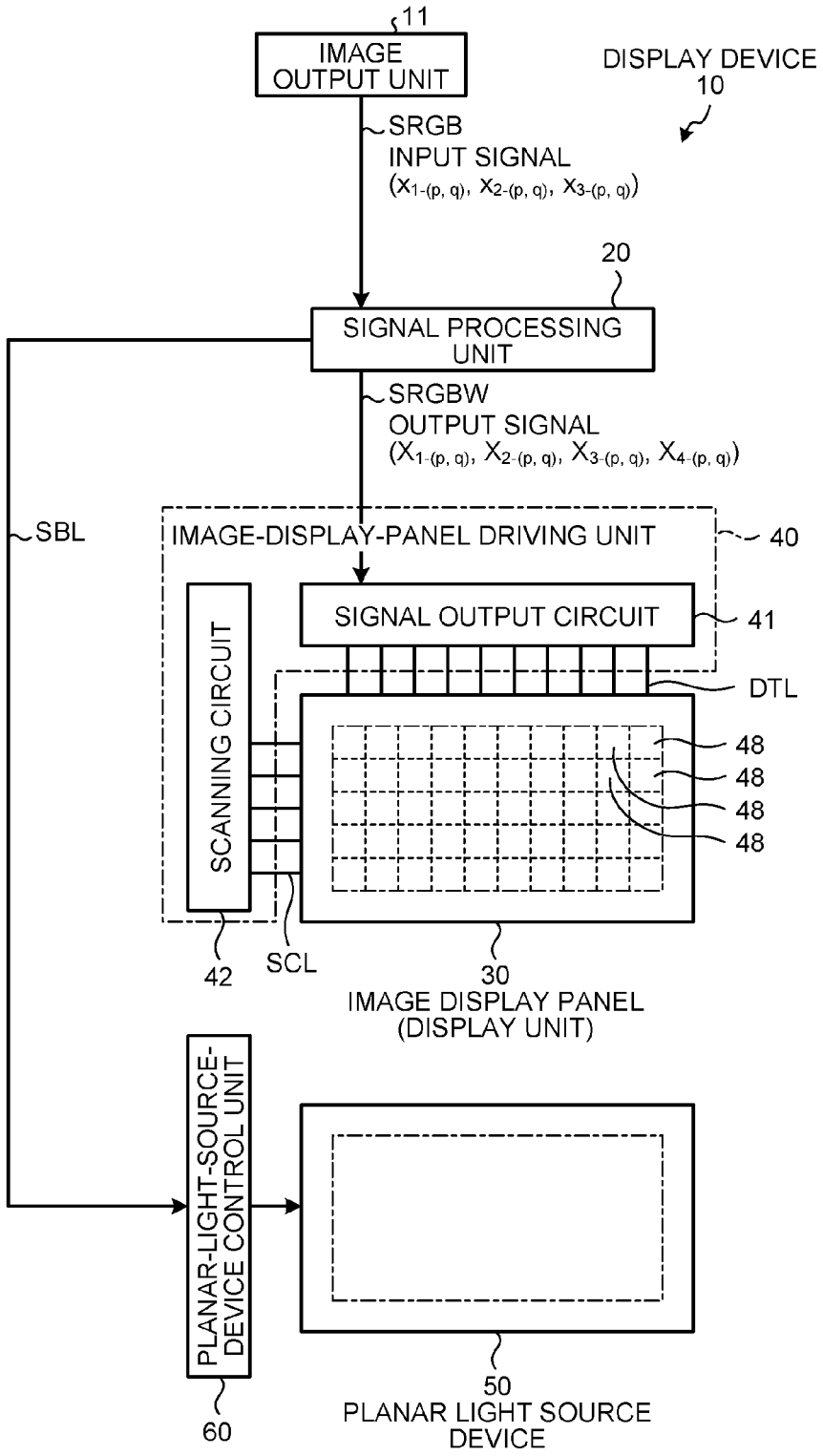
FIG. 1 is a block diagram of an exemplary configuration of a display device according to an embodiment.

The following describes an embodiment in detail with reference to the drawings. The present invention is not limited to the embodiment described below. Components described below include a component that is easily conceivable by those skilled in the art and substantially the same component. The components described below can be appropriately combined. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will not be repeated in some cases.

Configuration of the Display Device

Figure 2:
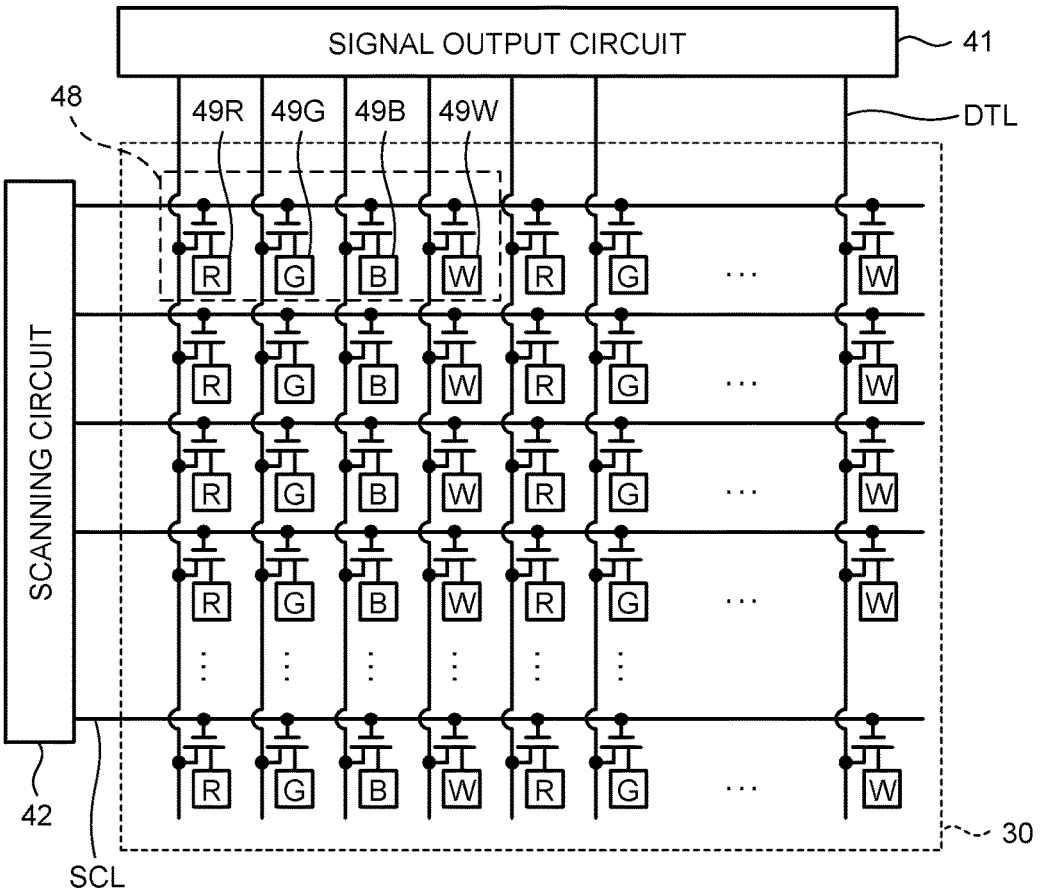
FIG. 2 is a diagram of a pixel array in an image display panel according to the present embodiment.

FIG. 1 is a block diagram of an exemplary configuration of a display device according to an embodiment. FIG. 2 is a diagram of a pixel array in an image display panel according to the present embodiment.

As illustrated in FIG. 1, a display device 10 includes a signal processing unit 20, an image display panel (display unit) 30, an image-display-panel driving unit 40, a planar light source device 50, and a planar-light-source-device control unit 60. The signal processing unit 20 receives input signals SRGB of an image from an image output unit 11. The signal processing unit 20 transmits output signals SRGBW to each unit of the display device 10, thereby controlling an operation of each unit. The image display panel 30 displays an image based on the output signals SRGBW output from the signal processing unit 20. The image-display-panel driving unit 40 controls the drive of the image display panel 30. The planar light source device 50 irradiates the image display panel 30 from the back surface thereof. The planar-light-source-device control unit 60 controls the drive of the planar light source device 50.

The signal processing unit 20 is an arithmetic processing unit that controls operations of the image display panel 30 and the planar light source device 50. The signal processing unit 20 is coupled with the image-display-panel driving unit 40 that drives the image display panel 30 and to the planar-light-source-device control unit 60 that drives the planar light source device 50. The signal processing unit 20 processes the input signals received from the outside to generate output signals and planar-light-source-device control signals. In other words, the signal processing unit 20 converts an input value (input signal) in an input HSV (Hue-Saturation-Value, Value is also called Brightness) color space of the input signal into an extended value (output signal) in an extended HSV color space reproducible by a first color, a second color, a third color, and a fourth color. The signal processing unit 20 outputs the generated output signal to the image-display-panel driving unit 40 and outputs the generated planar-light-source-device control signal to the planar-light-source-device control unit 60.

As illustrated in FIG. 1, the image display panel 30 includes $P_0 \times Q_0$ pixels 48 ($P_0$ in a row direction and $Q_0$ in a column direction) arrayed in a two-dimensional matrix (rows and columns). In the example illustrated in FIG. 1, a plurality of pixels 48 are arrayed in a matrix in an X-Y two-dimensional coordinate system. In this example, the row direction corresponds to the X-direction, whereas the column direction corresponds to the Y-direction.

The pixels 48 each include a first sub-pixel 49R, a second sub-pixel 49G, a third sub-pixel 49B, and a fourth sub-pixel 49W. The first sub-pixel 49R displays a first primary color (e.g., red). The second sub-pixel 49G displays a second primary color (e.g., green). The third sub-pixel 49B displays a third primary color (e.g., blue). The fourth sub-pixel 49W displays a fourth color (e.g., white). As described above, the pixels 48 arrayed in a matrix in the image display panel 30 each include the first sub-pixel 49R that displays the first color, the second sub-pixel 49G that displays the second color, the third sub-pixel 49B that displays the third color, and the fourth sub-pixel 49W that displays the fourth color. The first, the second, the third, and the fourth colors are not limited to the first primary color, the second primary color, the third primary color, and white, respectively, and simply need to be different from one another, such as complementary colors. The fourth sub-pixel 49W that displays the fourth color is preferably brighter than the first sub-pixel 49R that displays the first color, the second sub-pixel 49G that displays the second color, and the third sub-pixel 49B that displays the third color when the first to fourth sub-pixels 49R, 49G, 49B, and 49W are irradiated with light of the same light source lighting amount. In the following description, the first sub-pixel 49R, the second sub-pixel 49G, the third sub-pixel 49B, and the fourth sub-pixel 49W will be referred to as a sub-pixel 49 when they need not be distinguished from one another.

More specifically, the display device 10 is a transmissive color liquid-crystal display device. As illustrated in FIG. 2, the image display panel 30 is a color liquid-crystal display panel. A first color filter is arranged between the first sub-pixel 49R and an image observer and allows the first primary color to pass therethrough. A second color filter is arranged between the second sub-pixel 49G and the image observer and allows the second primary color to pass therethrough. A third color filter is arranged between the third sub-pixel 49B and the image observer and allows the third primary color to pass therethrough. The image display panel 30 has no color filter between the fourth sub-pixel 49W and the image observer. The fourth sub-pixel 49W may be provided with a transparent resin layer instead of a color filter. The transparent resin layer in the image display panel 30 can suppress the occurrence of a large gap above the fourth sub-pixel 49W, otherwise a large gap occurs because no color filter is arranged for the fourth sub-pixel 49W.

The image-display-panel driving unit 40 illustrated in FIGS. 1 and 2 is included in a control unit according to the present embodiment. The image-display-panel driving unit 40 includes a signal output circuit 41 and a scanning circuit 42. The image-display-panel driving unit 40 causes the signal output circuit 41 to hold video signals and sequentially output them to the image display panel 30. The signal output circuit 41 is electrically coupled with the image display panel 30 by signal lines DTL. The image-display-panel driving unit 40 causes the scanning circuit 42 to select sub-pixels 49 in the image display panel 30 and control on and off of switching elements (e.g., thin-film transistors (TFTs)) for controlling operations (light transmittance) of the respective sub-pixels 49. The scanning circuit 42 is electrically coupled with the image display panel 30 by scanning lines SCL.

Figure 3:
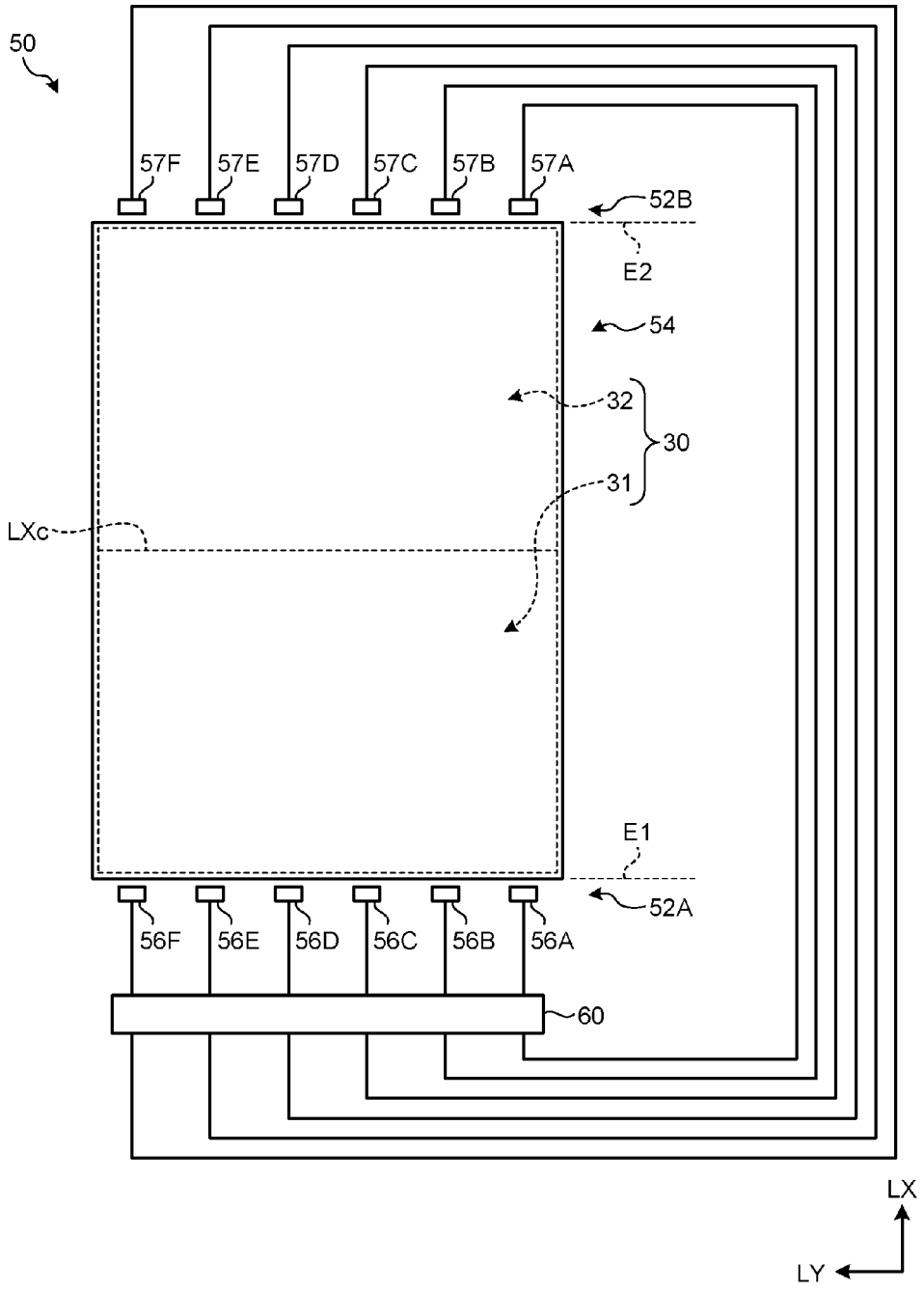
FIG. 3 is a diagram for explaining a light guide plate and sidelight light sources according to the present embodiment.

The planar light source device 50 is arranged on the back surface side of the image display panel 30. The planar light source device 50 outputs light to the image display panel 30, thereby irradiating the image display panel 30. FIG. 3 is a diagram for explaining a light guide plate and sidelight light sources according to the present embodiment. A light guide plate 54 has incident surfaces E (a first incident surface E1 and a second incident surface E2) on the side surfaces thereof, respectively. The planar light source device 50 includes a first sidelight light source 52A at a position facing the first incident surface E1. The first sidelight light source 52A includes a plurality of light sources 56A to 56F.

The planar light source device 50 also includes a second sidelight light source 52B at a position facing the second incident surface E2. The second sidelight light source 52B includes a plurality of light sources 57A to 57F.

The first sidelight light source 52A and the second sidelight light source 52B are arranged such that the light sources 56A to 56F and the light sources 57A to 57F are line-symmetric with respect to a center line LXc of the light guide plate 54 in a light incident direction LX.

The light sources 56A to 56F and 57A to 57F, for example, are light-emitting diodes (LEDs) of the same color (e.g., white).

The light sources 56A to 56F are aligned along one side surface of the light guide plate 54. Let us assume a case where LY denotes a light source array direction in which the light sources 56A to 56F are aligned. In this case, light output from the light sources 56A to 56F is incident on the first incident surface E1 of the light guide plate 54 along the light incident direction LX orthogonal to the light source array direction LY.

Similarly, the light sources 57A to 57F are aligned along the other side surface of the light guide plate 54. Let us assume a case where LY denotes a light source array direction in which the light sources 57A to 57F are aligned. In this case, light output from the light sources 57A to 57F is incident on the second incident surface E2 of the light guide plate 54 along the light incident direction LX orthogonal to the light source array direction LY.

The planar-light-source-device control unit 60, for example, controls the amount of light output from the planar light source device 50. The planar-light-source-device control-unit 60 is included in the control unit according to the present embodiment. Specifically, the planar-light-source-device control unit 60 adjusts the value of an electric current supplied to the planar light source device 50 based on a planar-light-source-device-control signal SBL output from the signal processing unit 20. The planar-light-source-device control unit 60 thus controls the amount of light (intensity of light) output to the image display panel 30.

The value of an electric current supplied to the planar light source device 50 is adjusted by adjusting the duty ratio of a voltage or an electric current applied to the light sources 56A to 56F and 57A to 57F. In other words, the planar-light-source-device control unit 60 controls the on and off duty ratio of a voltage or an electric current applied to the light sources 56A to 56F and 57A to 57F in FIG. 3 individually. The planar-light-source-device control unit 60 thus performs light source divisional drive control for controlling the light source lighting amount (intensity) of light output from the light sources 56A to 56F and 57A to 57F individually.

As described above, the planar-light-source-device control unit 60 controls the luminance of each light source of the first sidelight light source 52A individually and the luminance of each light source of the second sidelight light source 52B individually.

The planar-light-source-device control unit 60 virtually divides the whole display surface of the image display panel 30 into two areas at the center line LXc in the light incident direction LX and handles the two areas resulting from the division as a first display surface 31 and a second display surface 32. The first display surface 31 is an area in the display surface of the image display panel 30 closer to the first sidelight light source 52A. The first display surface 31 is more affected by light output from the first sidelight light source 52A than by light output from the second sidelight light source 52B. By contrast, the second display surface 32 is an area in the display surface of the image display panel 30 closer to the second sidelight light source 52B. The second display surface 32 is more affected by light output from the second sidelight light source 52B than by light output from the first sidelight light source 52A.

The following describes an example where one light source of the first sidelight light source 52A affects the first display surface 31 illustrated in FIG. 3. The first sidelight light source 52A and the second sidelight light source 52B are arranged such that the light sources 56A to 56F and the light sources 57A to 57F are line-symmetric with respect to the center line LXc in the light incident direction LX. Because the following description is also applicable to the light sources 57A to 57F by replacing the light sources 56A to 56F with the light sources 57A to 57F, detailed description will be omitted for an example where one light source of the second sidelight light source 52B affects the second display surface 32 illustrated in FIG. 3.

Figure 4:
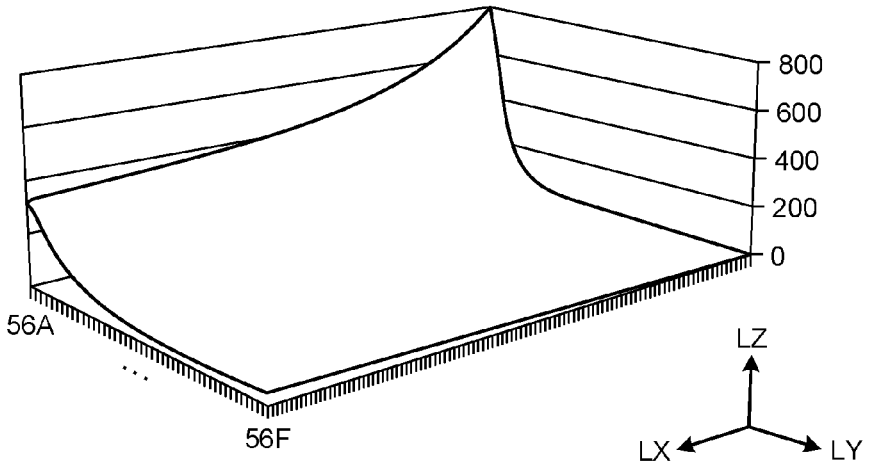
FIG. 4 is a diagram for explaining an example of light intensity distribution affected by one light source of the sidelight light source according to the present embodiment.
Figure 5:
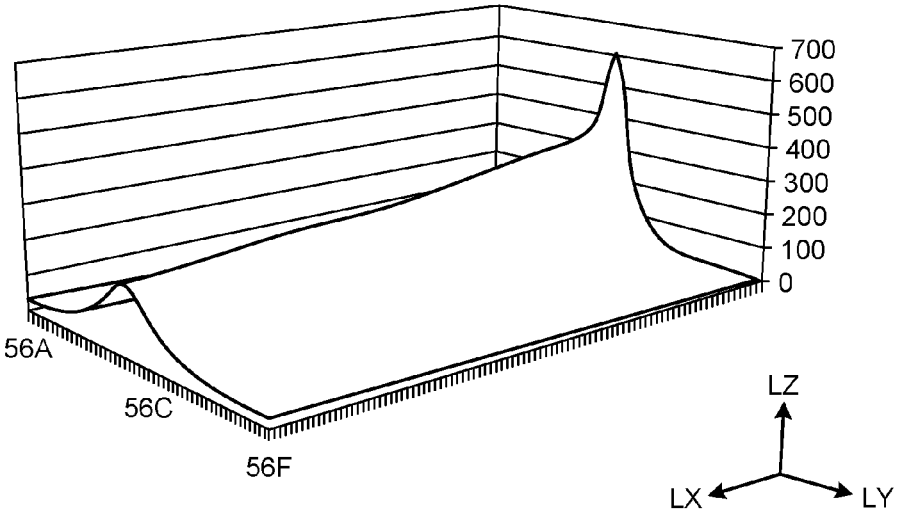
FIG. 5 is a diagram for explaining another example of light intensity distribution affected by one light source of the sidelight light source according to the present embodiment.

FIGS. 4 and 5 are diagrams for explaining an example of light intensity distribution affected by one light source of the sidelight light source according to the present embodiment. FIG. 4 illustrates information on the light intensity distribution of incident light obtained when only the light source 56A illustrated in FIG. 3 is turned on, the incident light being incident from the light source 56A on the light guide plate 54 and then traveling from the light guide plate 54 to the plane of the image display panel 30. When the incident light from the light source 56A enters the first incident surface E1 of the light guide plate 54 along the light incident direction LX orthogonal to the light source array direction LY, the light guide plate 54 guides the light in an illumination direction LZ in which the image display panel 30 is irradiated from the back surface thereof. The illumination direction LZ according to the present embodiment is orthogonal to the light source array direction LY and the light incident direction LX.

FIG. 5 illustrates information on the light intensity distribution of incident light obtained when only the light source 56C illustrated in FIG. 3 is turned on, the incident light being incident from the light source 56C on the light guide plate 54 and then traveling from the light guide plate 54 to the plane of the image display panel 30. When the incident light from the light source 56C enters the first incident surface E1 of the light guide plate 54 along the light incident direction LX orthogonal to the light source array direction LY, the light guide plate 54 guides the light in the illumination direction LZ in which the image display panel 30 is irradiated from the back surface thereof.

In the light guide plate 54, light is reflected by both end surfaces in the light source array direction LY. As a result, the intensity distribution of light output from the light sources 56A and 56F arranged closer to both end surfaces in the light source array direction LY is different from that of light output from the light source 56C, for example, arranged between the light sources 56A and 56F. To address this, the planar-light-source-device control unit 60 according to the present embodiment needs to control the electric current or the on and off duty ratio for the light sources 56A to 56F illustrated in FIG. 3 individually, thereby controlling the light source lighting amount (intensity) of output light depending on the light intensity distribution of the light sources 56A to 56F, which will be described later. The following describes processing operations performed by the display device 10, more specifically by the signal processing unit 20.

Processing Operations Performed by the Display Device

Figure 6:
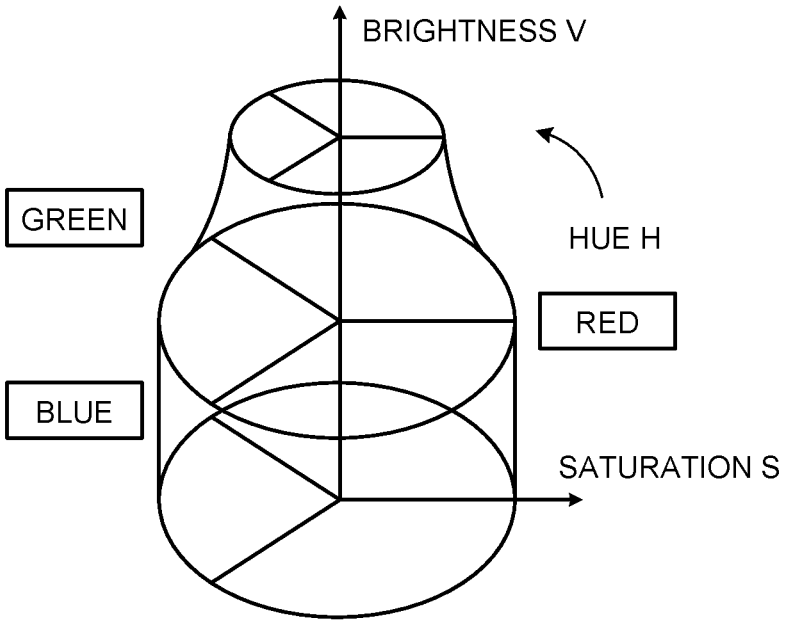
FIG. 6 is a conceptual diagram of an extended HSV color space reproducible by the display device according to the present embodiment.
Figure 7:
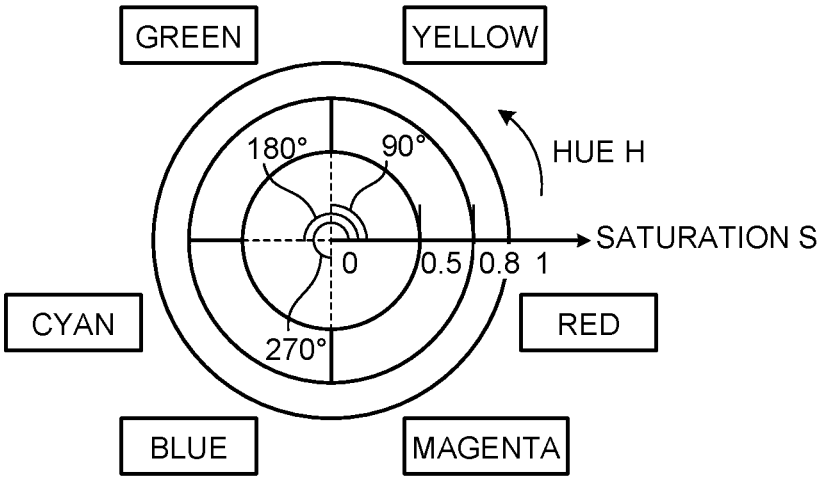
FIG. 7 is a conceptual diagram of a relation between a hue and saturation in the extended HSV color space.
Figure 8:
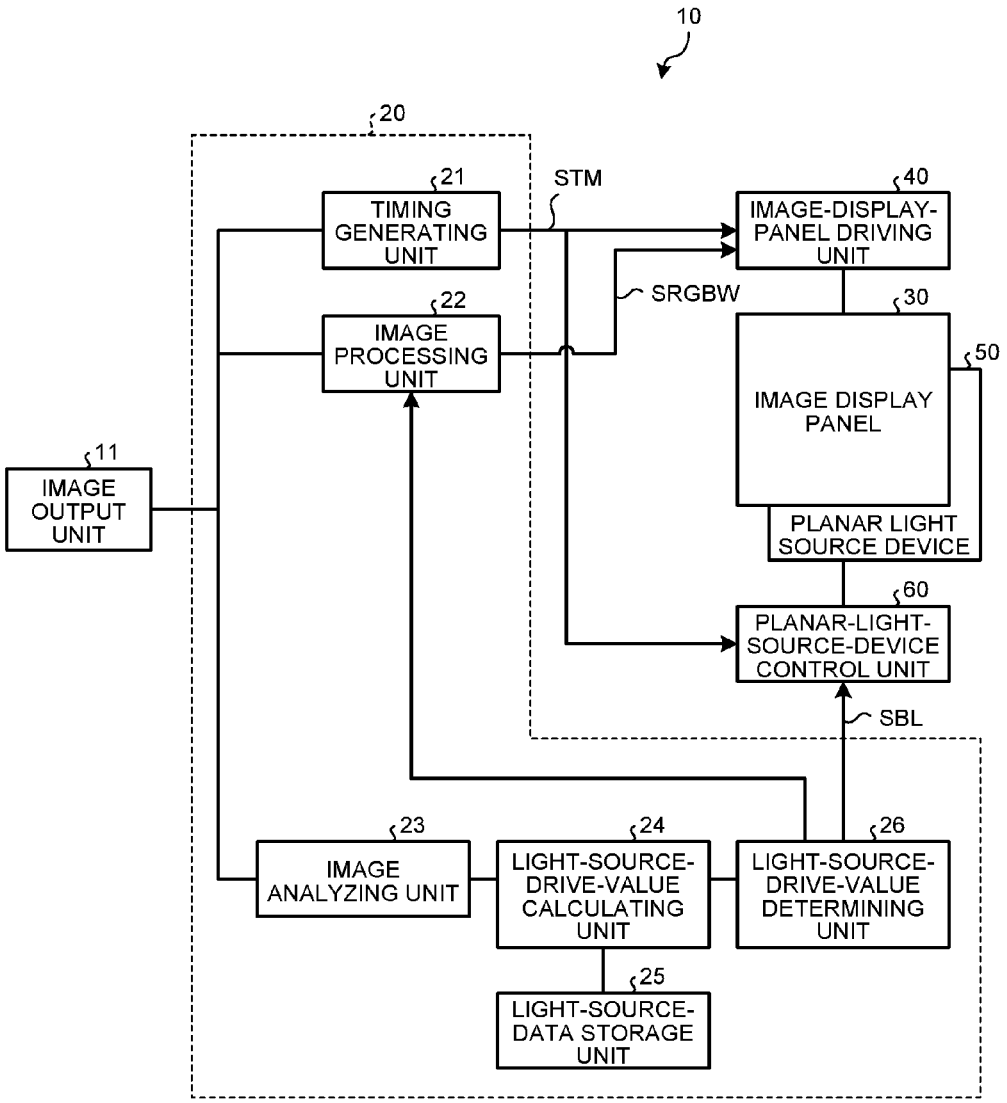
FIG. 8 is a block diagram for explaining a signal processing unit according to the present embodiment.
Figure 9:
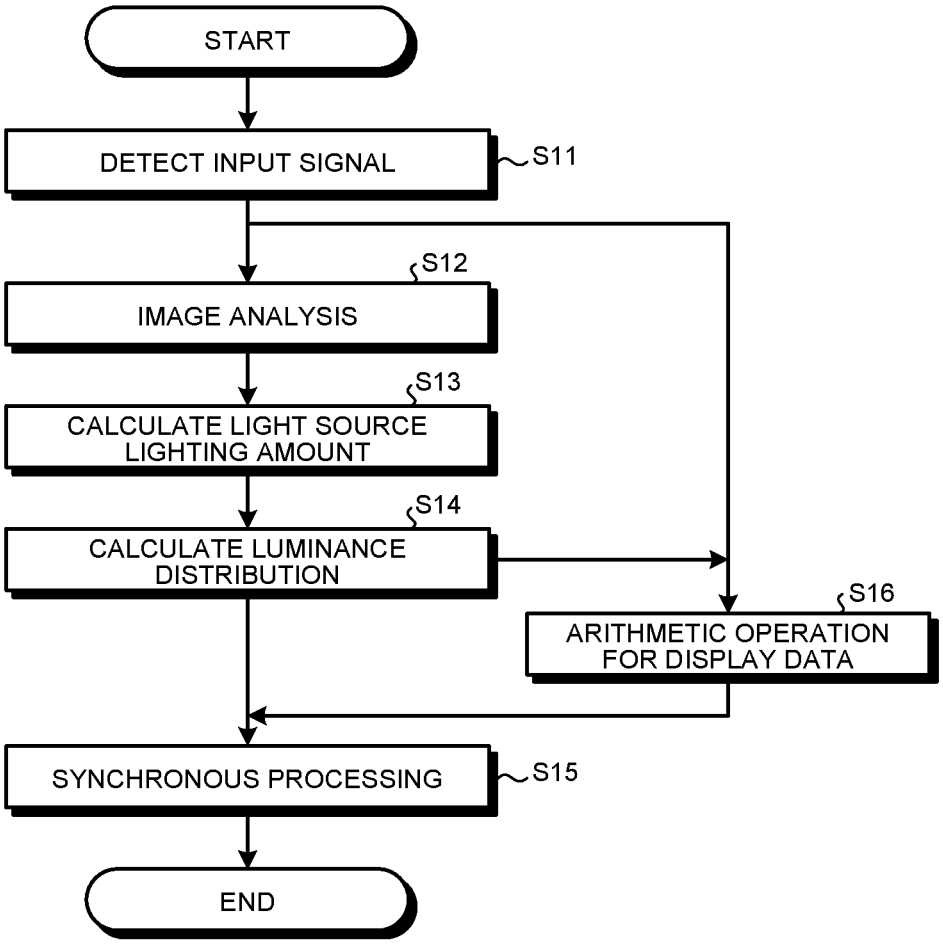
FIG. 9 is a flowchart of a method for driving the display device according to the present embodiment.

FIG. 6 is a conceptual diagram of an extended HSV color space reproducible by the display device according to the present embodiment. FIG. 7 is a conceptual diagram of a relation between a hue and saturation in the extended HSV color space. FIG. 8 is a block diagram for explaining the signal processing unit according to the present embodiment. As illustrated in FIG. 1, the signal processing unit 20 receives the input signal SRGB, which is information on an image to be displayed, from the image output unit 11 provided outside the signal processing unit 20. FIG. 9 is a flowchart of a method for driving the display device according to the present embodiment. The input signal SRGB includes information on an image (color) to be displayed at the position of each pixel as an input signal. Specifically, in the image display panel 30 including $P_0 \times Q_0$ pixels 48 arrayed in a matrix, the signal processing unit 20 receives, for the (p, q)-th pixel 48 (where $1 \leq p \leq P_0$ and $1 \leq q \leq Q_0$ are satisfied), a signal including an input signal for the first sub-pixel 49R having a signal value of $x_{1-(p,\ q)}$, an input signal for the second sub-pixel 49G having a signal value of $x_{2-(p,\ q)}$, and an input signal for the third sub-pixel 49B having a signal value of $x_{3-(p,\ q)}$ (refer to FIG. 1). As illustrated in FIG. 8, the signal processing unit 20 includes a timing generating unit 21, an image processing unit 22, an image analyzing unit 23, a light-source-drive-value calculating unit 24, a light-source-data storage unit 25, and a light-source-drive-value determining unit 26.

As illustrated in FIG. 9, the signal processing unit 20 illustrated in FIGS. 1 and 8 detects an input signal SRGB (Step S11). The timing generating unit 21 processes the input signal SRGB, thereby transmitting a synchronization signal STM for synchronizing timings of each frame in the image-display-panel driving unit 40 and the planar-light-source-device control unit 60 to the image-display-panel driving unit 40 and the planar-light-source-device control unit 60. The signal processing unit 20 performs a display data arithmetic step (Step S16). In the Step 19, the image processing unit 22 of the signal processing unit 20 processes the input signal SRGB, thereby generating an output signal for the first sub-pixel (signal value $X_{1-(p,\ q)}$) for determining display gradation in the first sub-pixel 49R, an output signal for the second sub-pixel (signal value $X_{2-(p,\ q)}$) for determining display gradation in the second sub-pixel 49G, an output signal for the third sub-pixel (signal value $X_{3-(p,\ q)}$) for determining display gradation in the third sub-pixel 49B, and an output signal for the fourth sub-pixel (signal value $X_{4-(p,\ q)}$) for determining display gradation in the fourth sub-pixel 49W. The image processing unit 22 then outputs the generated output signals to the image-display-panel driving unit 40. The following describes the display data arithmetic step (Step S16) according to the present embodiment in detail.

Because the pixels 48 each include the fourth sub-pixel 49W that outputs the fourth color (white), the display device 10 can broaden the dynamic range of brightness in the HSV color space (extended HSV color space) as illustrated in FIG. 6. Specifically, as illustrated in FIG. 6, the extended HSV color space has the following shape: a substantially truncated cone in which the maximum value of brightness V decreases as saturation S increases is placed on a cylindrical HSV color space displayable by the first sub-pixel 49R, the second sub-pixel 49G, and the third sub-pixel 49B.

The signal processing unit 20 stores therein the maximum value Vmax(S) of the brightness having the saturation S as a variable in the HSV color space expanded (extended) by adding the fourth color (e.g., white) by the image processing unit 22 of the signal processing unit 20. In other words, the signal processing unit 20 stores therein the maximum value Vmax(S) of the brightness for each pair of coordinates (coordinate values) of the saturation and the hue in the three-dimensional HSV color space illustrated in FIG. 6. Because the input signal includes the input signals for the first sub-pixel 49R, the second sub-pixel 49G, and the third sub-pixel 49B, the HSV color space of the input signal has a cylindrical shape, that is, the same shape as the cylindrical part of the extended HSV color space.

The signal processing unit 20 calculates the output signal (signal value $X_{1-(p,\ q)}$) for the first sub-pixel 49R based on at least the input signal (signal value $x_{1-(p,\ q)}$) and an expansion coefficient $\alpha$ of the first sub-pixel 49R and outputs the output signal to the first sub-pixel 49R. The signal processing unit 20 calculates the output signal (signal value $X_{2-(p,\ q)}$) for the second sub-pixel 49G based on at least the input signal (signal value $x_{2-(p,\ q)}$) and the expansion coefficient $\alpha$ of the second sub-pixel 49G and outputs the output signal to the second sub-pixel 49G. The signal processing unit 20 calculates the output signal (signal value $X_{3-(p,\ q)}$) for the third sub-pixel 49B based on at least the input signal (signal value $x_{3-(p,\ q)}$) and the expansion coefficient $\alpha$ of the third sub-pixel 49B and outputs the output signal to the third sub-pixel 49B. The signal processing unit 20 calculates the output signal (signal value $X_{4-(p,\ q)}$) for the fourth sub-pixel 49W based on the input signal (signal value $x_{1-(p,\ q)}$) for the first sub-pixel 49R, the input signal (signal value $x_{2-(p,\ q)}$) for the second sub-pixel 49G, and the input signal (signal value $x_{3-(p,\ q)}$) for the third sub-pixel 49B and outputs the output signal to the fourth sub-pixel 49W.

Specifically, the image processing unit 22 of the signal processing unit 20 calculates the output signal for the first sub-pixel 49R based on the expansion coefficient $\alpha$ of the first sub-pixel 49R and the output signal for the fourth sub-pixel 49W, calculates the output signal for the second sub-pixel 49G based on the expansion coefficient $\alpha$ of the second sub-pixel 49G and the output signal for the fourth sub-pixel 49W, and calculates the output signal for the third sub-pixel 49B based on the expansion coefficient $\alpha$ of the third sub-pixel 49B and the output signal for the fourth sub-pixel 49W.

Specifically, assuming that $\chi$ is a constant depending on the display device, the signal processing unit 20 calculates the signal value $X_{1-(p,\ q)}$ corresponding to the output signal for the first sub-pixel 49R, the signal value $X_{2-(p,\ q)}$ corresponding to the output signal for the second sub-pixel 49G, and the signal value $X_{3-(p,\ q)}$ corresponding to the output signal for the third sub-pixel 49B for the (p, q)-th pixel (or the (p, q)-th group of the first sub-pixel 49R, the second sub-pixel 49G, and the third sub-pixel 49B) using the following expressions (1) to (3), respectively.

$$X_{1-(p,\ q)}=\alpha\cdot x_{1-(p,\ q)}-\chi\cdot X_{4-(p,\ q)} \tag{1}$$

$$X_{2-(p,\ q)}=\alpha\cdot x_{2-(p,\ q)}-\chi\cdot X_{4-(p,\ q)} \tag{2}$$

$$X_{3-(p,\ q)}=\alpha\cdot x_{3-(p,\ q)}-\chi\cdot X_{4-(p,\ q)} \tag{3}$$

The signal processing unit 20 obtains the maximum value Vmax(S) of the brightness using the saturation S as a variable in the HSV color space extended by adding the fourth color, obtains the saturation S and the brightness V(S) of a plurality of pixels 48 based on input signal values of the sub-pixels 49 of the pixels 48.

The saturation S is expressed by: S=(Max−Min)/Max, and the brightness V(S) is expressed by: V(S)=Max. The saturation S takes a value from 0 to 1, and the brightness V(S) takes a value from 0 to $(2^n-1)$, where n is the number of bits for display gradation. Max is the maximum value of the input signal value for the first sub-pixel 49R, the input signal value for the second sub-pixel 49G, and the input signal value for the third sub-pixel 49B in the pixel 48. Min is the minimum value of the input signal value for the first sub-pixel 49R, the input signal value for the second sub-pixel 49G, and the input signal value for the third sub-pixel 49B in the pixel 48. As illustrated in FIG. 7, the hue H is represented in a range from 0° to 360°. The hue H varies in order of red, yellow, green, cyan, blue, magenta, and red from 0° to 360°.

In this embodiment, the signal value $X_{4-(p,\ q)}$ can be obtained based on a product of $Min_{(p,\ q)}$ and the expansion coefficient $\alpha$. Specifically, the signal value $X_{4-(p,\ q)}$ can be obtained based on the following expression (4). In the expression (4), the product of $Min_{(p,\ q)}$ and the expansion coefficient $\alpha$ is divided by $\chi$, but the present embodiment is not limited thereto. Description of $\chi$ will be provided later.

$$X_{4-(p,\ q)}=Min_{(p,\ q)}\cdot\alpha/\chi \tag{4}$$

Typically, in the (p, q)-th pixel, the saturation $S_{(p,\ q)}$ and the brightness $V(S)_{(p,\ q)}$ in the cylindrical HSV color space can be obtained through the following expressions (5) and (6) based on the input signal (signal value $x_{1-(p,\ q)}$) for the first sub-pixel 49R, the input signal (signal value $x_{2-(p,\ q)}$) for the second sub-pixel 49G, and the input signal (signal value $x_{3-(p,\ q)}$) for the third sub-pixel 49B.

$$S_{(p,\ q)}=(Max_{(p,\ q)}-Min_{(p,\ q)})/Max_{(p,\ q)} \tag{5}$$

$$V(S)_{(p,\ q)}=Max_{(p,\ q)} \tag{6}$$

In this case, $Max_{(p,\ q)}$ is the maximum value among the input signal values of three sub-pixels 49, that is, ($x_{1-(p,\ q)}$, $x_{2-(p,\ q)}$, $x_{3-(p,\ q)}$), and $Min_{(p,\ q)}$ is the minimum value among the input signal values of three sub-pixels 49, that is, ($x_{1-(p,\ q)}$, $x_{2-(p,\ q)}$, $x_{3-(p,\ q)}$). In this embodiment, n=8 is assumed. That is, the display gradation bit number is caused to be 8 (the value of display gradation is 256, that is, 0 to 255).

The fourth sub-pixel 49W that displays white is provided with no color filter. The fourth sub-pixel 49W that displays the fourth color is brighter than the first sub-pixel 49R that displays the first color, the second sub-pixel 49G that displays the second color, and the third sub-pixel 49B that displays the third color when the first to fourth sub-pixels 49W, 49R, 49G, and 49B are irradiated with light of the same light source lighting amount. Let us assume a case where $BN_{1-3}$ denotes the luminance of an aggregate of the first sub-pixel 49R, the second sub-pixel 49G, and the third sub-pixel 49B in a pixel 48 or a group of pixels 48 obtained when the first sub-pixel 49R receives a signal having a value corresponding to the maximum signal value of output signals for the first sub-pixel 49R, the second sub-pixel 49G receives a signal having a value corresponding to the maximum signal value of output signals for the second sub-pixel 49G, and the third sub-pixel 49B receives a signal having a value corresponding to the maximum signal value of output signals for the third sub-pixel 49B. Let us also assume a case where $BN_4$ denotes the luminance of the fourth sub-pixel 49W obtained when the fourth sub-pixel 49W in the pixel 48 or the group of pixels 48 receives a signal having a value corresponding to the maximum signal value of output signals for the fourth sub-pixel 49W. In other words, when the aggregate of the first sub-pixel 49R, the second sub-pixel 49G, and the third sub-pixel 49B displays white having the highest luminance, the luminance of white is represented by $BN_{1-3}$. Assuming that $\chi$ is a constant depending on the display device, the constant $\chi$ is expressed by: $\chi=BN_4/BN_{1-3}$.

Specifically, the luminance $BN_4$ in a case in which the input signal having a display gradation value of 255 is assumed to be input to the fourth sub-pixel 49W is, for example, 1.5 times the luminance $BN_{1-3}$ of white in a case in which the signal value $x_{1-(p,\ q)}=255$, the signal value $x_{2-(p,\ q)}=255$, and the signal value $x_{3-(p,\ q)}=255$ are input to the aggregate of the first sub-pixel 49R, the second sub-pixel 49G, and the third sub-pixel 49B as input signals having the above display gradation value. That is, $\chi=1.5$ in this embodiment.

When the signal value $x_{4-(p,\ q)}$ is given by the above expression (4), the maximum value Vmax(S) of the brightness can be represented by the following expressions (7) and (8).

When $S \leq S_0$, $$V\max(S)=(\chi+1)\cdot(2^n-1) \tag{7}$$

When $S_0<S\leq 1$ is satisfied, $$V\max(S)=(2^n-1)\cdot(1/S) \tag{8}$$

where $S_0=1/(\chi+1)$ is satisfied. In other words, $S_0$ denotes a threshold for the saturation S. If the saturation S of the input signal value is equal to or lower than $S_0$, the display device 10 can reproduce the brightness obtained when the fourth sub-pixel is turned on with the maximum lighting amount. By contrast, if the saturation S of the input signal value is higher than $S_0$, the display device 10 fails to reproduce the brightness obtained when the fourth sub-pixel is turned on with the maximum lighting amount.

The thus obtained maximum value Vmax(S) of the brightness using the saturation S as a variable in the HSV color space extended by adding the fourth color is stored, for example, as a kind of look-up table in the signal processing unit 20. Alternatively, the maximum value Vmax(S) of the brightness using the saturation S as a variable in the extended HSV color space is obtained by the signal processing unit 20 as occasion demands.

Next, the following describes a method (expansion processing) of obtaining the output signals for the (p, q)-th pixel 48, that is, the signal values of $X_{1-(p,\ q)}$, $X_{2-(p,\ q)}$, $X_{3-(p,\ q)}$, and $X_{4-(p,\ q)}$. The following processing is performed while maintaining a ratio between the luminance of the first primary color displayed by (the first sub-pixel 49R+the fourth sub-pixel 49W), the luminance of the second primary color displayed by (the second sub-pixel 49G+the fourth sub-pixel 49W), and the luminance of the third primary color displayed by (the third sub-pixel 49B+the fourth sub-pixel 49W). The processing is performed while keeping (maintaining) a color tone. Additionally, the processing is performed while keeping (maintaining) a gradation-luminance characteristic (gamma characteristic, $\gamma$ characteristic). When all of the input signal values are 0 or small in any of the pixels 48 or any group of the pixels 48, the expansion coefficient $\alpha$ may be obtained without including such a pixel 48 or a group of the pixels 48.

First Process

First, the signal processing unit 20 obtains the saturation S and the brightness V(S) of each of pixels 48 based on the input signal values of the sub-pixels 49 of the pixels 48. Specifically, the signal processing unit 20 obtains $S_{(p,\ q)}$ and $V(S)_{(p,\ q)}$ through the expressions (7) and (8) based on the signal value $x_{1-(p,\ q)}$ as the input signal for the first sub-pixel 49R to the (p, q)-th pixel 48, the signal value $x_{2-(p,\ q)}$ as the input signal for the second sub-pixel 49G, and the signal value $x_{3-(p,\ q)}$ as the input signal for the third sub-pixel 49B. The signal processing unit 20 performs this processing on each of the pixels 48.

Second Process

Subsequently, the signal processing unit 20 obtains the expansion coefficient $\alpha(S)$ based on Vmax(S)/V(S) obtained for the pixels 48.

$$\alpha(S)=V\max(S)/V(S) \tag{9}$$

Third Process

Next, the signal processing unit 20 obtains the signal value $X_{4-(p,\ q)}$ for the (p, q)-th pixel 48 based on at least the signal value $x_{1-(p,\ q)}$, the signal value $x_{2-(p,\ q)}$, and the signal value $x_{3-(p,\ q)}$. In this embodiment, the signal processing unit 20 determines the signal value $X_{4-(p,\ q)}$ based on $Min_{(p,\ q)}$, the expansion coefficient $\alpha$, and the constant $\chi$. More specifically, as described above, the signal processing unit 20 obtains the signal value $X_{4-(p,\ q)}$ based on the expression (4) described above. The signal processing unit 20 obtains the signal value $X_{4-(p,\ q)}$ for all of the $P_0 \times Q_0$ pixels 48.

Fourth Process

Subsequently, the signal processing unit 20 obtains the signal value $X_{1-(p,\ q)}$ for the (p, q)-th pixel 48 based on the signal value $x_{1-(p,\ q)}$, the expansion coefficient $\alpha$, and the signal value $X_{4-(p,\ q)}$, obtains the signal value $X_{2-(p,\ q)}$ for the (p, q)-th pixel 48 based on the signal value $x_{2-(p,\ q)}$, the expansion coefficient $\alpha$, and the signal value $X_{4-(p,\ q)}$, and obtains the signal value $X_{3-(p,\ q)}$ for the (p, q)-th pixel 48 based on the signal value $x_{3-(p,\ q)}$, the expansion coefficient $\alpha$, and the signal value $X_{4-(p,\ q)}$. Specifically, the signal processing unit 20 obtains the signal value $X_{1-(p,\ q)}$, the signal value $X_{2-(p,\ q)}$, and the signal value $X_{3-(p,\ q)}$ for the (p, q)-th pixel 48 based on the expressions (1) to (3) described above.

As represented by the expression (4), the signal processing unit 20 expands $Min_{(p,\ q)}$ with the expansion coefficient α. Expansion of $Min_{(p, q)}$ with the expansion coefficient α increases not only the luminance of a white display sub-pixel (fourth sub-pixel 49W) but also the luminance of a red display sub-pixel, a green display sub-pixel, and a blue display sub-pixel (corresponding to the first sub-pixel 49R, the second sub-pixel 49G, and the third sub-pixel 49B, respectively) as represented by the expressions described above. As a result, dullness in color can be prevented. In other words, expansion of $Min_{(p, q)}$ with the expansion coefficient α increases the luminance of the entire image by α times compared with a case where $Min_{(p, q)}$ is not extended. This expansion method is suitably used to display an image, such as a still image, with high luminance, for example.

As illustrated in FIG. 9, the signal processing unit 20 performs the display data arithmetic step (Step S16) and performs an image analysis on the input signal SRGB (Step S12).

The image analyzing unit 23 analyzes the fact that the signal value $X_{1-(p, q)}$, the signal value $X_{2-(p, q)}$, the signal value $X_{3-(p, q)}$, and the signal value $X_{4-(p, q)}$ in the (p, q)-th pixel 48 are extended by α times. To display an image the luminance of which is equal to that of the image not extended based on the information on the input signal SRGB of the image, the display device 10 simply needs to reduce the amount of light output from the planar light source device 50 based on the expansion coefficient α. Specifically, the light-source-drive-value calculating unit 24 and the light-source-drive-value determining unit 26 simply need to control the electric current or the on and off duty ratio for the light sources 56A to 56F individually such that the amount of light output from the planar light source device 50 is reduced by 1/α times. To perform control on each light source, the signal processing unit 20 according to the present embodiment calculates an expansion coefficient and a reciprocal thereof for each luminance determination block (described later) based on the input signal values of pixels in the luminance determination block. The expansion coefficient of each luminance determination block is hereinafter denoted by $\alpha_b$, and the reciprocal thereof is denoted by $1/\alpha_b$.

Figure 10:
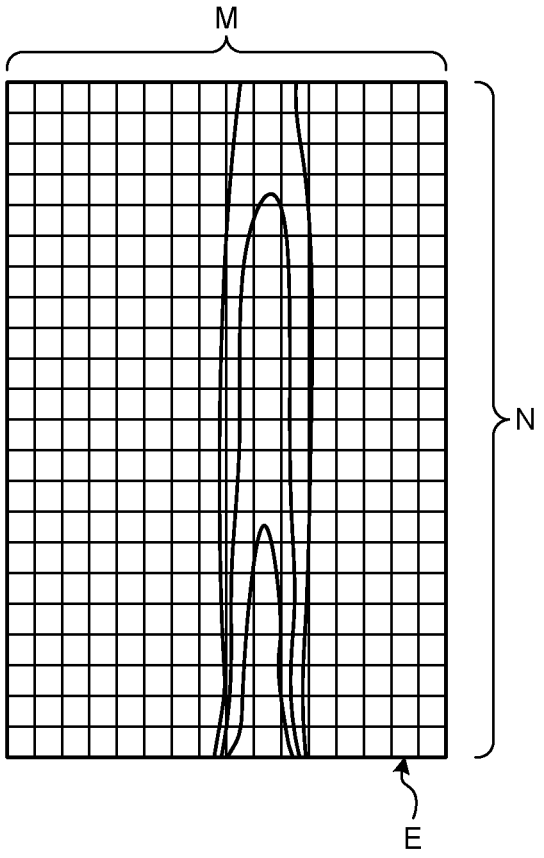
FIG. 10 is a schematic diagram for explaining information on light intensity distribution of incident light output from a certain light source and traveling from the light guide plate to a plane of the image display panel.
Figure 11:
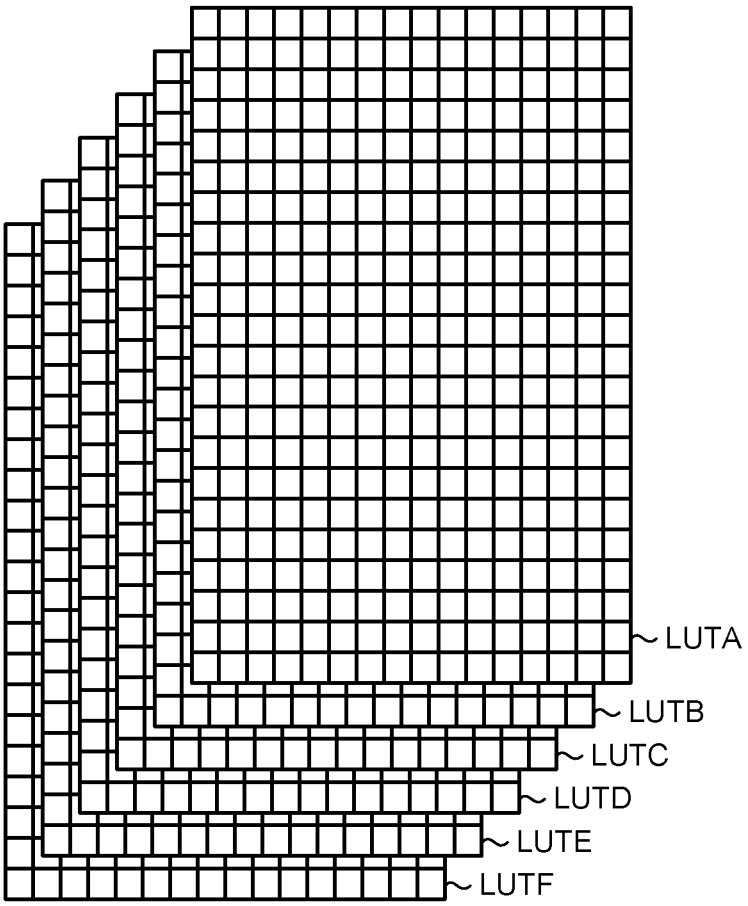
FIG. 11 is a schematic diagram for explaining lookup tables.

The following described lookup tables used in the processing described later. FIG. 10 is a schematic diagram for explaining information on light intensity distribution of incident light output from a certain light source and traveling from the light guide plate to a plane of the image display panel. FIG. 11 is a schematic diagram for explaining the lookup tables. The light-source-data storage unit 25 according to the present embodiment stores therein a plurality of lookup tables (LUTs). The lookup tables are array data composed of M×N array elements and each store therein representative values of light intensity in the respective array elements. M denotes the number of array elements in the light source array direction LY (number of columns), whereas N denotes the number of array elements in the light incident direction LX (number of rows). While the M×N array elements correspond to the respective pixels, for example, the array elements corresponding to the respective pixels may be thinned out at regular intervals, and the lookup tables may store therein the remaining array elements. Alternatively, the lookup tables may each store therein representative values of light intensity in respective divided areas obtained by virtually dividing the plane of the image display panel 30 into M×N. In this case, the representative value may be the average of light intensity in the corresponding divided area, the median of light intensity in the corresponding divided area, or the value of light intensity at any position in the corresponding divided area, for example. While the data in the lookup tables according to the present embodiment is the representative values of the respective divided areas, it is not limited thereto.

The lookup tables according to the present embodiment each store therein the representative values of light intensity in the respective divided areas obtained by virtually dividing the plane of the image display panel 30 illustrated in FIG. 3 into M×N. The light-source-data storage unit 25 stores therein the lookup tables of the respective light sources. As illustrated in FIG. 11, for example, the light-source-data storage unit 25 stores therein a lookup table LUTA. The LUTA indicates the information on the light intensity distribution of incident light obtained when only the light source 56A illustrated in FIG. 3 is turned on with a predetermined light source lighting amount (refer to FIG. 4), the incident light being incident from the light source 56A on the light guide plate 54 and traveling from the light guide plate 54 to the plane of the image display panel 30. The light-source-data storage unit 25 also stores therein a lookup table LUTB. The LUTB indicates the information on the light intensity distribution of incident light obtained when only the light source 56B illustrated in FIG. 3 is turned on with the predetermined light source lighting amount, the incident light being incident from the light source 56B on the light guide plate 54 and traveling from the light guide plate 54 to the plane of the image display panel 30. The light-source-data storage unit 25 also stores therein a lookup table LUTC. The LUTC indicates the information on the light intensity distribution of incident light obtained when only the light source 56C illustrated in FIG. 3 is turned on with the predetermined light source lighting amount, the incident light being incident from the light source 56C on the light guide plate 54 and traveling from the light guide plate 54 to the plane of the image display panel 30. The light-source-data storage unit 25 also stores therein a lookup table LUTD. The LUTD indicates the information on the light intensity distribution of incident light obtained when only the light source 56D illustrated in FIG. 3 is turned on with the predetermined light source lighting amount, the incident light being incident from the light source 56D on the light guide plate 54 and traveling from the light guide plate 54 to the plane of the image display panel 30. The light-source-data storage unit 25 also stores therein a lookup table LUTE. The LUTE indicates the information on the light intensity distribution of incident light obtained when only the light source 56E illustrated in FIG. 3 is turned on with the predetermined light source lighting amount, the incident light being incident from the light source 56E on the light guide plate 54 and traveling from the light guide plate 54 to the plane of the image display panel 30. The light-source-data storage unit 25 also stores therein a lookup table LUTF. The LUTF indicates the information on the light intensity distribution of incident light obtained when only the light source 56F illustrated in FIG. 3 is turned on with the predetermined light source lighting amount, the incident light being incident from the light source 56F on the light guide plate 54 and traveling from the light guide plate 54 to the plane of the image display panel 30.

The lookup tables LUTA to LUTF according to the present embodiment correspond to the light sources 56A to 56F, respectively. The lookup tables according to the present embodiment, for example, may be data obtained by simultaneously turning on a pair of the light sources 56A and 56B, a pair of the light sources 56C and 56D, and a pair of the light sources 56E and 56F out of the light sources 56A to 56F, respectively. This data structure can reduce labor in the operation for creating the lookup tables and the storage capacity of the light-source-data storage unit 25. As a result, an integrated circuit including the light-source-data storage unit 25 can be downsized.

The light-source-drive-value calculating unit 24 refers to the lookup tables LUTA to LUTF in the light-source-data storage unit 25. The light-source-drive-value calculating unit 24 superimposes the lookup tables LUTA to LUTF such that the light source lighting amounts are closer to $1/\alpha_b$ times the value of each block, thereby calculating the light source lighting amounts of the light sources 56A to 56F (Step S13). Representative luminance obtained by superimposing the (i, j)-th divided areas in lookup tables LUTA to LUTF (where $1 \leq i \leq N$ and $1 \leq j \leq M$ are satisfied), for example, is calculated by the following expression (10).

$$L_{(i,j)} = \sum_{k=0}^{n} \{(Ic/\alpha_{k(i,j)}) \times LUTm(P, Q)\} \tag{10}$$

$LUTm(P, Q)$: lookup table data of each light source $Ic/\alpha_k$: each light source current $m$: $A$ to $F$ With this calculation, the light-source-drive-value calculating unit 24 replaces complicated arithmetic processing with simple reference processing of the lookup tables LUTA to LUTF, thereby reducing the operation amount.

As described above, to cause the image display panel 30 to display an image, the image-display-panel driving unit 40 requires the luminance distribution in units of the pixels 48. Based on the light source lighting amounts of the light sources 56A to 56F calculated at Step S13 and the lookup tables LUTA to LUTF, the light-source-drive-value determining unit 26 calculates the luminance distribution in units of the pixels 48 (Step S14). The luminance distribution in units of the pixels 48 is calculated by performing an interpolation operation using the lookup tables LUTA to LUTF. While the luminance distribution in units of the pixels 48 has a large quantity of information, the present embodiment can reduce the operation load because the lookup tables LUTA to LUTF are created with thinned representative values.

Figure 12:
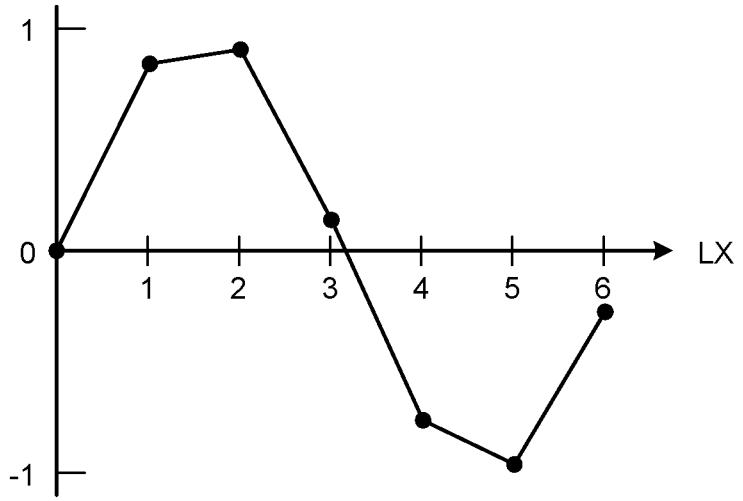
FIG. 12 is a diagram for explaining an arithmetic operation for linear interpolation.
Figure 13:
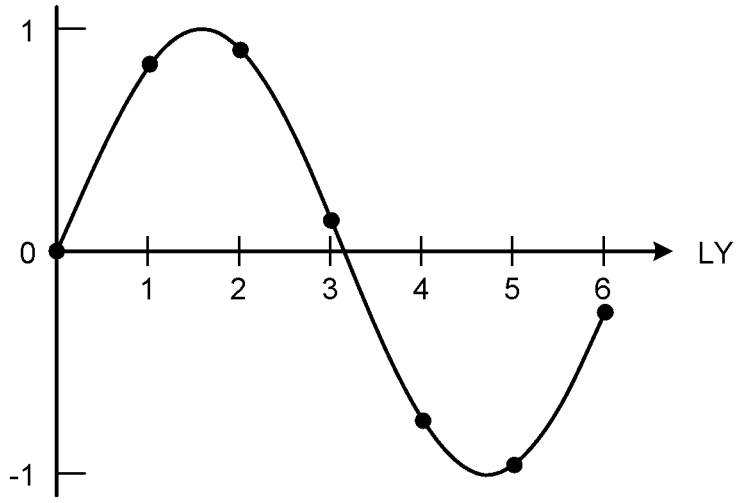
FIG. 13 is a diagram for explaining an arithmetic operation for polynomial interpolation.

The information on the luminance in units of the pixels 48 varies drastically in the light source array direction LY and moderately in the light incident direction LX. FIG. 12 is a diagram for explaining an arithmetic operation for linear interpolation. FIG. 13 is a diagram for explaining an arithmetic operation for polynomial interpolation. The information on the luminance of the pixels 48 in the light incident direction LX is obtained by performing the linear interpolation illustrated in FIG. 12. The information on the luminance of the pixels 48 in the light source array direction LY is obtained by performing the polynomial interpolation illustrated in FIG. 13. The polynomial interpolation is cubic interpolation, for example. The lookup tables LUTA to LUTF simply need to store therein values of light intensity at least at the peak positions of light output from the respective light sources and at positions between the adjacent light sources in the light source array direction LY.

Figure 14:
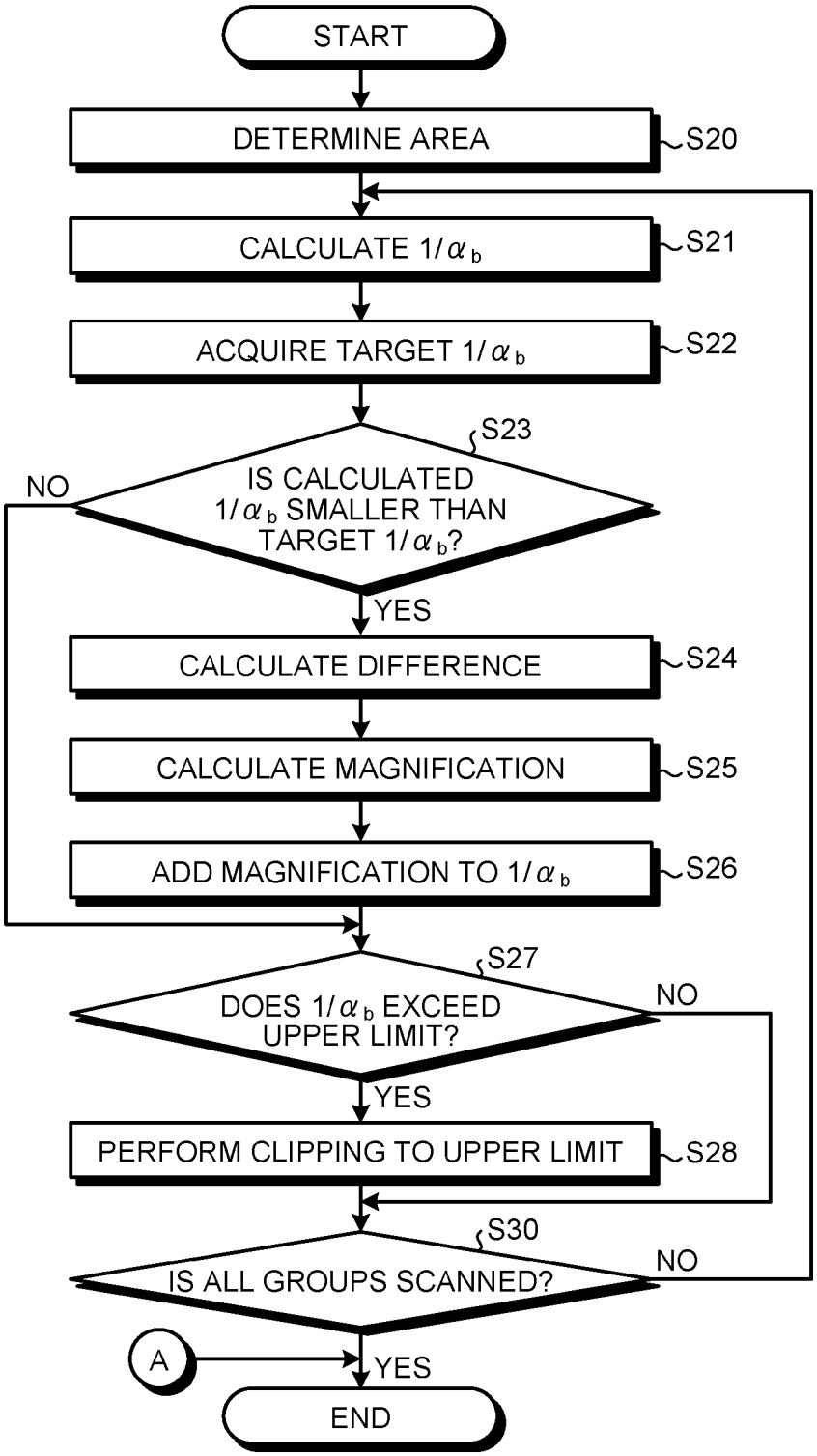
FIG. 14 is a detailed flowchart of an image analysis and light source drive value calculation step according to the present embodiment.
Figure 15:
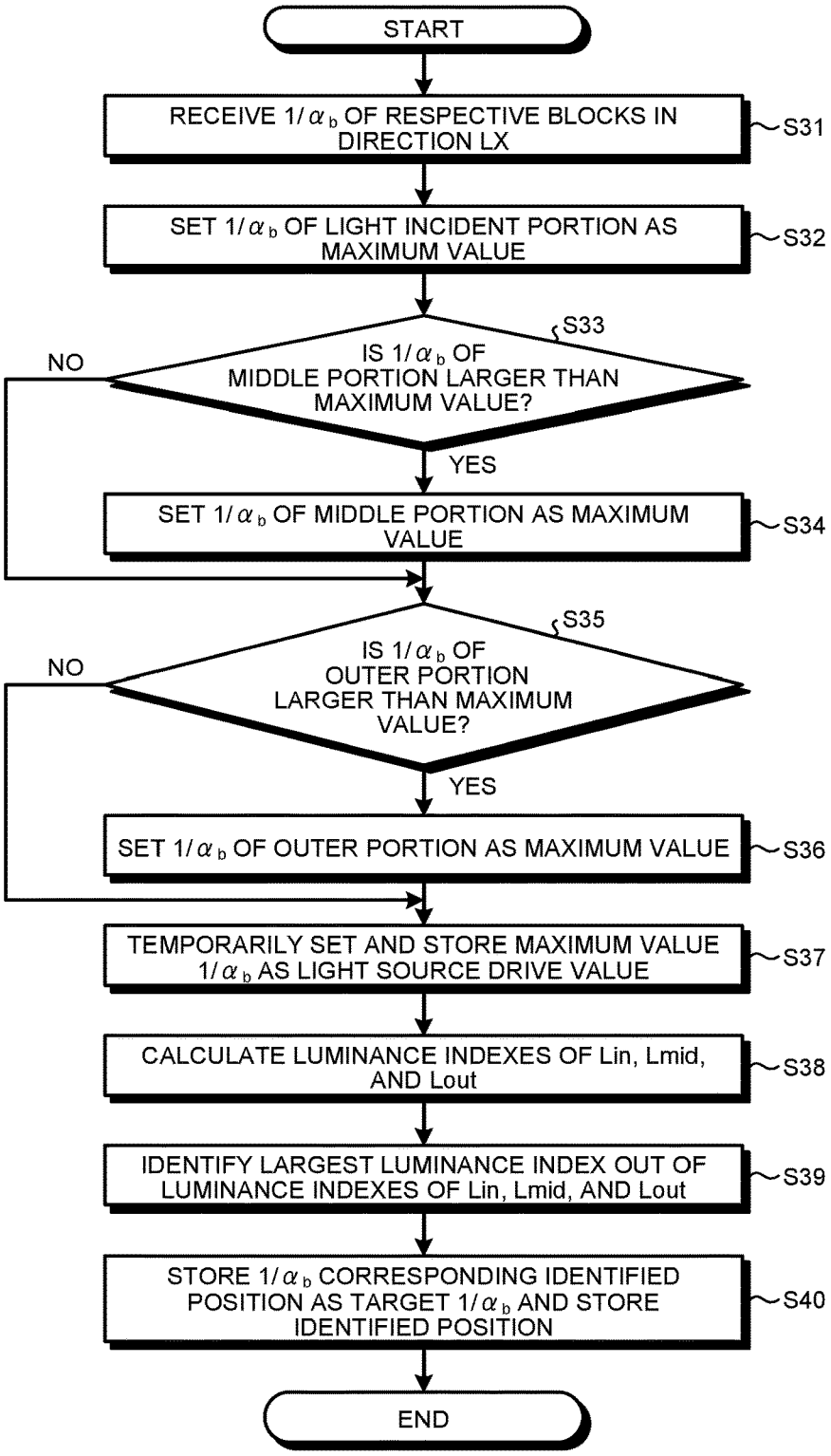
FIG. 15 is a flowchart for explaining a step of determining a drive value of each light source according to the present embodiment.
Figure 16:
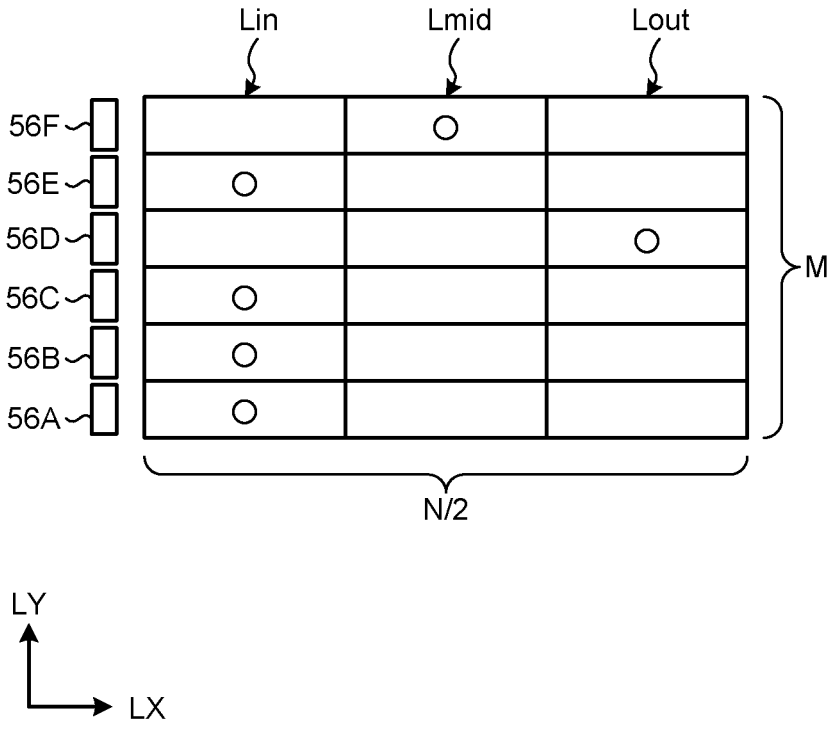
FIG. 16 is a diagram for explaining identified (flagged) luminance determination blocks according to the present embodiment.

FIG. 14 is a detailed flowchart of an image analysis and light source drive value calculation step according to the present embodiment. FIG. 15 is a flowchart for explaining a step of determining a drive value of each light source according to the present embodiment. FIG. 16 is a diagram for explaining identified (flagged) luminance determination blocks according to the present embodiment. The following describes the image analysis and light source drive value calculation step with reference to FIGS. 14 to 16. The luminance determination blocks will be described. As illustrated in FIG. 16, the luminance determination blocks (which may simply referred to as blocks) include a light incident portion Lin, a middle portion Lmid, and an outer portion Lout. Columns each of which includes the light incident portion Lin, the middle portion Lmid, and the outer portion Lout aligned in the light incident direction LX are aligned in the light source array direction LY. Thus, the light incident portion Lin, the middle portion Lmid, and the outer portion Lout are luminance determination blocks obtained by virtually dividing the first display surface 31 (refer to FIG. 3) of the image display panel 30 into a matrix in the light source array direction LY and the light incident direction LX. The luminance determination blocks according to the present embodiment are arranged in a form of six columns in the light source array direction LY and three rows in the light incident direction LX. The number of columns of the luminance determination blocks in the light source array direction LY illustrated in FIG. 16 corresponds to the number of the light sources 56A to 56F, each of the columns including the light incident portion Lin, the middle portion Lmid, and the outer portion Lout. In the luminance determination blocks illustrated in FIG. 16, the number of luminance determination blocks in the light incident direction LX is three of the light incident portion Lin, the middle portion Lmid, and the outer portion Lout. The opposite light incident portion Lout, the middle portion Lmid, and the light incident portion Lin are closer to the center line LXc in the light incident direction LX in this order. The present embodiment considers three blocks present at the same position in the light source array direction LY (the light incident portion Lin, the middle portion Lmid, and the outer portion Lout) as one group. In this arrangement, a plurality of groups are aligned in the light source array direction LY. The processing described later is performed while sequentially specifying each of the groups as a group of interest.

The image analyzing unit 23 calculates $1/\alpha_b$ of the luminance determination blocks based on the input signal values included in the luminance determination blocks as described above. After specifying one group as a group of interest, the light-source-drive-value calculating unit 24 receives (acquires) the calculated $1/\alpha_b$ of the blocks in the group of interest (blocks aligned in the light incident direction LX) as illustrated in FIG. 15 (Step S31). The light-source-drive-value calculating unit 24 sets $1/\alpha_b$ of the light incident portion Lin as the maximum value (Step S32). If $1/\alpha_b$ of the middle portion Lmid in the group of interest is larger than the maximum value (Yes at Step S33), the light-source-drive-value calculating unit 24 sets $1/\alpha_b$ of the middle portion Lmid as the maximum value (Step S34). The middle portion Lmid in the group of interest is a portion present at the same position in the light source array direction LY as the light incident portion Lin having its value set as the maximum value at Step S32. If $1/\alpha_b$ of the middle portion Lmid in the group of interest is equal to or smaller than the maximum value (No at Step S33), the light-source-drive-value calculating unit 24 performs the processing at Step S35 using $1/\alpha_b$ of the light incident portion Lin as the maximum value.

If $1/\alpha_b$ of the outer portion Lout in the group of interest is larger than the maximum value (Yes at Step S35), the light-source-drive-value calculating unit 24 sets $1/\alpha_b$ of the outer portion Lout as the maximum value (Step S36). The outer portion Lout is a portion present at the same position in the light source array direction LY as the light incident portion Lin having its value set as the maximum value at Step S32. If $1/\alpha_b$ of the outer portion Lout in the group of interest is equal to or smaller than the maximum value (No at Step S35), the light-source-drive-value calculating unit 24 performs the processing at Step S37 without replacing the maximum value.

The light-source-drive-value calculating unit 24 temporarily sets the maximum value $1/\alpha_b$ as a light source drive value and stores it therein (Step S37). While the explanation has been made of an example where the light-source-drive-value calculating unit 24 compares $1/\alpha_b$ of the luminance determination blocks calculated based on the input signal values of the luminance determination blocks to identify the maximum value in the group of interest, the present disclosure is not limited thereto. The light-source-drive-value calculating unit 24 may multiply $1/\alpha_b$ of the luminance determination blocks calculated based on the input signal values of the luminance determination blocks by the values of light intensity at the positions corresponding to the respective luminance determination blocks stored in the lookup table. The light-source-drive-value calculating unit 24 then compares the values obtained by the multiplication to identify the maximum value in each group.

Assuming that the light source drive value is $1/\alpha_{i\text{-}max}$, the light-source-drive-value calculating unit 24 calculates luminance indexes of the light incident portion Lin, the middle portion Lmid, and the outer portion Lout in the group of interest by the following expressions (11) to (13), respectively (Step S38). In the following expressions, LUTm ($P_{Lin}$, $Q_{Lin}$) denotes data in the $P_{Lin}$-th column and the $Q_{Lin}$-th row in a lookup table m. The data in the $P_{Lin}$-th column and the $Q_{Lin}$-th row may be data of each pixel, data of each luminance determination block, or data of each divided area obtained by virtually dividing the image display panel 30 into predetermined areas. This format is also applicable to LUTm ($P_{Lmid}$, $Q_{Lmid}$) and LUTm ($P_{Lout}$, $Q_{Lout}$).

$$\text{luminance index of } Lin=(1/\alpha_{Lin})/\Sigma\{(1/\alpha_{i\text{-}max})\times LUTm(P_{Lin},Q_{Lin})\} \tag{11}$$

($1/\alpha_{Lin}$): $1/\alpha$ of the block of Lin
($1/\alpha_{i\text{-}max}$): light source drive value
LUTm($P_{Lin}$,$Q_{Lin}$): lookup table data of each light source
m: A to F $$\text{luminance index of } Lmid=(1/\alpha_{Lmid})/\Sigma\{(1/\alpha_{i\text{-}max})\times LUTm(P_{Lmid},Q_{Lmid})\} \tag{12}$$

($1/\alpha_{Lmid}$): $1/\alpha$ of the block of Lmid
($1/\alpha_{i\text{-}max}$): light source drive value
LUTm($P_{Lmid}$,$Q_{Lmid}$): lookup table data of each light source
m: A to F $$\text{luminance index of } Lout=(1/\alpha_{Lout})/\Sigma\{(1/\alpha_{i\text{-}max})\times LUTm(P_{Lout},Q_{Lout})\} \tag{13}$$

($1/\alpha_{Lout}$): $1/\alpha$ of the block Lout
($1/\alpha_{i\text{-}max}$): light source drive value
LUTm($P_{Lout}$,$Q_{Lout}$): lookup table data of each light source
m: A to F The light-source-drive-value calculating unit 24 identifies the largest luminance index out of the luminance indexes of the light incident portion Lin, the middle portion Lmid, and the outer portion Lout calculated at Step S38 (Step S39).

The light-source-drive-value calculating unit 24 stores therein $1/\alpha_b$ corresponding to the luminance index identified at Step S39 as a target $1/\alpha_b$ and stores therein the position of the identified block serving as a block corresponding to the identified luminance index and one of the light incident portion Lin, the middle portion Lmid, and the outer portion Lout in the group of interest (Step S40). The identified block corresponds to a luminance determination block to be a target of luminance correction, and $1/\alpha_b$ of the identified luminance determination block corresponds to the target $1/\alpha_b$ for the group to which the luminance determination block belongs. The "block to be a target of luminance correction" may be hereinafter simply referred to as a "luminance correction target block".

The example illustrated in FIG. 16 indicates that the luminance determination blocks identified with a flag of a circle have the maximum value.

After the determination of the target $1/\alpha_b$, the image analyzing unit 23 determines the area of the luminance determination block as illustrated in FIG. 14 (Step S20). The light-source-drive-value calculating unit 24 specifies a group of interest and calculates $1/\alpha_b$ of the luminance correction target block in the specified group of interest (Step S21). The calculated $1/\alpha_b$ is a value corresponding to the luminance of the luminance correction target block assuming that the light sources are turned on with the respective light source drive values temporarily set as described above (or corrected by the processing described later), and is different from the light source drive value of each luminance correction target block (each light source). Specifically, $1/\alpha_b$ can be calculated using the values of light intensity in the lookup tables corresponding to the light sources 56A to 56F. The light-source-drive-value calculating unit 24 calculates $1/\alpha_b$ of the luminance correction target block using the following expression (14), for example.

$$1/\alpha_G = \sum_{k=0}^{n} \{(1/\alpha_k)\times LUTm(P, Q)\} \tag{14}$$

$LUTm(P, Q)$: lookup table data of each light source $1/\alpha_k$: light source drive value of the luminance correction target block $m$: $A$ to $F$ In the expression (14), $1/\alpha_G$ denotes the result of calculation of $1/\alpha_b$ of the luminance correction target block performed at Step S21, LUTm (P, Q) denotes data (value of light intensity) in the P-th column and the Q-th row in the lookup table m, and $1/\alpha_k$ denotes the light source drive value $1/\alpha_b$ of the luminance correction target block in each group. In this example, each group corresponds to any one of the light sources 56A to 56F, and the lookup tables LUTA to LUTF correspond to the light sources 56A to 56F, respectively. In the expression (14), the light source drive value of the luminance correction target block in each group is multiplied by data of the position (P, Q) of the luminance correction target block in the lookup table corresponding to the group (light source). Calculation of the sum of the values obtained by the multiplication derives $1/\alpha_b$ ($1/\alpha_G$ in the expression (14)) with the effect of light from all the light sources taken into consideration. In the expression (14), the latest $1/\alpha_b$ of the luminance correction target block in each group is used as $1/\alpha_k$. In other words, after luminance correction (correction of $1/\alpha_b$) of a luminance correction target block in a group of interest is performed by the processing described later, $1/\alpha_b$ resulting from the luminance correction is used as $1/\alpha_k$ of the luminance correction target block in the group of interest to perform the calculation at Step S21 on another luminance correction target block in a group that is subjected to luminance correction after the correction of the group of interest.

Subsequently, as illustrated in FIG. 14, the light-source-drive-value calculating unit 24 acquires the target $1/\alpha_b$ of the group of interest (Step S22). The light-source-drive-value calculating unit 24 then performs correction of the luminance (correction of the light source drive value) described below.

Figure 17:
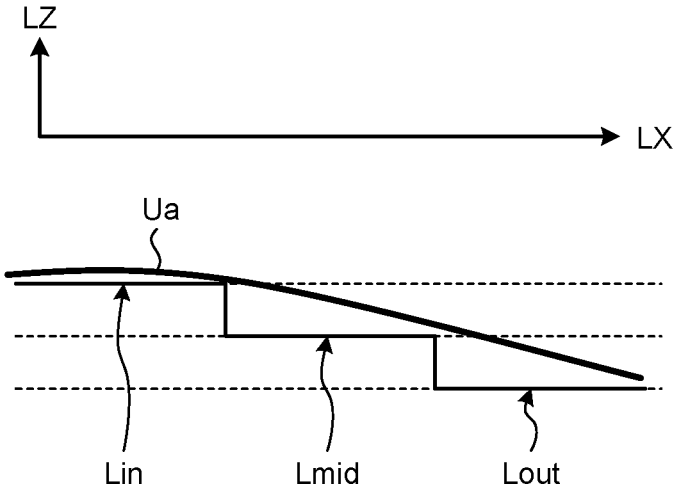
FIG. 17 is a diagram for explaining a case where the luminance is highest at a light incident portion in the luminance determination blocks according to the present embodiment.
Figure 18:
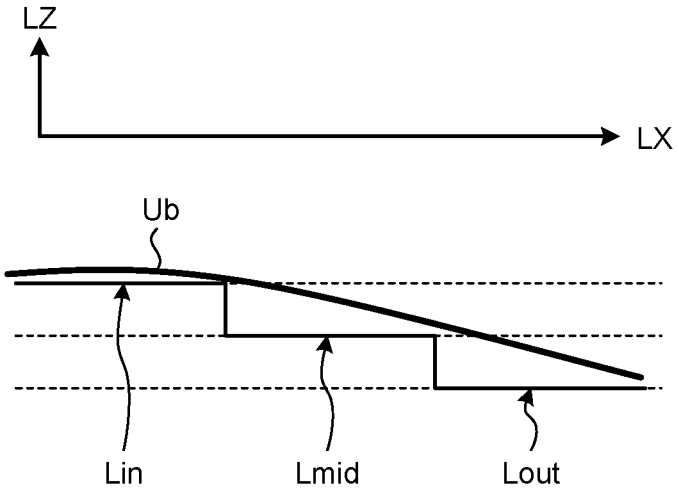
FIG. 18 is a diagram for explaining actual luminance of the luminance determination blocks illustrated in FIG. 17.
Figure 19:
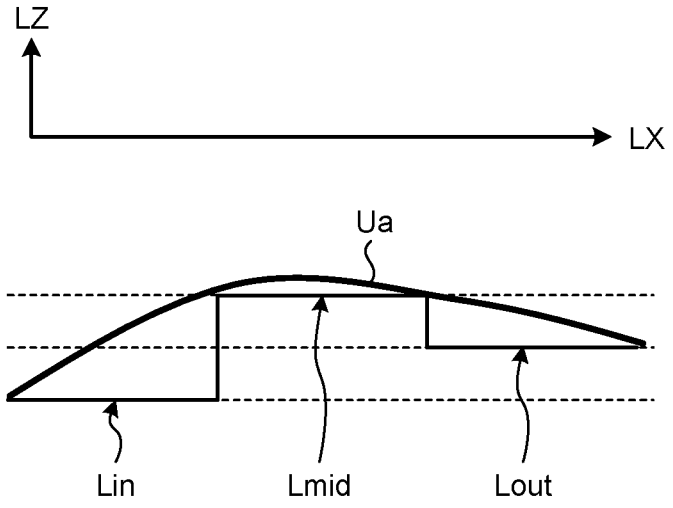
FIG. 19 is a diagram for explaining a case where the luminance is highest at a middle portion in the luminance determination blocks according to the present embodiment.
Figure 20:
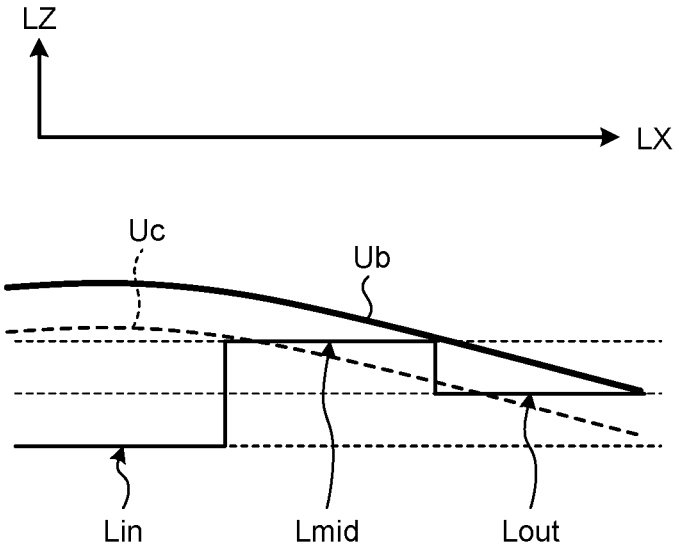
FIG. 20 is a diagram for explaining actual luminance of the luminance determination blocks illustrated in FIG. 19.
Figure 21:
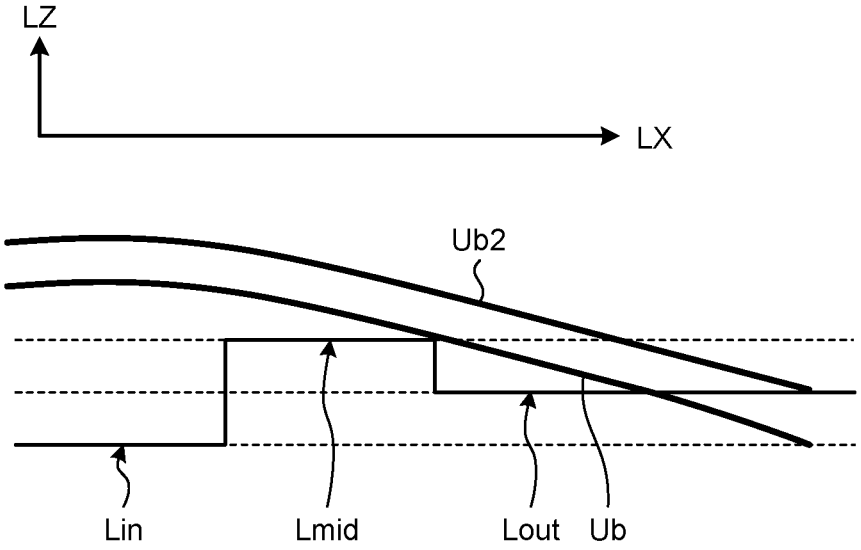
FIG. 21 is another diagram for explaining actual luminance of the luminance determination blocks illustrated in FIG. 19.
Figure 22:
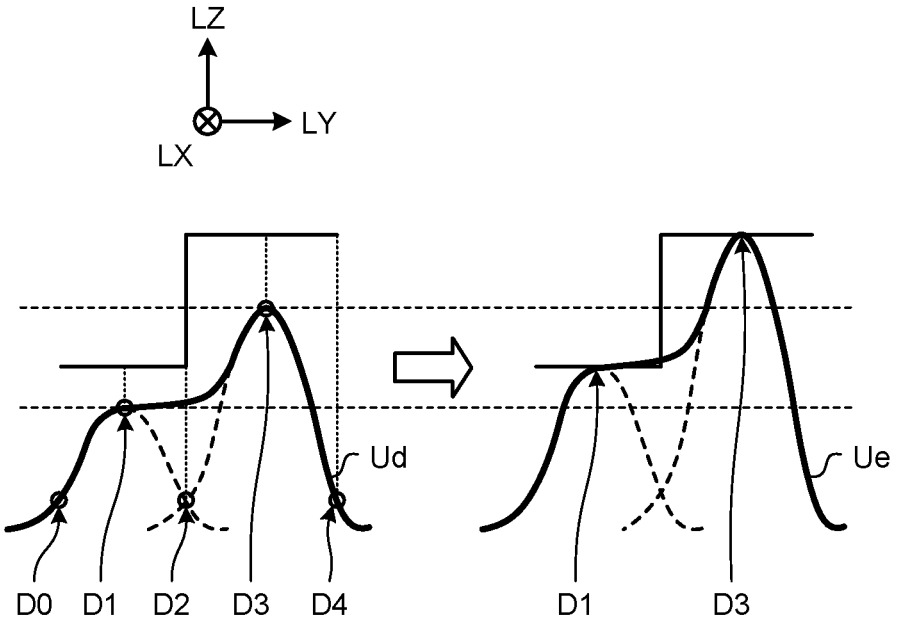
FIG. 22 is a conceptual diagram for explaining an increase in the light source lighting amount to compensate insufficient luminance according to the present embodiment.

FIGS. 17 to 21 schematically illustrate the light source lighting amount in the illumination direction LZ of the light incident portion Lin, the middle portion Lmid, and the outer portion Lout present at the same position in the light source array direction LY. Let us assume a case where $1/\alpha_b$ and the luminance index in the light incident portion Lin out of the light incident portion Lin, the middle portion Lmid, and the outer portion Lout present at the same position in the light source array direction LY are each the maximum value, for example. In this case, a curve Ua indicating the light source lighting amount of an ideal light source illustrated in FIG. 17 is similar to a curve Ub indicating the light source lighting amount of an actual light source illustrated in FIG. 18. This is because light output from a light source has characteristics that the light amount decreases as it travels away from the first incident surface E1. Let us also assume a case where $1/\alpha_b$ in the middle portion Lmid out of the light incident portion Lin, the middle portion Lmid, and the outer portion Lout present at the same position in the light source array direction LY is the maximum value as illustrated in FIG. 19, for example. In this case, the luminance of the curve Ua indicating the light source lighting amount of the ideal light source illustrated in FIG. 19 is hard to ensure by a single light source. To address this, it is necessary to increase the luminance in the light incident portion Lin, which originally need not be increased, thereby making $1/\alpha_b$ in the light incident portion Lin the largest as represented by the curve $U_b$ indicating the light source lighting amount of the actual light source illustrated in FIG. 20. In this case, the luminance index of the middle portion Lmid is the maximum value. If the luminance index is calculated using the value of light intensity at a position closest to the light source in the block of the middle portion Lmid, $1/\alpha_b$ in the middle portion Lmid and the outer portion Lout may possibly fall short as represented by a curve Uc indicating the light source lighting amount. Consequently, the luminance index needs to be calculated using the value of light intensity at a position farthest from the light source in each block. Even when $1/\alpha_b$ of the middle portion Lmid is the largest as illustrated in FIG. 21, and the light source lighting amount is set so as to supply necessary luminance to the middle portion Lmid, the light may possibly have the characteristics indicated by the curve Ub, thereby failing to supply necessary luminance to the outer portion Lout. In this case, it is necessary to set the light source lighting amount having characteristics indicated by a curve Ub2, and the luminance index is used to determine whether the light source lighting amount is set in this manner. In this case, the luminance index of the outer portion Lout is the maximum value. The first sidelight light source 52A according to the present embodiment can perform individual drive control on the light sources 56A to 56F. With this control, a curve Ud indicating the light source lighting amount of the light source is corrected to a curve Ue as illustrated in FIG. 22. As illustrated in FIG. 22, the light-source-drive-value calculating unit 24 holds at least data positions and luminance of peaks and troughs (D0 to D4) in the luminance in the light source array direction LY and holds at least one or more pieces of data of the light incident portion Lin, the middle portion Lmid, and the outer portion Lout in the light incident direction LX. If the curve Ud is corrected to the curve Ue as illustrated in FIG. 22, the luminance levels of the peaks D1 and D3 in the luminance are changed out of the peaks and the troughs (D0 to D4) in the luminance.

If $1/\alpha_b$ of the luminance correction target block in the group of interest calculated at Step S21 is smaller than the target $1/\alpha_b$ of the group of interest (Yes at Step S23), the light-source-drive-value calculating unit 24 calculates the difference between the calculated $1/\alpha_b$ and the target $1/\alpha_b$ (Step S24). The light-source-drive-value calculating unit 24 then calculates the magnification of the difference (Step S25). The light-source-drive-value calculating unit 24 calculates how many times larger the difference is than the value in the lookup table at the position. Specifically, the light-source-drive-value calculating unit 24 reads data corresponding to the position of the block to be a target of luminance correction from the lookup table of the light source corresponding to the position of the block to be a target of luminance correction in the light source array direction LY. The read data is referred to as Percentage for convenience. The magnification is calculated by dividing a difference Sub between the calculated $1/\alpha_b$ and the target $1/\alpha_b$ by Percentage. The lookup tables LUTA to LUTF according to the present embodiment store therein the light intensity distribution obtained when the light sources are turned on at the maximum output (output of 100%). By dividing the difference by the value of light intensity in the lookup table, the light-source-drive-value calculating unit 24 can derive the ratio (magnification) of the difference to the value of light intensity of 100%.

The light-source-drive-value calculating unit 24 adds the calculated magnification of the difference to $1/\alpha_b$ calculated based on the input signal and temporarily set at Step S37 (Step S26). In other words, if $1/\alpha_b$ calculated at Step S21 is smaller than the target $1/\alpha_b$ of the block, the light-source-drive-value calculating unit 24 adds the calculated magnification of the difference to the temporarily set $1/\alpha_b$ (Step S26), thereby compensating the luminance of the block having insufficient luminance. Subsequently, the light-source-drive-value calculating unit 24 performs the processing at Step S27.

By contrast, if $1/\alpha_b$ calculated at Step S21 is equal to or larger than the target $1/\alpha_b$ of the group of interest (No at Step S23), the light-source-drive-value calculating unit 24 skips the processing from Step S24 to Step S26 and performs the processing at Step S27. If $1/\alpha_b$ of the luminance correction target block exceeds an upper limit (Yes at Step S27), the light-source-drive-value calculating unit 24 performs clipping for replacing $1/\alpha_b$ with the upper limit (Step S28). If positive determination is made at Step S23, $1/\alpha_b$ of the luminance correction target block compared with the upper limit at Step S27 is the light source drive value $1/\alpha_b$ resulting from the correction at Step S26. By contrast, if negative determination is made at Step S23, $1/\alpha_b$ is the temporarily set light source drive value $1/\alpha_b$. The upper limit is set in advance as an upper limit of the light source drive value used in light source control. After the processing at Step S28, the light-source-drive-value calculating unit 24 performs the processing at Step S30. By contrast, if $1/\alpha_b$ of the luminance correction target block does not exceed the upper limit (No at Step S27), the light-source-drive-value calculating unit 24 skips the processing at Step S28 and performs the processing at Step S30. If scanning of all the groups is completed (Yes at Step S30), the light-source-drive-value calculating unit 24 finishes the process illustrated in FIG. 14. By contrast, if scanning of all the groups is not completed (No at Step S30), the light-source-drive-value calculating unit 24 specifies the next group as a group of interest and performs the processing at Step S21 again. With the processing described above, the light source drive value $1/\alpha_b$ of each block temporarily set at Step S37 is corrected. If negative determination is made at Step S23 and Step S27, the temporarily set light source drive value may possibly not be corrected. In this case, the temporarily set light source drive value is used for control of the light source lighting amount of the light source without any change. The light source lighting amount is calculated from $1/\alpha_b$ of each block derived in this manner. Subsequently, $1/\alpha_b$ of each luminance correction target block calculated as described above is used as the light source drive value $1/\alpha_k$ of each light source. The light source drive values $1/\alpha_k$ of the light sources 56A to 56F are thus calculated. Based on the light source drive value $1/\alpha_k$ and the lookup table, the representative luminance is calculated by the expression (10).

The representative luminance of the light sources 57A to 57F of the second sidelight light source 52B can be calculated in the same manner. As described above, the temporarily set $1/\alpha_b$ is corrected such that $1/\alpha_b$ of each luminance correction target block is equal to the target $1/\alpha_b$. The light source lighting amount of each light source is controlled based on the corrected $1/\alpha_b$. In other words, the light source lighting amount of each light source is controlled such that the luminance of each luminance correction target block satisfies the target luminance.

The method for calculating the light source drive value described above is also applicable to a display device including a sidelight light source only at a position facing an incident surface (e.g., E1) on one side surface of the light guide plate 54 as illustrated in FIG. 16. The calculation method is also applicable to a display device including sidelight light sources (the first sidelight light source 52A and the second sidelight light source 52B) at positions facing incident surfaces (e.g., E1 and E2) on both side surfaces of the light guide plate 54 as illustrated in FIG. 3. In this case, the calculation method is applicable to a case where an image is displayed by turning on only one of the first sidelight light source 52A and the second sidelight light source 52B. The calculation method is also applicable to a case where an image is displayed by turning on both of the first sidelight light source 52A and the second sidelight light source 52B. In this case, however, the first display surface 31 is affected not only by light output from the first sidelight light source 52A but also by light output from the second sidelight light source 52B. The second display surface 32 is affected not only by light output from the second sidelight light source 52B but also by light output from the first sidelight light source 52A. Therefore, the light-source-drive-value calculating unit 24 preferably calculates the light source drive values $1/\alpha_b$ of the two sidelight light sources not separately but collectively while taking into consideration the interaction between the two sidelight light sources.

The embodiment described below, for example, calculates the light source lighting amount $1/\alpha_k$ of each light source with higher accuracy while taking into consideration light to which the light sources of the first sidelight light source 52A and the light sources of the second sidelight light source 52B are interactively contribute.

Figure 23:
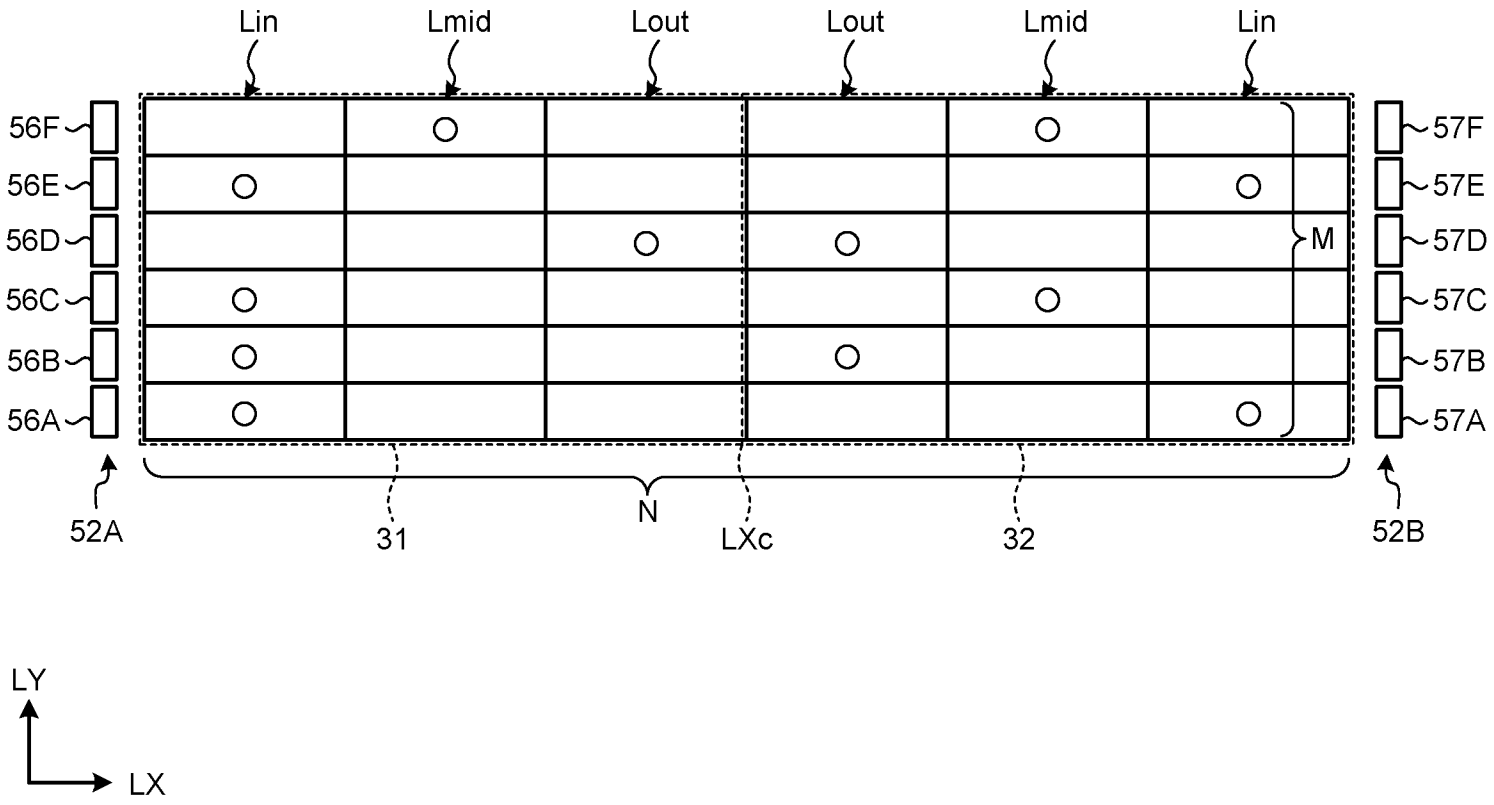
FIG. 23 is another diagram for explaining identified (flagged) luminance determination blocks according to the present embodiment.

FIG. 23 is another diagram for explaining identified (flagged) luminance determination blocks according to the present embodiment. The following describes arrangement of blocks in a case where the light sources of the first sidelight light source 52A and the light sources of the second sidelight light source 52B are used. The second display surface 32 of the image display panel 30 also has the light incident portion Lin, the middle portion Lmid, and the outer portion Lout obtained by virtually dividing the second display surface 32 into a matrix in the light source array direction LY and the light incident direction LX. On the second display surface 32 of the image display panel 30, the outer portion Lout, the middle portion Lmid, and the light incident portion Lin are closer to the center line LXc in the light incident direction LX in this order. With this arrangement, the groups of three blocks (the light incident portions Lin, the middle portions Lmid, and the outer portions Lout) present at the same position in the light source array direction LY are line-symmetric with respect to the center line LXc in the light incident direction LX. On the second display surface 32 illustrated in FIG. 23, the number of rows of the luminance determination blocks in the light source array direction LY composed of the light incident portion Lin, the middle portion Lmid, and the outer portion Lout corresponds to the number of the light sources 57A to 57F.

On the second display surface 32, the three blocks present at the same position in the light source array direction LY (the light incident portion Lin, the middle portion Lmid, and the outer portion Lout) are considered as one group. In this arrangement, a plurality of groups are aligned in the light source array direction LY. The groups on the second display surface 32 are included in all the groups at Step S30. In the processing illustrated in FIG. 15, the light source drive value is temporarily set and the target $1/\alpha_b$ is calculated for each of the groups on the first display surface 31 and the groups on the second display surface 32. In the processing illustrated in FIG. 14, if scanning of the groups on the first display surface 31 is completed, but scanning of the groups on the second display surface 32 is not completed (No at Step S30), the light-source-drive-value calculating unit 24 specifies the next group as a group of interest and performs the processing at Step S21 again.

Figure 24:
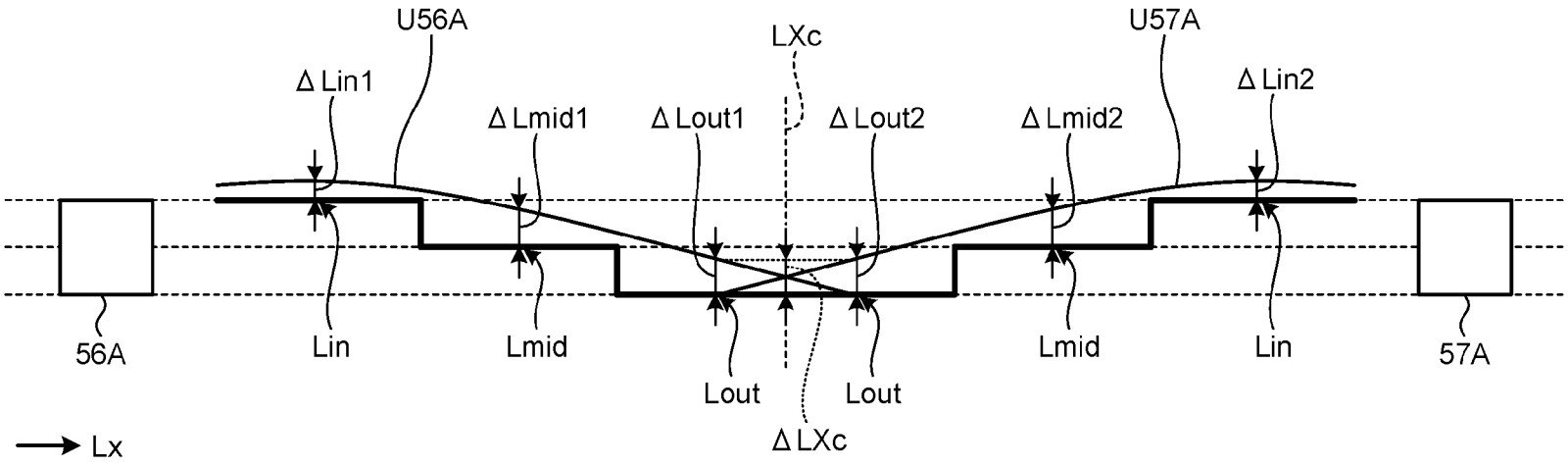
FIG. 24 is a diagram for explaining actual luminance of the luminance determination blocks.

As a result, as illustrated in FIG. 23, the luminance determination blocks identified with a flag of a circle are independently set on the first display surface 31 and the second display surface 32. In two groups corresponding to the light sources 56A and 57A illustrated in FIG. 23, for example, the luminance is higher in the respective light incident portions Lin as illustrated in FIG. 18. FIG. 24 is a diagram for explaining actual luminance of the luminance determination blocks. In a curve U56A indicating the light source lighting amount of the light source 56A on the first display surface 31, light source lighting amount differences ΔLin1, ΔLmid1, and ΔLout1 of the light incident portion Lin, the middle portion Lmid, and the outer portion Lout, respectively, are ideally reduced to the minimum. Similarly, in a curve U57A indicating the light source lighting amount of the light source 57A on the second display surface 32, light source lighting amount differences ΔLin2, ΔLmid2, and ΔLout2 of the light incident portion Lin, the middle portion Lmid, and the outer portion Lout, respectively, are ideally reduced to the minimum. Even if the light source 56A is turned on such that the luminance falls on an ideal curve U56A, light output from the light source 57A opposite thereto may possibly affect the first display surface 31. Similarly, even if the light source 57A is turned on such that the luminance falls on an ideal curve U57A, light output from the light source 56A opposite thereto may possibly affect the second display surface 32. To reduce an unintended light source lighting amount difference ΔLXc illustrated in FIG. 24, for example, it is necessary to set the light source drive value $1/\alpha_k$ of the light source 56A while taking into consideration the effects not only of the light sources 56B to 56F but also of the light sources 57A to 57F.

The present embodiment performs the following processing. The image analyzing unit 23 calculates $1/\alpha_b$ of the luminance determination blocks based on the input signal values included in the luminance determination blocks as described above. After specifying one group as a group of interest, the light-source-drive-value calculating unit 24 receives (acquires) the calculated $1/\alpha_b$ of the blocks in the group of interest (blocks aligned in the light incident direction LX) as illustrated in FIG. 15 (Step S31). The light-source-drive-value calculating unit 24 sets $1/\alpha_b$ of the light incident portion Lin as the maximum value (Step S32). If $1/\alpha_b$ of the middle portion Lmid in the group of interest is larger than the maximum value (Yes at Step S33), the light-source-drive-value calculating unit 24 sets $1/\alpha_b$ of the middle portion Lmid as the maximum value (Step S34). The middle portion Lmid is a portion present at the same position in the light source array direction LY as the light incident portion Lin having its value set as the maximum value at Step S32. If $1/\alpha_b$ of the middle portion Lmid in the group of interest is equal to or smaller than the maximum value (No at Step S33), the light-source-drive-value calculating unit 24 performs the processing at Step S35 using $1/\alpha_b$ of the light incident portion Lin as the maximum value.

If $1/\alpha_b$ of the outer portion Lout in the group of interest is larger than the maximum value (Yes at Step S35), the light-source-drive-value calculating unit 24 sets $1/\alpha_b$ of the outer portion Lout as the maximum value (Step S36). The outer portion Lout is a portion present at the same position in the light source array direction LY as the light incident portion Lin having its value set as the maximum value at Step S32. If $1/\alpha_b$ of the outer portion Lout in the group of interest is equal to or smaller than the maximum value (No at Step S35), the light-source-drive-value calculating unit 24 performs the processing at Step S37 without replacing the maximum value.

The light-source-drive-value calculating unit 24 temporarily sets the maximum value $1/\alpha_b$ as the light source drive value and stores it therein (Step S37). Also in this example where the first sidelight light source 52A and the second sidelight light source 52B are used, the light-source-drive-value calculating unit 24 compares $1/\alpha_b$ of the luminance determination blocks calculated based on the input signal values of the luminance determination blocks to identify the maximum value in each group of interest. The present disclosure, however, is not limited thereto. The light-source-drive-value calculating unit 24, for example, may multiply $1/\alpha_b$ of the luminance determination blocks calculated based on the input signal values of the luminance determination blocks by the values of light intensity at the positions corresponding to the respective luminance determination blocks stored in the lookup table. The light-source-drive-value calculating unit 24 then compares the values obtained by the multiplication to identify the maximum value in each group.

Assuming that the light source drive value of each light source in the first sidelight light source 52A is $1/\alpha_{i1\text{-}max}$ and that the light source drive value of each light source in the second sidelight light source 52B is $1/\alpha_{i2\text{-}max}$, the light-source-drive-value calculating unit 24 calculates luminance indexes of the light incident portion Lin, the middle portion Lmid, and the outer portion Lout in the group of interest by the expressions (11) to (13), respectively (Step S38). The light-source-data storage unit 25 stores therein in advance the lookup tables LUTA to LUTF corresponding to the light sources 56A to 56F, respectively, of the first sidelight light source 52A and lookup tables LUTG to LUTL corresponding to the light sources 57A to 57F, respectively, of the second sidelight light source 52B. In this example, m of LUTm indicating a lookup table takes not from A to F but from A to L. With this operation, the light-source-drive-value calculating unit 24 can calculate the luminance indexes that reflect the degree of contribution of light from the light sources of the first sidelight light source 52A and the second sidelight light source 52B. In the expressions (11) to (13), LUTm ($P_{Lin}$, $Q_{Lin}$) denotes data in the $P_{Lin}$-th column and the $Q_{Lin}$-th row in the lookup table m. The data in the $P_{Lin}$-th column and the $Q_{Lin}$-th row may be data of each pixel, data of each luminance determination block, or data of each divided area obtained by virtually dividing the image display panel 30 into predetermined areas. This format is also applicable to LUTm ($P_{Lmid}$, $Q_{Lmid}$) and LUTm ($P_{Lout}$, $Q_{Lout}$). In this example, ($P_{Lin}$, $Q_{Lin}$) denotes a coordinate value represented by an absolute coordinate system common to the lookup tables.

The present disclosure does not necessarily have the lookup tables for the respective light sources as described above. The present disclosure, for example, may have only lookup tables corresponding to the respective light sources of either one of the first sidelight light source 52A and the second sidelight light source 52B. Information on the light intensity distribution in the lookup table obtained when only one of the light sources on the second incident surface E2 side is turned on and incident light output therefrom travels from the light guide plate 54 to the plane of the image display panel 30 is the same as information on the light intensity distribution in the lookup table of the light source on the first incident surface E1 side arranged line-symmetrically with the turned-on light source with respect to the center line LXc in the light incident direction LX. As described above, the lookup tables LUTA to LUTF correspond to the light sources 56A to 56F, respectively. If the light-source-data storage unit 25 stores therein the lookup tables LUTA to LUTF, the light-source-drive-value calculating unit 24 can calculate the light source lighting amount of each light source not only of the first sidelight light source 52A but also of the second sidelight light source 52B using the lookup tables LUTA to LUTF in the light-source-data storage unit 25. More specifically, the light-source-drive-value calculating unit 24 can calculate the light source lighting amount of the light sources 57A to 57F by inverting the lookup tables LUTA to LUTF in a manner line-symmetric with respect to the center line LXc and superimposing them. In this case, the light-source-drive-value calculating unit 24 can calculate the luminance indexes using the following expressions (15-1), (16-1), and (17-1) instead of the expressions (11), (12), and (13), respectively.

$$\text{luminance index of } Lin=(1/\alpha_{Lin})/[\Sigma\{(1/\alpha_{i1\text{-}max})\times LUTm(P_{Lin},Q_{Lin})\}+\Sigma\{(1/\alpha_{i2\text{-}max})\times LUTm(P_{Lin},\mathrm{MAX}Q-Q_{Lin})\}] \quad (15\text{-}1)$$

($1/\alpha_{Lin}$): $1/\alpha$ of the block of Lin ($1/\alpha_{i1\text{-}max}$): light source drive value of the first sidelight light source ($1/\alpha_{i2\text{-}max}$): light source drive value of the second sidelight light source LUTm($P_{Lin}$,$Q_{Lin}$),LUTm($P_{Lin}$,MAXQ−$Q_{Lin}$): lookup table data of each light source m: A to F $$\text{luminance index of } Lmid=(1/\alpha_{Lmid})/[\Sigma\{(1/\alpha_{i1\text{-}max})\times LUTm(P_{Lmid},Q_{Lmid})\})+\Sigma\{(1/\alpha_{i2\text{-}max})\times LUTm(P_{Lmid},\mathrm{MAX}Q-Q_{Lmid})\}] \quad (16\text{-}1)$$

$(1/\alpha_{Lmid})$: $1/\alpha$ of the block of Lmid $(1/\alpha_{i1\text{-}max})$: light source drive value of the first sidelight light source $(1/\alpha_{i2\text{-}max})$: light source drive value of the second sidelight light source $LUTm(P_{Lmid},Q_{Lmid}),LUTm(P_{Lmid},MAXQ-Q_{Lmid})$: lookup table data of each light source m: A to F $$\text{luminance index of } Lout=(1/\alpha_{Lout})/[\Sigma\{(1/\alpha_{i1\text{-}max})\times LUTm(P_{Lout},Q_{Lout})\}+\Sigma\{(1/\alpha_{i2\text{-}max})\times LUTm(P_{Lout},MAXQ-Q_{Lout})\}] \quad (17\text{-}1)$$

Figure 30:
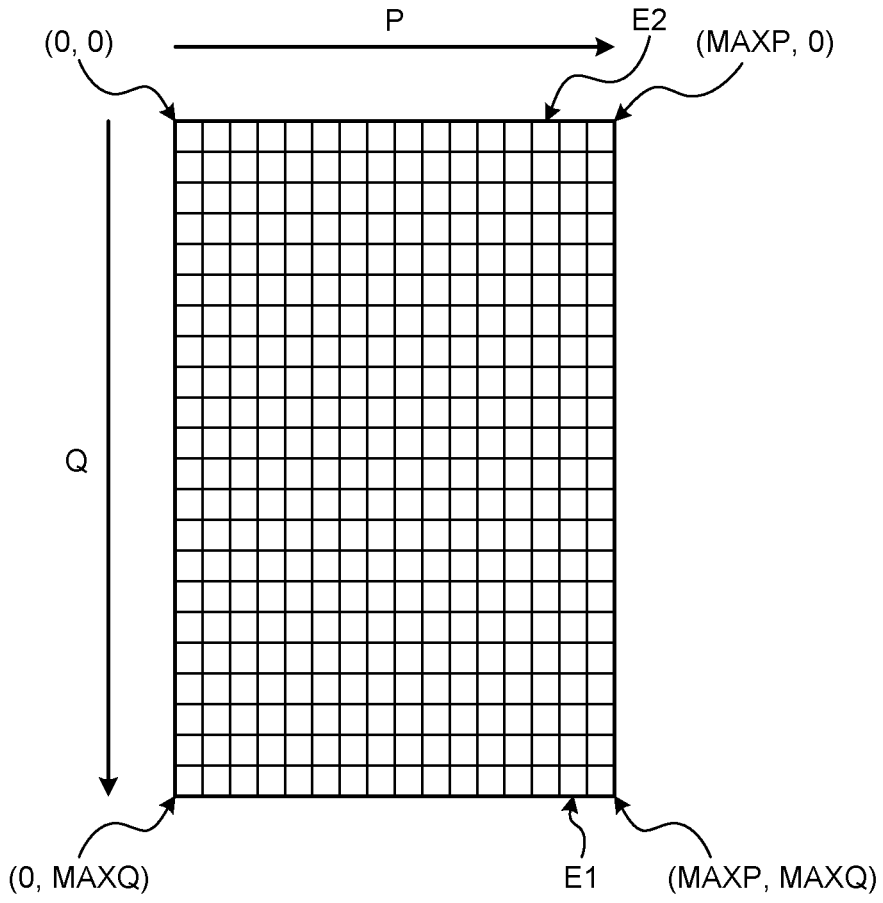
FIG. 30 is a diagram of an example of an absolute coordinate value in the lookup table according to the present embodiment.

$(1/\alpha_{Lout})$: $1/\alpha$ of the block of Lout $(1/\alpha_{i1\text{-}max})$: light source drive value of the first sidelight light source $(1/\alpha_{i2\text{-}max})$: light source drive value of the second sidelight light source $LUTm(P_{Lout},Q_{Lout}),LUTm(P_{Lout},MAXQ-Q_{Lout})$: lookup table data of each light source m: A to F In the expressions (15-1) to (17-1), coordinate transformation is performed to use the lookup tables indicating the light intensity distribution obtained when the light sources of the first sidelight light source 52A are turned on as the lookup tables indicating the light intensity distribution obtained when the light sources of the second sidelight light source 52B are turned on. The following describes the coordinate transformation with reference to FIG. 30. In the expressions (15-1) to (17-1), the coordinate value is distinguished depending on the position in the light incident direction LX like $(P_{Lin}, Q_{Lin})$, $(P_{Lmid}, Q_{Lmid})$, and $(P_{Lout}, Q_{Lout})$. Because the concept of coordinate transformation is common independently of positions in the light incident direction, the coordinate value is simply represented by (P, Q) in the following description.

In LUTm (P, Q) indicating data in the P-th column and the Q-th row in the lookup table m, P denotes a position in the light source array direction LY, whereas Q denotes a position in the light incident direction LX. P takes a value from 0 to MAXP, whereas Q takes a value from 0 to MAXQ. Assuming that (P, Q)=(0, 0) is the coordinate value of an array element at a first corner on the second sidelight light source 52B side out of the array elements in the lookup table m, the coordinate value of an array element at a second corner is represented by (MAXP, 0). The coordinate value of an array element at a first corner on the first sidelight light source 52A side is represented by (0, MAXQ), whereas the coordinate value of an array element at a second corner is represented by (MAXP, MAXQ). In a case where the lookup tables LUTA to LUTF are inverted with respect to the center line LXc, and where an absolute coordinate value on the lookup tables LUTA to LUTF is represented by (P, Q), the light-source-drive-value calculating unit 24 reads and uses data at a coordinate (P, MAXQ-Q) from the lookup tables LUTA to LUTF (coordinate transformation). In the expressions (15-1) to (17-1), the read and used data is represented by LUTm (P, MAXQ-Q). By reading data at a position line-symmetric with a processing target block with respect to the center line LXc from the lookup tables LUTA to LUTF, the light-source-drive-value calculating unit 24 can invert the lookup tables LUTA to LUTF with respect to the center line LXc to use them.

The light-source-drive-value calculating unit 24 identifies the largest luminance index out of the luminance indexes of the light incident portion Lin, the middle portion Lmid, and the outer portion Lout calculated at Step S38 (Step S39).

The light-source-drive-value calculating unit 24 stores therein $1/\alpha_b$ corresponding to the luminance index identified at Step S39 as a target $1/\alpha_b$ and stores therein the position of the identified block serving as a block corresponding to the identified luminance index and one of the light incident portion Lin, the middle portion Lmid, and the outer portion Lout in the group of interest (Step S40). The identified block corresponds to the luminance determination block to be a target of luminance correction, and $1/\alpha_b$ of the identified luminance determination block corresponds to the target $1/\alpha_b$ for the group to which the luminance determination block belongs.

The example illustrated in FIG. 23 indicates that the luminance determination blocks identified with a flag of a circle have the maximum value.

After the determination of the target $1/\alpha_b$, the image analyzing unit 23 determines the area of the luminance determination block as illustrated in FIG. 14 (Step S20). The light-source-drive-value calculating unit 24 specifies a group of interest and calculates $1/\alpha_b$ of the luminance correction target block in the specified group of interest (Step S21). The calculated $1/\alpha_b$ is a value corresponding to the luminance of the luminance correction target block assuming that the light sources are turned on with the respective light source drive values temporarily set as described above (or corrected by the processing described later), and is different from the light source drive value of each luminance correction target block (each light source). Specifically, $1/\alpha_b$ can be calculated using the values of light intensity in the LUT corresponding to the light sources of the first sidelight light source 52A and the second sidelight light source 52B. If the light-source-data storage unit 25 stores therein in advance the lookup tables LUTA to LUTF corresponding to the light sources 56A to 56F, respectively, of the first sidelight light source 52A and the lookup tables LUTG to LUTL corresponding to the light sources 57A to 57F, respectively, of the second sidelight light source 52B, the light-source-drive-value calculating unit 24 calculates $1/\alpha_b$ of the luminance correction target block using the expression (14). In this case, m of LUTm indicating a lookup table takes not from A to F but from A to L. With this operation, the light-source-drive-value calculating unit 24 can calculate $1/\alpha_b$ ($1/\alpha_G$ in the expression (14)) with the effect of light from all the light sources taken into consideration. Similarly to the above operation, in the expression (14), the latest $1/\alpha_b$ of the luminance correction target block in each group is used as $1/\alpha_k$. In other words, after luminance correction (adjustment of $1/\alpha_b$) of a luminance correction target block in a group of interest is performed by the processing described later, $1/\alpha_b$ resulting from the luminance correction is used as $1/\alpha_k$ of the luminance correction target block in the group of interest to perform the calculation at Step S21 on another luminance correction target block in a group that is subjected to luminance correction after the correction of the group of interest.

As described above, the present embodiment may have only the lookup tables indicating the light intensity distribution obtained when the light sources of the first sidelight light source 52A are turned on and does not necessarily have the lookup tables indicating the light intensity distribution obtained when the light sources of the second sidelight light source 52B are turned on. In this case, to use the lookup tables indicating the light intensity distribution obtained when the light sources of the first sidelight light source 52A are turned on as the lookup tables indicating the light intensity distribution obtained when the light sources of the second sidelight light source 52B are turned on, the light-source-drive-value calculating unit 24 calculates $1/\alpha_b$ of the luminance correction target block using the following expression (18-1) instead of the expression (14) at Step S21.

$$1/\alpha_G=\Sigma\{(1/\alpha_{k1})\times LUTm(P, Q)\}+\Sigma\{(1/\alpha_{k2})\times LUTm(P, \mathrm{MAX}Q-Q)\} \quad (18\text{-}1)$$

$(1/\alpha_{k1})$: light source drive value of the luminance correction target block on the first sidelight light source side $(1/\alpha_{k2})$: light source drive value of the luminance correction target block on the second sidelight light source side LUTm(P, Q): lookup table data of each light source m: A to F In the expression (18-1), coordinate transformation is performed similarly to the expressions (15-1) to (17-1). Specifically, in a case where the lookup tables indicating the light intensity distribution obtained when the light sources of the first sidelight light source 52A are turned on are also used as the lookup tables indicating the light intensity distribution obtained when the light sources of the second sidelight light source 52B are turned on, and where an absolute coordinate value of the processing target block on the lookup tables is represented by (P, Q), the light-source-drive-value calculating unit 24 reads and uses data at the coordinate (P, MAXQ-Q) from the lookup tables corresponding to the position of the processing target block in the light source array direction LY (coordinate transformation). In the expression (18-1), the read and used data is represented by LUTm (P, MAXQ-Q). By reading data at a position line-symmetric with the processing target block with respect to the center line LXc from the lookup tables LUTA to LUTF, the light-source-drive-value calculating unit 24 can invert the lookup tables LUTA to LUTF with respect to the center line LXc to use them.

Subsequently, the light-source-drive-value calculating unit 24 acquires the target $1/\alpha_b$ of the group of interest as illustrated in FIG. 14 (Step S22). The light-source-drive-value calculating unit 24 then performs correction of the luminance (correction of the light source drive value) described below.

If $1/\alpha_b$ of the luminance correction target block in the group of interest calculated at Step S21 is smaller than the target $1/\alpha_b$ of the group of interest (Yes at Step S23), the light-source-drive-value calculating unit 24 calculates the difference between the calculated $1/\alpha_b$ and the target $1/\alpha_b$ (Step S24). The light-source-drive-value calculating unit 24 then calculates the magnification of the difference (Step S25). The light-source-drive-value calculating unit 24 calculates how many times larger the difference is than the value in the lookup table at the position. Specifically, the light-source-drive-value calculating unit 24 reads data corresponding to the position of the luminance correction target block from the lookup table of the light source corresponding to the position of the luminance correction target block in the light source array direction LY. The read data is referred to as Percentage for convenience. The magnification is calculated by dividing the difference Sub between the calculated $1/\alpha_b$ and the target $1/\alpha_b$ by Percentage. The lookup tables according to the present embodiment store therein the light intensity distribution obtained when the light sources are turned on at the maximum output (output of 100%). By dividing the difference by the value of light intensity in the lookup table, the light-source-drive-value calculating unit 24 can derive the ratio (magnification) of the difference to the value of light intensity of 100%. In a case where the lookup tables indicating the light intensity distribution obtained when the light sources of the first sidelight light source 52A are turned on are also used as the lookup tables indicating the light intensity distribution obtained when the light sources of the second sidelight light source 52B are turned on, the light-source-drive-value calculating unit 24 performs coordinate transformation as described above when reading Percentage. Specifically, in a case where an absolute coordinate value of the luminance correction target block is represented by (P, Q), the light-source-drive-value calculating unit 24 reads data at the coordinate (P, MAXQ-Q) from the lookup tables corresponding to the position of the luminance correction target block in the light source array direction LY and uses it as Percentage.

The light-source-drive-value calculating unit 24 adds the calculated magnification of the difference to $1/\alpha_b$ calculated based on the input signal and temporarily set at Step S37 (Step S26). In other words, if $1/\alpha_b$ calculated at Step S21 is smaller than the target $1/\alpha_b$ of the block, the light-source-drive-value calculating unit 24 adds the calculated magnification of the difference to the temporarily set $1/\alpha_b$ (Step S26), thereby compensating the luminance of the block having insufficient luminance.

Figure 25:
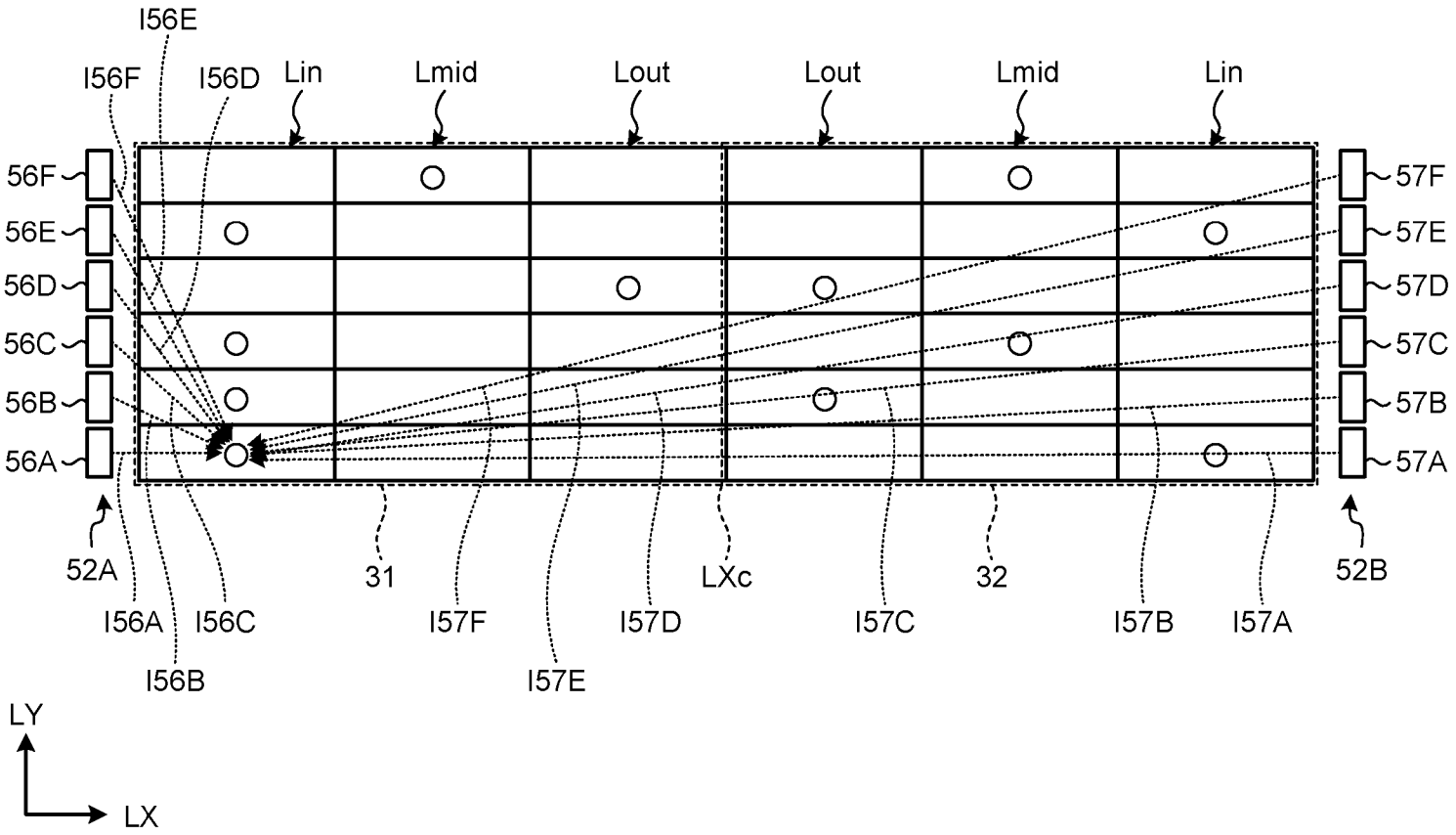
FIG. 25 is a diagram for explaining effects of the respective light sources to one luminance determination block serving as a target for luminance correction.

FIG. 25 is a diagram for explaining effects of the respective light sources to one luminance determination block serving as a target for luminance correction. Let us assume a case where the luminance determination block illustrated in FIG. 25 is the light incident portion Lin on the first display surface 31 closest to the light source 56A. In this case, the representative luminance of the luminance determination block is obtained by adding luminance I56A to I56F and I57A to I57F of the luminance determination block generated by incident light output from the light sources 56A to 56F and 57A to 57F, respectively. As illustrated in FIG. 25, for example, the light-source-drive-value calculating unit 24 recalculates the light source drive value of the light source 56A such that the sum of the luminance generated by the light source 56A and the luminance generated by the light sources 56B to 56F and 57A to 57F other than the light source 56A is equal to the target luminance. The light-source-drive-value calculating unit 24 then stores therein the recalculated light source drive value. Specifically, as described above, the light-source-drive-value calculating unit 24 calculates the difference Sub by subtracting $1/\alpha_b$ from the target $1/\alpha_b$, $1/\alpha_b$ being calculated at Step S21, that is, $1/\alpha_b$ corresponding to the sum of the luminance on the assumption that the light sources 56A to 56F and 57A to 57F are turned on. The light-source-drive-value calculating unit 24 divides the difference Sub by Percentage on the lookup table corresponding to the light source 56A, thereby calculating the magnification. The light-source-drive-value calculating unit 24 adds the magnification to $1/\alpha_b$ temporarily set as the light source drive value of the light source 56A. The light-source-drive-value calculating unit 24 thus recalculates the light source drive value of the light source 56A and stores it therein. The light-source-drive-value calculating unit 24 performs the processing on each light source. With this processing, the curve Ud illustrated in FIG. 22 is corrected to the curve Ue, for example. As a result, the luminance levels of the peaks D1 and D3 in the luminance are changed out of the peaks and the troughs (D0 to D4) in the luminance, whereby the luminance is increased. The light-source-drive-value calculating unit 24 then performs the processing at Step S27.

By contrast, if $1/\alpha_b$ calculated at Step S21 is equal to or larger than the target $1/\alpha_b$ of the group of interest (No at Step S23), the light-source-drive-value calculating unit 24 skips the processing from Step S24 to Step S26 and performs the processing at Step S27. If $1/\alpha_b$ of the luminance correction target block exceeds an upper limit (Yes at Step S27), the light-source-drive-value calculating unit 24 performs clipping for replacing $1/\alpha_b$ with the upper limit (Step S28). If positive determination is made at Step S23, $1/\alpha_b$ of the luminance correction target block compared with the upper limit at Step S27 is the light source drive value $1/\alpha_b$ resulting from the correction at Step S26 as described above. By contrast, if negative determination is made at Step S23, $1/\alpha_b$ is the temporarily set light source drive value $1/\alpha_b$. The upper limit is set in advance as an upper limit of the light source drive value used in light source control. After the processing at Step S28, the light-source-drive-value calculating unit 24 performs the processing at Step S30. By contrast, if $1/\alpha_b$ of the luminance correction target block does not exceed the upper limit (No at Step S27), the light-source-drive-value calculating unit 24 skips the processing at Step S28 and performs the processing at Step S30. If scanning of all the groups is completed (Yes at Step S30), the light-source-drive-value calculating unit 24 finishes the process illustrated in FIG. 14. By contrast, if scanning of all the groups is not completed (No at Step S30), the light-source-drive-value calculating unit 24 specifies the next group as a group of interest and performs the processing at Step S21 again. With the processing described above, the light source drive value $1/\alpha_b$ of each block temporarily set at Step S37 is corrected. If negative determination is made at Step S23 and Step S27, the temporarily set light source drive value may possibly not be corrected. In this case, the temporarily set light source drive value is used for control of the light source lighting amount of the light source without any change. The light source lighting amount is calculated from $1/\alpha_b$ of each block derived in this manner. Subsequently, $1/\alpha_b$ of each luminance correction target block calculated as described above is used as the light source drive value $1/\alpha_k$ of each light source. In other words, the light source drive values $1/\alpha_k$ of the light sources 56A to 56F and 57A to 57F are calculated. Based on the light source drive value $1/\alpha_k$ and the lookup table, the representative luminance is calculated by the expression (10). As described above, the temporarily set $1/\alpha_b$ is corrected such that $1/\alpha_b$ of each luminance correction target block is equal to the target $1/\alpha_b$. The light source lighting amount of each light source is controlled based on the corrected $1/\alpha_b$. In other words, the light source lighting amount of each light source is controlled such that the luminance of each luminance correction target block satisfies the target luminance.

To use the lookup tables indicating the light intensity distribution obtained when the light sources of the first sidelight light source 52A are turned on as the lookup tables indicating the light intensity distribution obtained when the light sources of the second sidelight light source 52B are turned on, it is necessary to incorporate the calculation for coordinate transformation into the expression (10). As described above, the representative luminance is calculated by multiplying light source currents by data of the lookup tables of the respective light sources and calculating the sum of the values resulting from the multiplication. When the lookup tables are shared by the first sidelight light source 52A and the second sidelight light source 52B, the light-source-drive-value calculating unit 24 can calculate the representative luminance simply by using the expression for multiplying the light source currents by data of the lookup tables of the respective light sources and calculating the sum of the values resulting from the multiplication for both of the first sidelight light source 52A and the second sidelight light source 52B. The light source currents of the second sidelight light source 52B are multiplied by data of the coordinate value (P, MAXQ-Q) instead of the coordinate value (P, Q) in the lookup tables.

While the display device 10 of the present embodiment has the lookup tables indicating the light intensity distribution obtained when the light sources of the first sidelight light source 52A are turned on and has no lookup tables indicating the light intensity distribution obtained when the light sources of the second sidelight light source 52B are turned on, the present disclosure is not limited thereto. The display device 10 of the present embodiment, for example, may have the lookup tables indicating the light intensity distribution obtained when the light sources of the second sidelight light source 52B are turned on and have no lookup tables indicating the light intensity distribution obtained when the light sources of the first sidelight light source 52A are turned on.

The calculation of the light source drive value $1/\alpha_k$ of the light source (luminance correction, that is, correction of the light source drive value) may be performed in order of the light sources 56A, 56B, 56C, 56D, 56E, 56F, 57A, 57B, 57C, 57D, 57E, and 57F. Alternatively, the calculation of the light source drive value $1/\alpha_k$ of the light source may be performed in order of the light sources 56A, 56B, 56C, 56D, 56E, 56F, 57F, 57E, 57D, 57C, 57B, and 57A. The order of calculating the light source drive value $1/\alpha_k$ of the light source is not limited. If the light source drive value $1/\alpha_k$ of one of the light sources 56A to 56F and 57A to 57F is corrected by the processing at Step S26 in FIG. 14, the light source drive values $1/\alpha_k$ of the other light sources are recalculated. Specifically, the light-source-drive-signal-value calculating unit 24 calculates the light source drive value $1/\alpha_k$ of the light sources 56A to 56F and 57A to 57F in order, while sequentially reflecting the light source drive values $1/\alpha_k$ of the light sources derived earlier on the light source drive values $1/\alpha_k$ of the light sources derived later. Thereby, the representative luminance of each light source is calculated with high accuracy.

The order of correction of the light source drive value may be determined based on the characteristics or the setting of the backlight, for example. In a case where a light source is affected more by the effect of light output from light sources aligned with the light source in the light source array direction LY (light sources included in the same sidelight light source) than by the effect of light output from light sources opposite to the light source in the light incident direction LX, for example, the light-source-drive-value calculating unit 24 may calculate the light source drive value in order of arrangement of the light sources in the light source array direction LY. In this case, the light-source-drive-value calculating unit 24 may calculate the light source drive value in order of the light sources 56A, 56B, 56C, 56D, 56E, 56F, 57A, 57B, 57C, 57D, 57E, and 57F or the light sources 56A, 56B, 56C, 56D, 56E, 56F, 57F, 57E, 57D, 57C, 57B, and 57A, for example.

In a case where a light source is affected less by the effect of light output from light sources aligned with the light source in the light source array direction LY (light sources included in the same sidelight light source) than by the effect of light output from light sources opposite to the light source in the light incident direction LX, for example, the light-source-drive-value calculating unit 24 may alternately correct the light source drive value of the light sources in the first sidelight light source 52A and the light source drive value of the light sources in the second sidelight light source 52B. In this case, the light-source-drive-value calculating unit 24 may correct the light source drive value in order of the light sources 56A, 57A, 56B, 57B, 56C, 57C, 56D, 57D, 56E, 57E, 56F, and 57F, for example.

Furthermore, the light-source-drive-value calculating unit 24 may correct the light source drive value a plurality of times. By reflecting the light source drive value corrected in the first correction of the light source drive value on the second correction of the light source drive value, for example, the light-source-drive-value calculating unit 24 can calculate the light source drive value with high accuracy. In this case, the light-source-drive-value calculating unit 24 can correct the light source drive value so as to increase the luminance in the first correction and correct the light source drive value so as to decrease the luminance in the second correction.

The light-source-drive-value determining unit 26 transmits the information on luminance of each pixel 48 (Step S14) to the image processing unit 22. The image processing unit 22 corrects the input signal SRGB based on the information on luminance of each pixel 48 (Step S16). The image processing unit 22 then performs synchronous processing for calculating the output signal SRGBW so as to output the signal value $X_{1-(p,\ q)}$, the signal value $X_{2-(p,\ q)}$, the signal value $X_{3-(p,\ q)}$, and the signal value $X_{4-(p,\ q)}$ for the (p, q)-th pixel 48 (Step S15). Based on a synchronization signal STM, the image-display-panel driving unit 40 displays an image of each frame on the image display panel 30, and the planar-light-source-device control unit 60 drives the light sources 56A to 56F and 57A to 57F individually.

The following describes specific examples of the luminance correction (correction of the light source drive value) described above. FIGS. 32 to 40 are diagrams for explaining specific examples of a process for correcting the light source drive value. The following describes a case where correction of the light source drive value is performed on the light sources of the first sidelight light source 52A first and on the light sources of the second sidelight light source 52B next, as one example. To simplify the explanation, the following describes two light sources of the light source 56A and the light source 57A, the light source 56A being included in the first sidelight light source 52A, and the light source 57A being included in the second sidelight light source 52B and arranged at the same position as that of the light source 56A in the light source array direction LY.

In FIGS. 32 to 40, a curve U56A0 indicates the light source lighting amount (intensity of light) obtained when the light source 56A is turned on with the temporarily set light source drive value. A curve U57A0 indicates the light source lighting amount obtained when the light source 57A is turned on with the temporarily set light source drive value. The temporarily set light source drive value corresponds to the light source drive value temporarily set at Step S37 in FIG. 15. A curve UC0 indicates a profile (synthesized lighting amount) obtained by synthesizing the light source lighting amount indicated by the curve U56A0 and the light source lighting amount indicated by the curve U57A0.

In FIGS. 32 to 40, a curve U56A1 indicates the light source lighting amount obtained when the light source 56A is turned on with the light source drive value corrected by the processing illustrated in FIG. 14 and other figures. In the specific examples described with reference to FIGS. 32 to 40, the light source drive value is corrected so as to increase the luminance (light source lighting amount) as described in the processing at Step S26 in FIG. 14, for example. A curve UC1 indicates a synthesized lighting amount obtained by synthesizing the curve U56A1 (light source lighting amount with the corrected light source drive value of the light source 56A) and the curve U57A0 (light source lighting amount with the temporarily set light source drive value of the light source 57A).

A curve U57A1 indicates the light source lighting amount obtained when the light source 57A is turned on with the light source drive value corrected by the processing illustrated in FIG. 14 and other figures. As described above, if the light source drive value of the light source 56A is corrected, the corrected light source drive value of the light source 56A is also used to perform calculation in correction of the light source drive value of the light source 57A (Step S21). By using a light source drive value corrected earlier to correct a light source drive value to be corrected after the earlier correction, the later correction can be performed with higher accuracy. A curve UC2 indicates a synthesized lighting amount obtained by synthesizing the curve U56A1 (light source lighting amount with the corrected light source drive value of the light source 56A) and the curve U57A1 (light source lighting amount with the corrected light source drive value of the light source 57A).

A curve UC1*a* indicates a synthesized lighting amount obtained by synthesizing the curve U56A0 (light source lighting amount with the temporarily set light source drive value of the light source 56A) and the curve U57A1 (light source lighting amount with the corrected light source drive value of the light source 57A). As described above with reference to FIG. 14, correction of the temporarily set light source drive value of the light source 56A may possibly not be performed (may possibly be skipped). The curve UC1*a* indicates the synthesized lighting amount in such a case.

Figure 32:
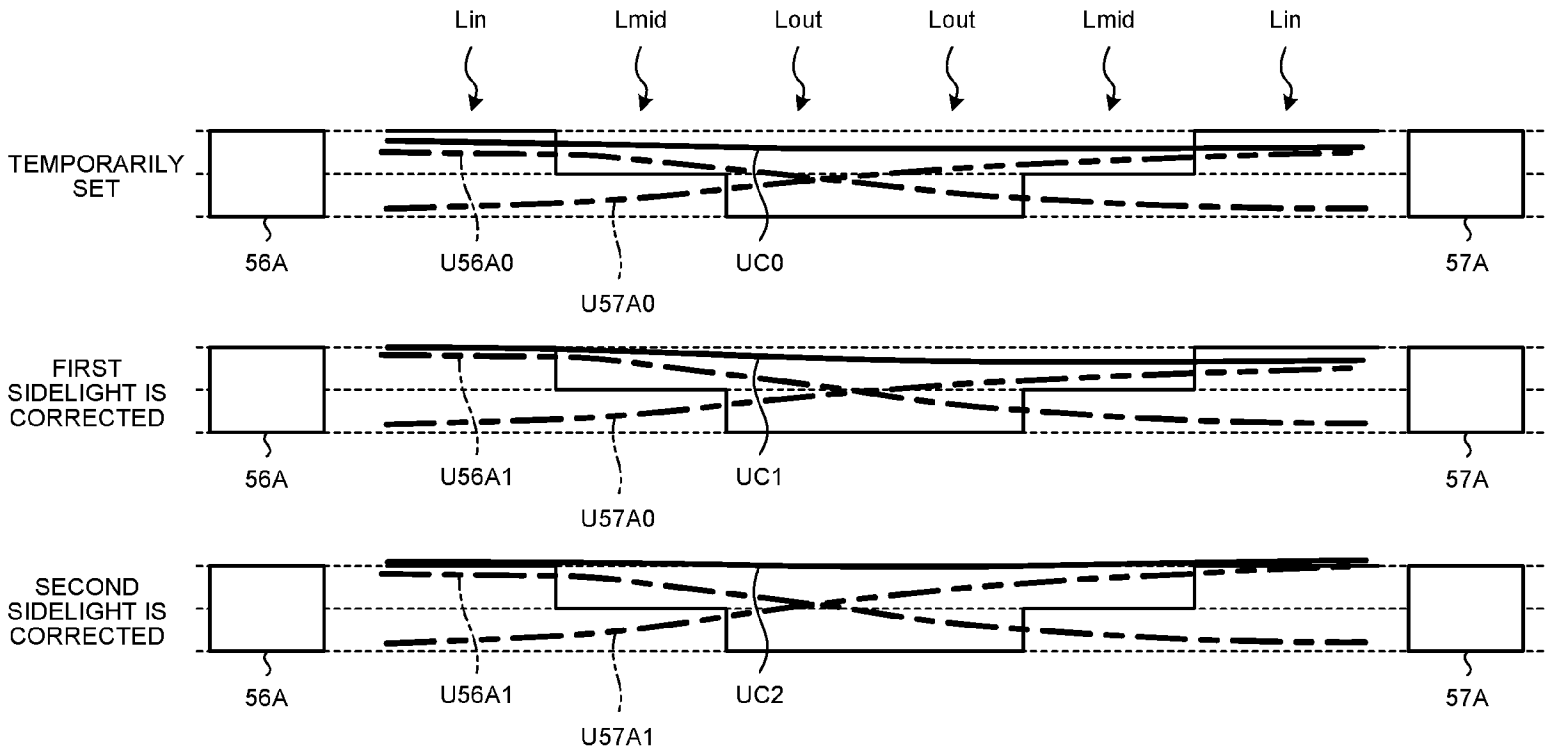
FIG. 32 is a diagram for explaining a specific example of a process for correcting the light source drive value according to the present embodiment.

The respective cases illustrated in FIGS. 32 to 40 will be described in greater detail. FIG. 32 illustrates an example where the luminance correction target block on the light source 56A side is the light incident portion Lin, and the luminance correction target block on the light source 57A side is also the block of the light incident portion Lin. In the example illustrated in FIG. 32, the synthesized lighting amount in each of the luminance correction target blocks obtained when the light sources are turned on with the temporarily set light source drive values is smaller than the target light source lighting amount (thin solid line) as indicated by the curve UC0. Therefore, it is preferable to correct the temporarily set light source drive values.

As described above, the light source drive value of the light source 56A in the first sidelight light source 52A is corrected before correction of the light source drive value of the light source 57A in the second sidelight light source 52B (curve U56A1). As indicated by the curve UC1, the correction of the light source drive value of the light source 56A increases the synthesized lighting amount in the light incident portion Lin on the light source 56A side to the target light source lighting amount in the light incident portion Lin on the light source 56A side. In other words, the luminance of the luminance correction target block (the light incident portion Lin) on the light source 56A side is equal to or higher than the target luminance.

Subsequently, the light source drive value of the light source 57A in the second sidelight light source 52B is corrected (curve U57A1). As indicated by the curve UC2, the correction of the light source drive value of the light source 57A increases the synthesized lighting amount in the light incident portion Lin on the light source 57A side to the target light source lighting amount for the light incident portion Lin on the light source 57A side. In other words, the luminance of the luminance correction target block (the light incident portion Lin) on the light source 57A side is equal to or higher than the target luminance. Correction of the light source drive values in this manner compensates the insufficient luminance.

Figure 33:
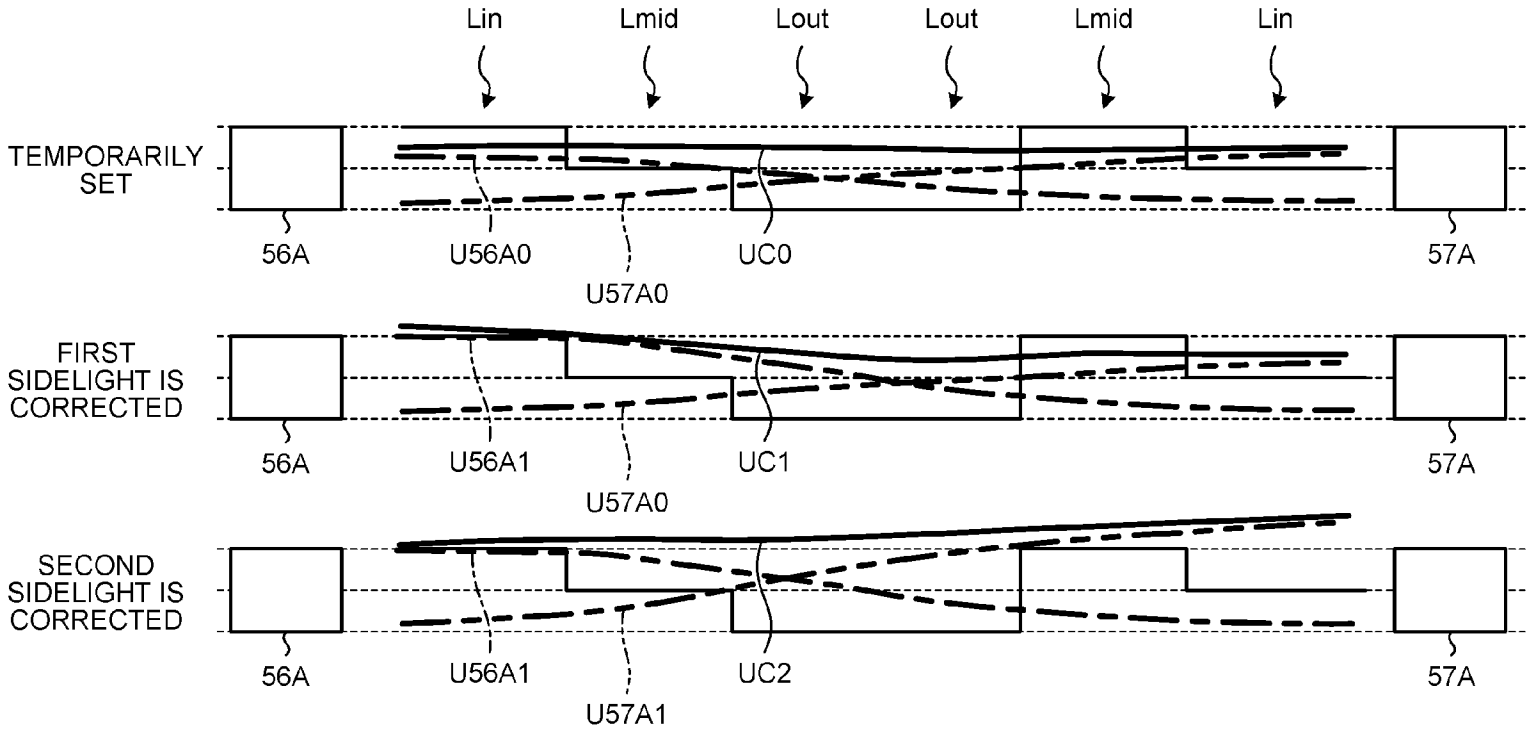
FIG. 33 is a diagram for explaining another specific example of a process for correcting the light source drive value according to the present embodiment.

FIG. 33 illustrates an example where the luminance correction target block on the light source 56A side is the light incident portion Lin, and the luminance correction target block on the light source 57A side is the middle portion Lmid. In the example illustrated in FIG. 33, the synthesized lighting amount in each of the luminance correction target blocks obtained when the light sources are turned on with the temporarily set light source drive values is smaller than the target light source lighting amount as indicated by the curve UC0. It is preferable to correct the temporarily set light source drive values.

As described above, the light source drive value of the light source 56A in the first sidelight light source 52A is corrected first (curve U56A1). As indicated by the curve UC1, the correction of the light source drive value of the light source 56A increases the synthesized lighting amount in the light incident portion Lin on the light source 56A side to the target light source lighting amount for the light incident portion Lin on the light source 56A side.

Subsequently, the light source drive value of the light source 57A in the second sidelight light source 52B is corrected (curve U57A1). As indicated by the curve UC2, the correction of the light source drive value of the light source 57A increases the synthesized lighting amount in the middle portion Lmid on the light source 57A side to the target light source lighting amount in the middle portion Lmid on the light source 57A side. Correction of the light source drive values in this manner compensates the insufficient luminance.

Figure 34:
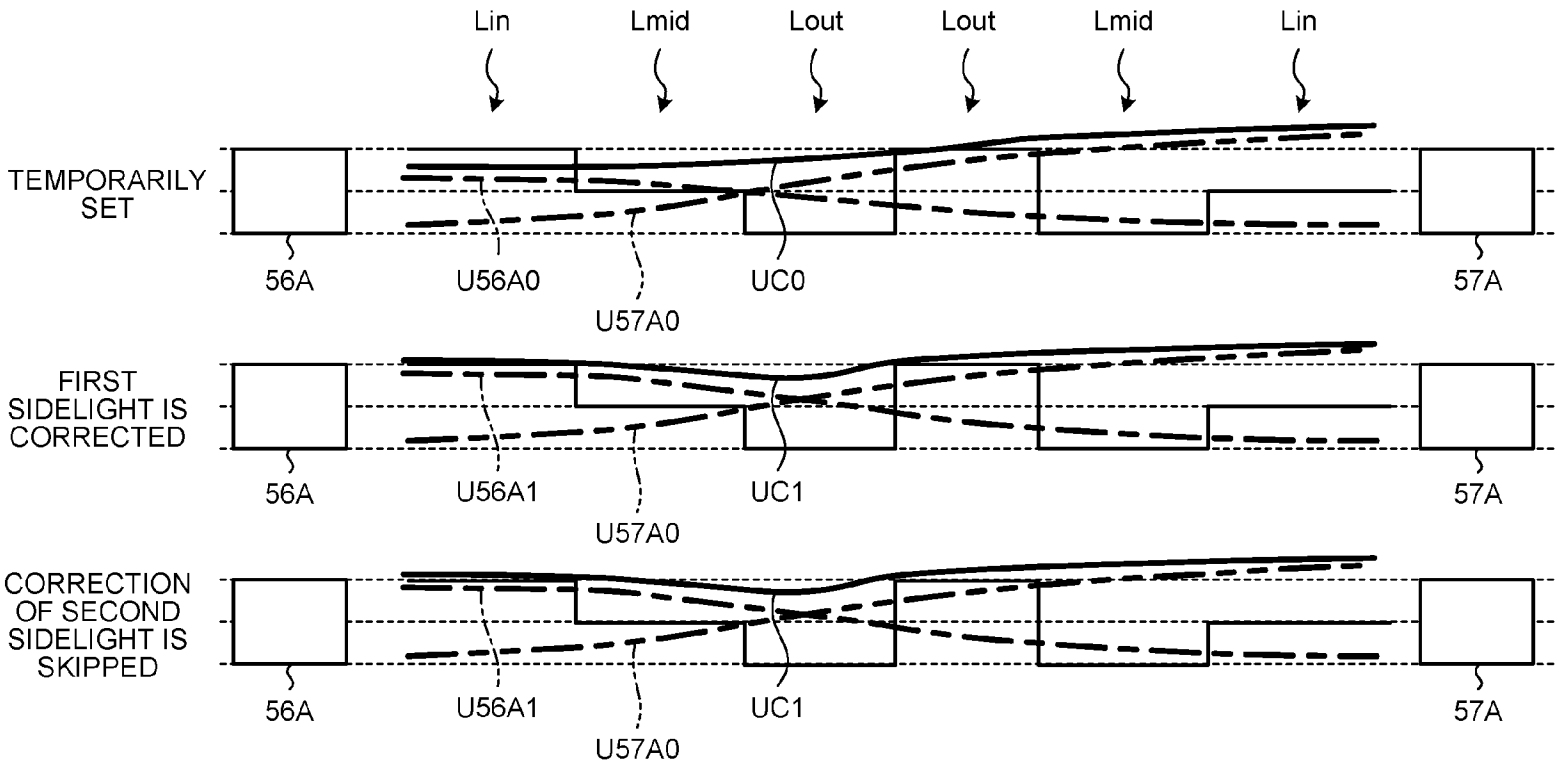
FIG. 34 is a diagram for explaining still another specific example of a process for correcting the light source drive value according to the present embodiment.

FIG. 34 illustrates an example where the luminance correction target block on the light source 56A side is the light incident portion Lin, and the luminance correction target block on the light source 57A side is the outer portion Lout. In the example illustrated in FIG. 34, the synthesized lighting amount in the luminance correction target block (light incident portion Lin) on the light source 56A side obtained when the light sources are turned on with the temporarily set light source drive values is smaller than the target light source lighting amount as indicated by the curve UC0. By contrast, the synthesized lighting amount in the luminance correction target block (outer portion Lout) on the light source 57A side obtained when the light sources are turned on with the temporarily set light source drive values is equal to or larger than the target light source lighting amount.

The light source drive value of the light source 56A in the first sidelight light source 52A is corrected (curve U56A1). As indicated by the curve UC1, the correction of the light source drive value of the light source 56A increases the synthesized lighting amount in the light incident portion Lin on the light source 56A side to the target light source lighting amount for the light incident portion Lin on the light source 56A side.

In the case illustrated in FIG. 34, the synthesized lighting amount in the luminance correction target block (outer portion Lout) on the light source 57A side obtained with the temporarily set light source drive values is equal to or larger than the target light source lighting amount. As a result, negative determination is made at Step S23 in FIG. 14 to skip the subsequent correction. In this example, in a case where the luminance correction target block on the light source 56A side is the light incident portion Lin, and the luminance correction target block on the light source 57A side is the outer portion Lout, the correction is skipped because the luminance (synthesized lighting amount) of the luminance correction target block on the light source 57A side is equal to or larger than the target luminance (target light source lighting amount). This is given by way of example only, and the correction is not always skipped in a case where the luminance correction target block on the light source 56A side is the light incident portion Lin, and the luminance correction target block on the light source 57A side is the outer portion Lout.

Figure 35:
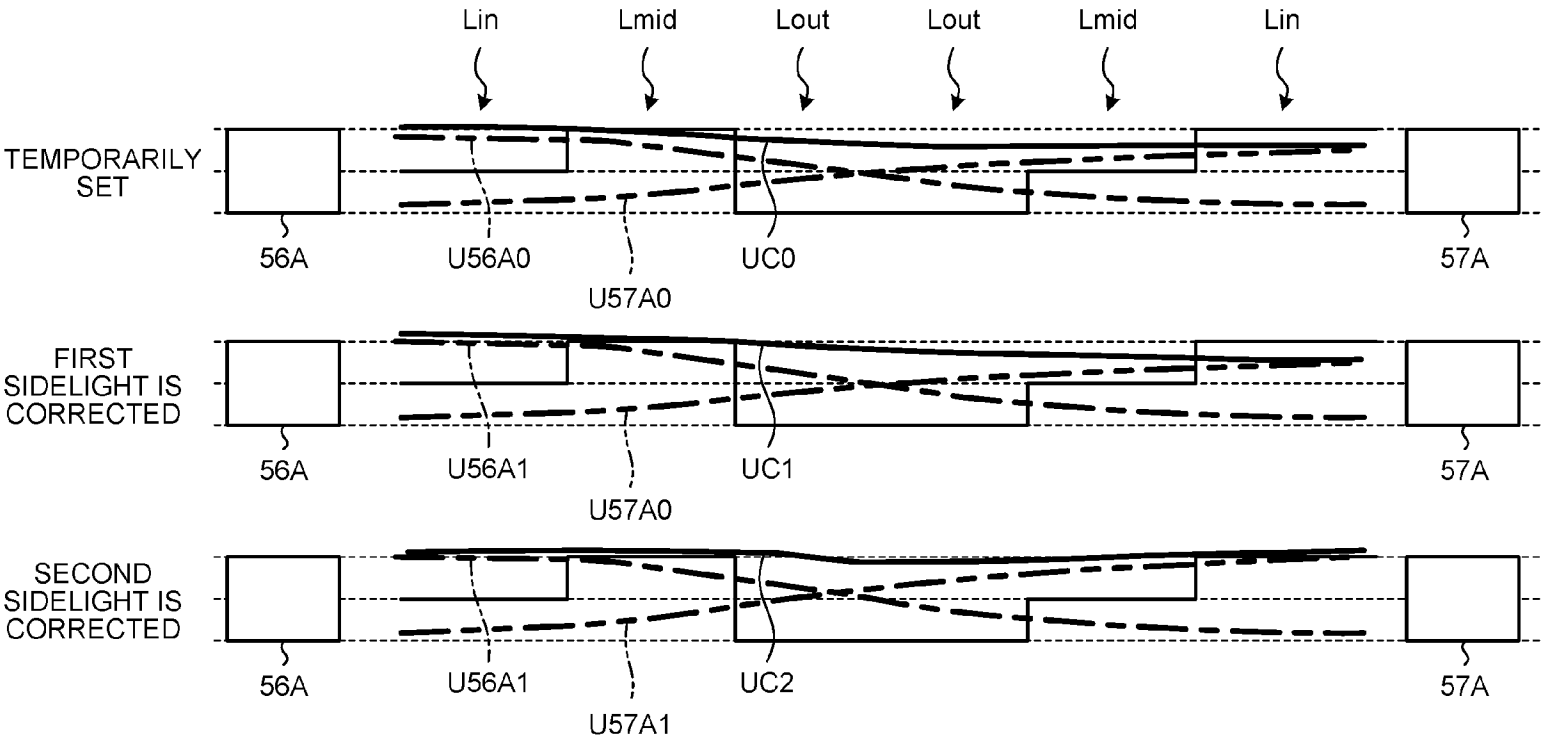
FIG. 35 is a diagram for explaining still another specific example of a process for correcting the light source drive value according to the present embodiment.

FIG. 35 illustrates an example where the luminance correction target block on the light source 56A side is the middle portion Lmid, and the luminance correction target block on the light source 57A side is the light incident portion Lin. In the example illustrated in FIG. 35, the synthesized lighting amount in each of the luminance correction target blocks obtained when the light sources are turned on with the temporarily set light source drive values is smaller than the target light source lighting amounts as indicated by the curve UC0. It is preferable to correct the temporarily set light source drive values.

As described above, the light source drive value of the light source 56A in the first sidelight light source 52A is corrected first (curve U56A1). As indicated by the curve UC1, the correction of the light source drive value of the light source 56A increases the synthesized lighting amount in the middle portion Lmid on the light source 56A side to the target light source lighting amount in the middle portion Lmid on the light source 56A side.

Subsequently, the light source drive value of the light source 57A in the second sidelight light source 52B is corrected (curve U57A1). As indicated by the curve UC2, the correction of the light source drive value of the light source 57A increases the synthesized lighting amount in the light incident portion Lin on the light source 57A side to the target light source lighting amount for the light incident portion Lin on the light source 57A side. Correction of the light source drive values in this manner compensates the insufficient luminance.

Figure 36:
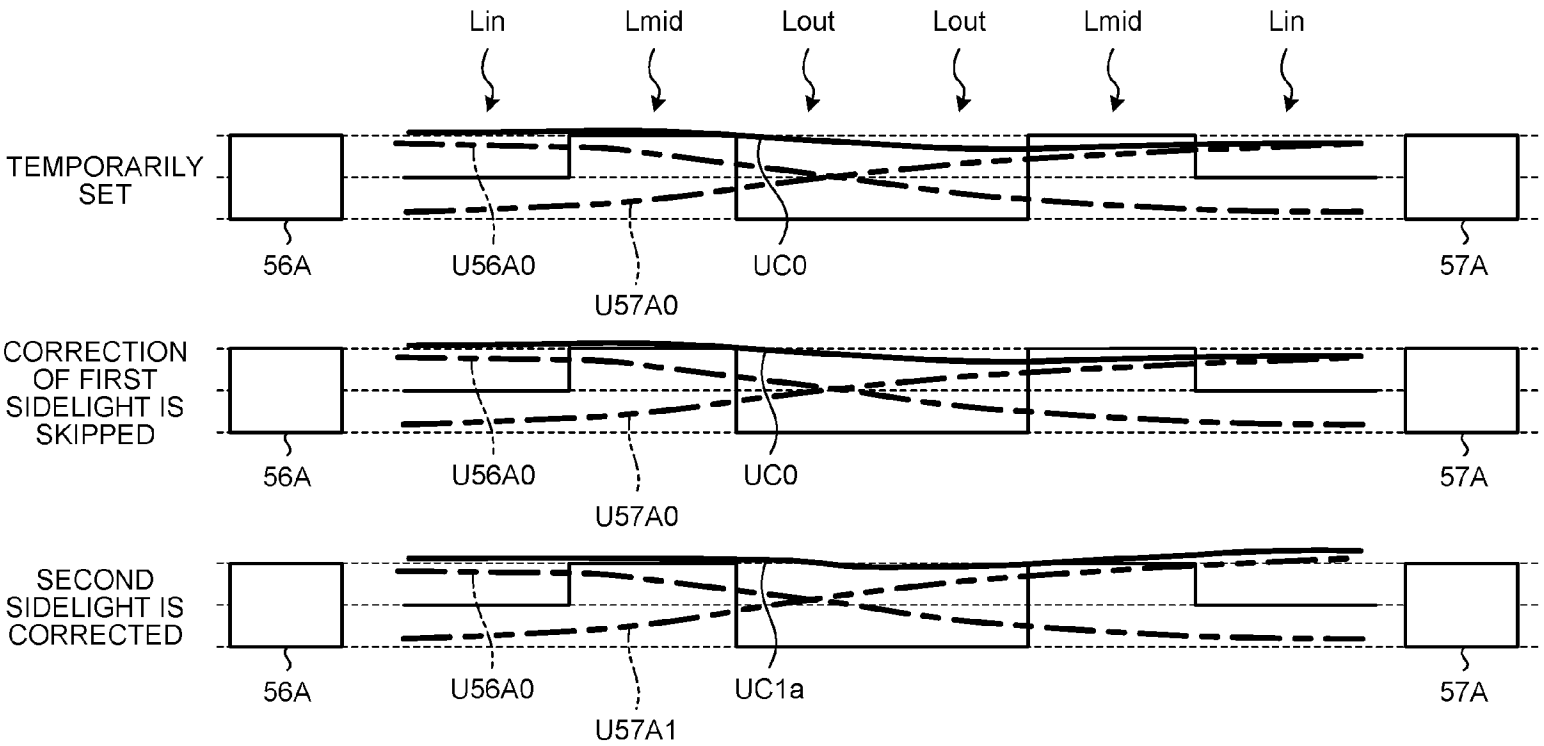
FIG. 36 is a diagram for explaining still another specific example of a process for correcting the light source drive value according to the present embodiment.

FIG. 36 illustrates an example where the luminance correction target block on the light source 56A side is the middle portion Lmid, and the luminance correction target block on the light source 57A side is also the block of the middle portion Lmid. In the example illustrated in FIG. 36, the synthesized lighting amount in the luminance correction target block (middle portion Lmid) on the light source 56A side obtained when the light sources are turned on with the temporarily set light source drive values is equal to or larger than the target light source lighting amount as indicated by the curve UC0. By contrast, the synthesized lighting amount in the luminance correction target block (middle portion Lmid) on the light source 57A side obtained when the light sources are turned on with the temporarily set light source drive values is smaller than the target light source lighting amount.

The synthesized lighting amount in the luminance correction target block (middle portion Lmid) on the light source 56A side obtained with the temporarily set light source drive values is equal to or larger than the target light source lighting amount. As a result, negative determination is made at Step S23 in FIG. 14 to skip the subsequent correction. In this example, in a case where the luminance correction target block on the light source 56A side is the middle portion Lmid, and the luminance correction target block on the light source 57A side is the middle portion Lmid, the correction is skipped because the luminance (synthesized lighting amount) of the luminance correction target block on the light source 56A side is equal to or larger than the target luminance (target light source lighting amount). This is given by way of example only, and the correction is not always skipped in a case where the luminance correction target block on the light source 56A side is the middle portion Lmid, and the luminance correction target block on the light source 57A side is the middle portion Lmid.

Subsequently, the light source drive value of the light source 57A in the second sidelight light source 52B is corrected (curve U57A1). This correction increases the synthesized lighting amount to the lighting amount indicated by the curve UC1*a*. As indicated by the curve UC1*a*, the correction of the light source drive value of the light source 57A increases the synthesized lighting amount for the middle portion Lmid on the light source 57A side to the target light source lighting amount in the middle portion Lmid on the light source 57A side.

Figure 37:
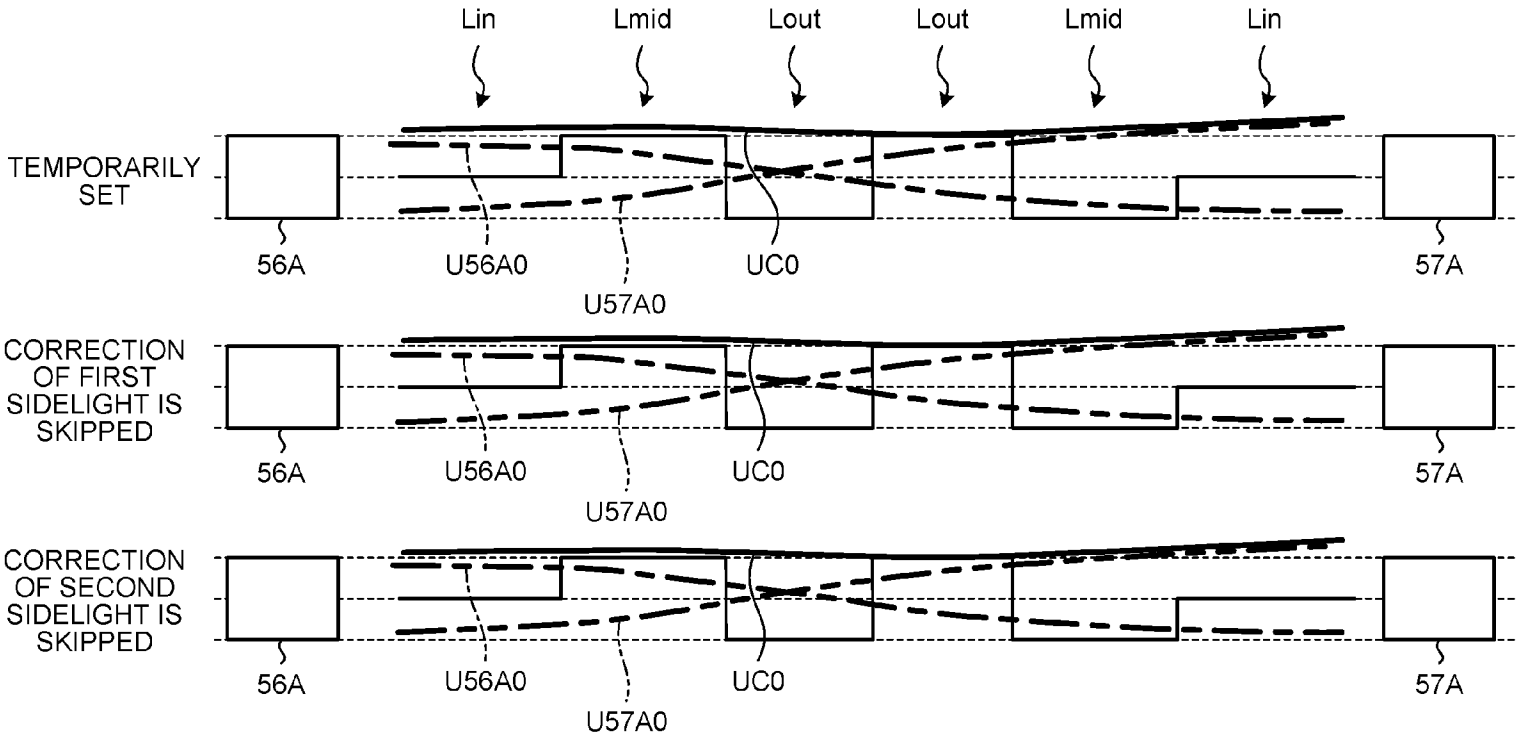
FIG. 37 is a diagram for explaining still another specific example of a process for correcting the light source drive value according to the present embodiment.

FIG. 37 illustrates an example where the luminance correction target block on the light source 56A side is the middle portion Lmid, and the luminance correction target block on the light source 57A side is the outer portion Lout. In the example illustrated in FIG. 37, the synthesized lighting amount in each of the luminance correction target blocks obtained when the light sources are turned on with the temporarily set light source drive values is equal to or larger than the target light source lighting amount. In other words, it is unnecessary to correct the light source drive values. In the example illustrated in FIG. 37, negative determination is made at Step S23 in FIG. 14 to skip the subsequent correction for both of the light sources 56A and 57.

In this example, in a case where the luminance correction target block on the light source 56A side is the middle portion Lmid, and the luminance correction target block on the light source 57A side is the outer portion Lout, the corrections are skipped because the luminance (synthesized lighting amount) of the luminance correction target block on the light source 56A side and the luminance correction target block on the light source 57A side is equal to or larger than the target luminance (target light source lighting amount). This is given by way of example only, and the corrections are not always skipped in a case where the luminance correction target block on the light source 56A side is the middle portion Lmid, and the luminance correction target block on the light source 57A side is the outer portion Lout.

Figure 38:
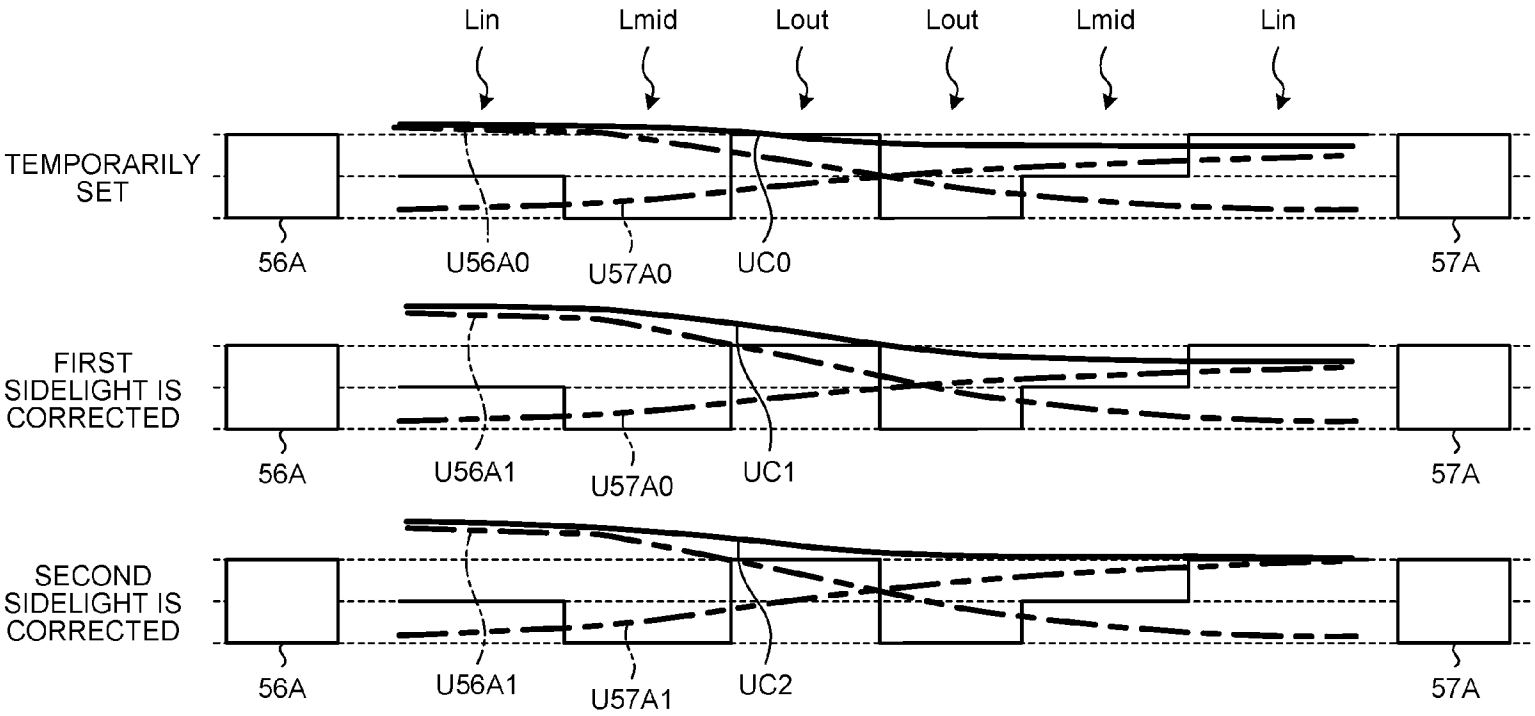
FIG. 38 is a diagram for explaining still another specific example of a process for correcting the light source drive value according to the present embodiment.

FIG. 38 illustrates an example where the luminance correction target block on the light source 56A side is the outer portion Lout, and the luminance correction target block on the light source 57A side is the light incident portion Lin. In the example illustrated in FIG. 38, the synthesized lighting amount in each of the luminance correction target blocks obtained when the light sources are turned on with the temporarily set light source drive values is smaller than the target light source lighting amount as indicated by the curve UC0. It is preferable to correct the temporarily set light source drive values.

The light source drive value of the light source 56A in the first sidelight light source 52A is corrected first (curve U56A1). As indicated by the curve UC1, the correction of the light source drive value of the light source 56A increases the synthesized lighting amount in the outer portion Lout on the light source 56A side to the target light source lighting amount for the outer portion Lout on the light source 56A side.

Subsequently, the light source drive value of the light source 57A in the second sidelight light source 52B is corrected (curve U57A1). As indicated by the curve UC2, the correction of the light source drive value of the light source 57A increases the synthesized lighting amount in the light incident portion Lin on the light source 57A side to the target light source lighting amount for the light incident portion Lin on the light source 57A side. Correction of the light source drive values in this manner compensates the insufficient luminance.

Figure 39:
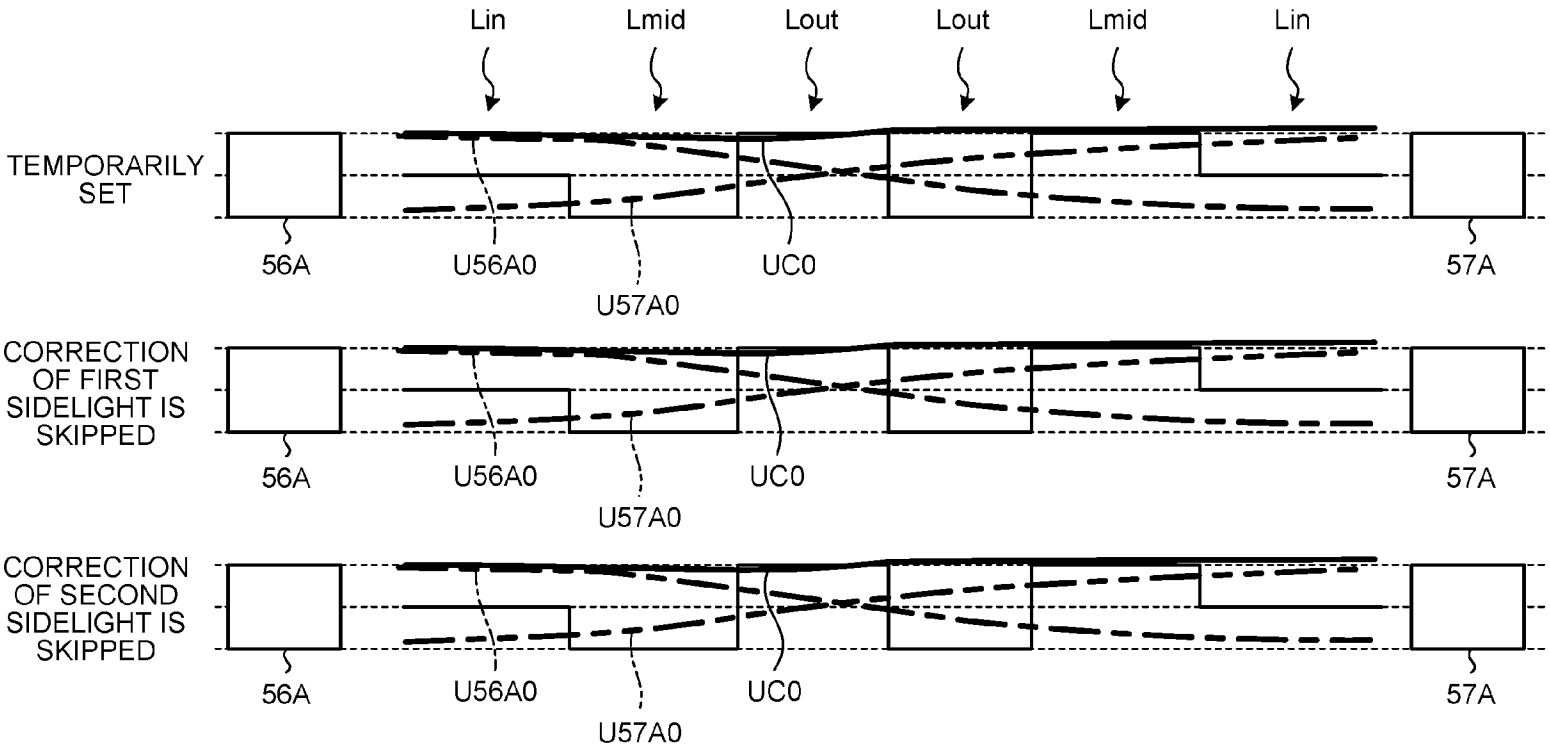
FIG. 39 is a diagram for explaining still another specific example of a process for correcting the light source drive value according to the present embodiment.

FIG. 39 illustrates an example where the luminance correction target block on the light source 56A side is the outer portion Lout, and the luminance correction target block on the light source 57A side is the middle portion Lmid. In the example illustrated in FIG. 39, the synthesized lighting amount in each of the luminance correction target blocks obtained when the light sources are turned on with the temporarily set light source drive values is equal to or larger than the target light source lighting amount. In other words, it is unnecessary to correct the light source drive values. In the example illustrated in FIG. 39, negative determination is made at Step S23 in FIG. 14 to skip the subsequent correction for both of the light sources 56A and 57.

In this example, in a case where the luminance correction target block on the light source 56A side is the outer portion Lout, and the luminance correction target block on the light source 57A side is the middle portion Lmid, the corrections are skipped because the luminance (synthesized lighting amount) of the luminance correction target block on the light source 56A side and the luminance correction target block on the light source 57A side is equal to or larger than the target luminance (target light source lighting amount). This is given by way of example only, and the corrections are not always skipped in a case where the luminance correction target block on the light source 56A side is the outer portion Lout, and the luminance correction target block on the light source 57A side is the middle portion Lmid.

Figure 40:
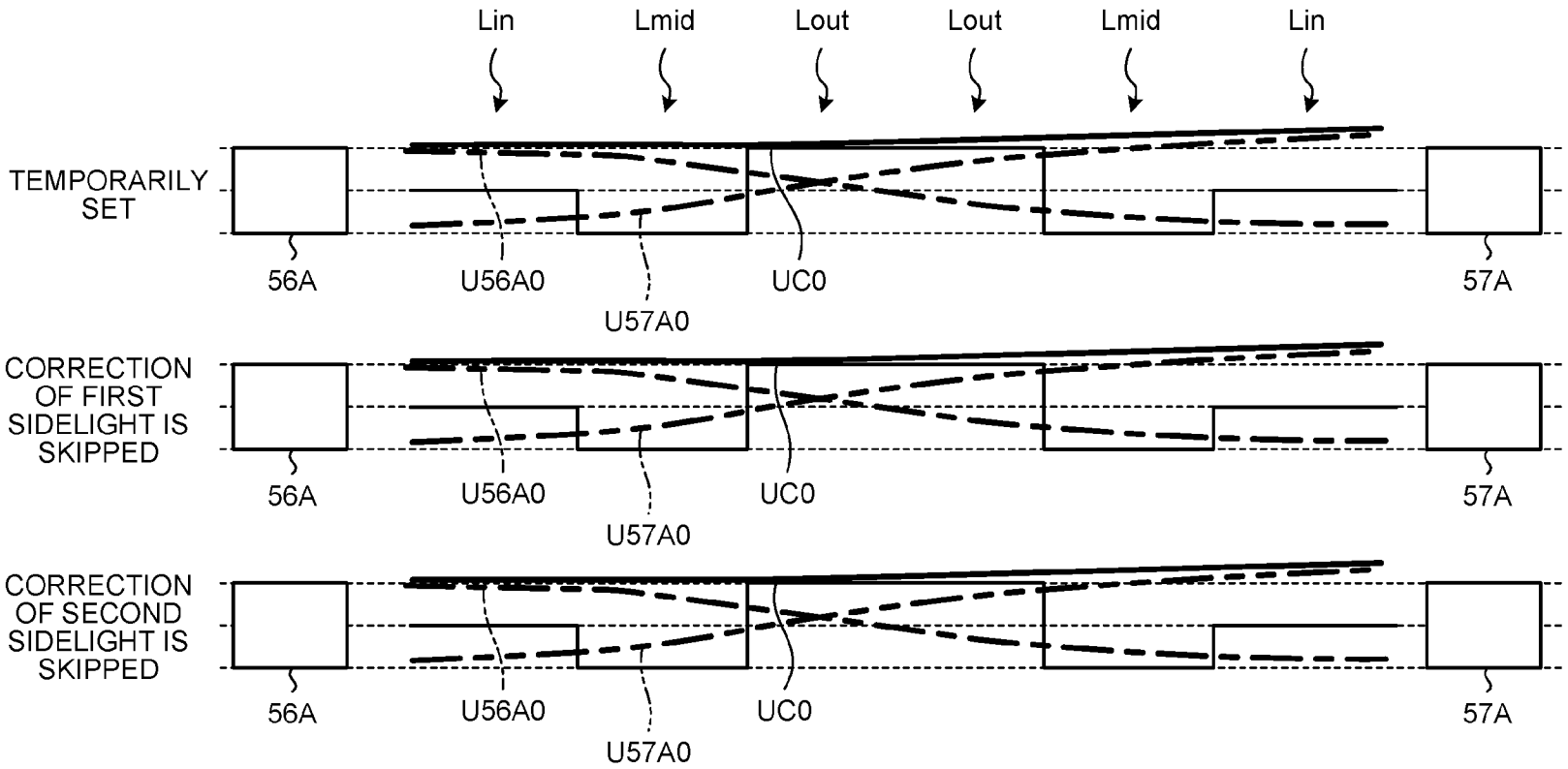
FIG. 40 is a diagram for explaining still another specific example of a process for correcting the light source drive value according to the present embodiment.

FIG. 40 illustrates an example where the luminance correction target block on the light source 56A side is the outer portion Lout, and the luminance correction target block on the light source 57A side is also the block of the outer portion Lout. In the example illustrated in FIG. 40, the synthesized lighting amount in each of the luminance correction target blocks obtained when the light sources are turned on with the temporarily set light source drive values is equal to or larger than the target light source lighting amount. In other words, it is unnecessary to correct the light source drive values. In the example illustrated in FIG. 40, negative determination is made at Step S23 in FIG. 14 to skip the subsequent correction for both of the light sources 56A and 57.

In this example, in a case where the luminance correction target block on the light source 56A side is the outer portion Lout, and the luminance correction target block on the light source 57A side is the outer portion Lout, the corrections are skipped because the luminance (synthesized lighting amount) of the luminance correction target block on the light source 56A side and the luminance correction target block on the light source 57A side is equal to or larger than the target luminance (target light source lighting amount). This is given by way of example only, and the corrections are not always skipped in a case where the luminance correction target block on the light source 56A side is the outer portion Lout, and the luminance correction target block on the light source 57A side is the outer portion Lout.

While various specific examples have been described with reference to FIGS. 32 to 40, the present disclosure is not limited thereto. Other cases than the specific examples illustrated in FIGS. 32 to 40 can also be processed as described above.

As described above, the display device 10 includes the image display panel 30 and the planar light source device 50. The planar light source device 50 serves as a planar light source and includes the light guide plate 54, the first sidelight light source 52A, and the second sidelight light source 52B. Based on the arithmetic operation performed by the signal processing unit 20, the image-display-panel driving unit 40 and the planar-light-source-device control unit 60 serving as the control unit operate in synchronization with each other. The control unit controls the light source lighting amounts of the light sources 56A to 56F and 57A to 57F individually based on the information on the input signal SRGB of an image and the lookup tables LUTA to LUTF. With this operation, the control unit can perform control so as to reduce the total light source lighting amount of the light sources 56A to 56F and 57A to 57F, thereby reducing the power consumption.

The control unit sets the luminance determination blocks by virtually dividing the image display panel 30 into a plurality of portions in the light source array direction LY and the light incident direction LX. The control unit according to the present embodiment divides the whole display surface of the image display panel 30 into the first display surface 31 and the second display surface 32. The control unit divides the first display surface 31 into a plurality of first luminance determination blocks and divides the second display surface 32 into a plurality of second luminance determination blocks.

In a case where an image is displayed on the first display surface 31 based on the information on the input signals of the image, the control unit identifies a block having the highest luminance out of the first luminance determination blocks present at the same position in the light source array direction LY. The control unit identifies a first luminance determination block to be a target of luminance correction by referring to the lookup tables LUTA to LUTF serving as the luminance information on the light sources. The control unit controls the light source lighting amounts of the light sources so as to satisfy the luminance of the identified first luminance determination block. In a case where an image is displayed on the second display surface 32 based on the information on the input signals of the image, the control unit identifies a block having the highest luminance out of the second luminance determination blocks present at the same position in the light source array direction LY. The control unit identifies a second luminance determination block to be a target of luminance correction by referring to the lookup tables LUTA to LUTF serving as the luminance information on the light sources. The control unit controls the light source lighting amounts of the light sources so as to satisfy the luminance of the identified second luminance determination block. With this configuration, the control unit can identify the luminance determination block to be a target of luminance correction while taking into consideration the backlight characteristics. The display device 10 thus controls the light source lighting amounts of the light sources 56A to 56F in the first sidelight light source 52A and the light sources 57A to 57F in the second sidelight light source 52B individually using the luminance of the identified luminance determination block as a target value. As a result, the display device 10 can reduce the power consumption in each light source and also reduce the number of pixels 48 having insufficient luminance.

If $1/\alpha_b$ exceeds an upper limit of $1/\alpha_b$, the display device 10 replaces $1/\alpha_b$ with the upper limit. With this configuration, the display device 10 can increase the luminance within its allowable range.

While an exemplary embodiment according to the present invention has been described, the embodiment is not intended to limit the present invention. The contents disclosed in the embodiment are given by way of example only, and various changes can be made without departing from the spirit of the invention. Appropriate changes made without departing from the spirit of the invention are naturally included in the scope of the invention.

The light sources of the first sidelight light source 52A or the second sidelight light source 52B, for example, may be divided into two light source groups of a first light source group and a second light source group by a center line of the light guide plate 54 in the light source array direction LY. In this case, the lookup tables LUTA, LUTB, and LUTC corresponding to the respective light sources in the first light source group may be generated and stored out of the lookup tables LUTA to LUTF. Because the light sources in the second light source group are line-symmetric with those in the first light source group with respect to the center line, the lookup tables LUTD, LUTE, and LUTF corresponding to the respective light sources in the second light source group are not necessarily created. Specifically, the lookup tables LUTC, LUTB, and LUTA corresponding to the light sources in the first light source group (first half of the light sources) are used instead of the lookup tables LUTD, LUTE, and LUTF corresponding to the light sources in the second light source group (second half of the light sources). In this case, it is necessary to perform coordinate transformation. To use the lookup tables LUTA, LUTB, and LUTC corresponding to the first half of the light sources as the lookup tables for the second half of the light sources, data stored in a position (MAXP-P, Q) simply needs to be read from the lookup tables corresponding to the light sources present at the positions line-symmetric with respect to the center line in the light source array direction LY (also refer to FIG. 30). Specifically, processing is performed by replacing the expressions (11) to (14) with the following expressions (15-2), (16-2), (17-2), and (18-2).

$$\text{luminance index of } Lin=(1/\alpha_{Lin})/[\Sigma\{(1/\alpha_{iA\text{-}max})\times LUTm(P_{Lin},Q_{Lin})\}+\Sigma\{(1/\alpha_{iB\text{-}max})\times LUTm(MAXP-P_{Lin},Q_{Lin})\}] \quad (15\text{-}2)$$

$(1/\alpha_{Lin})$: $1/\alpha$ of the block of Lin $(1/\alpha_{iA\text{-}max})$: light source drive value of the first half of the light sources $(1/\alpha_{iB\text{-}max})$: light source drive value of the second half of the light sources $LUTm(P_{Lin},Q_{Lin})$,$LUTm(MAXP-P_{Lin},Q_{Lin})$: lookup table data of each light source m: A to C $$\text{luminance index of } Lmid=(1/\alpha_{Lmid})/[\Sigma\{(1/\alpha_{iA\text{-}max})\times LUTm(P_{Lmid},Q_{Lmid})\}+\Sigma\{(1/\alpha_{iB\text{-}max})\times LUTm(MAXP-P_{Lmid},Q_{Lmid})\}] \quad (16\text{-}2)$$

$(1/\alpha_{Lmid})$: $1/\alpha$ of the block of Lmid $(1/\alpha_{iA\text{-}max})$: light source drive value of the first half of the light sources $(1/\alpha_{iB\text{-}max})$: light source drive value of the second half of the light sources $LUTm(P_{Lmid},Q_{Lmid})$,$LUTm(MAXP-P_{Lmid},Q_{Lmid})$: lookup table data of each light source m: A to C $$\text{luminance index of } Lout=(1/\alpha_{Lout})/[\Sigma\{(1/\alpha_{iA\text{-}max})\times LUTm(P_{Lout},Q_{Lout})\}+\Sigma\{(1/\alpha_{iB\text{-}max})\times LUTm(MAXP-P_{Lout},Q_{Lout})\}] \quad (17\text{-}2)$$

$(1/\alpha_{Lout})$: $1/\alpha$ of the block of Lout $(1/\alpha_{iA\text{-}max})$: light source drive value of the first half of the light sources $(1/\alpha_{iB\text{-}max})$: light source drive value of the second half of the light sources $LUTm(P_{Lout},Q_{Lout}),LUTm(MAXP-P_{Lout},Q_{Lout})$: lookup table data of each light source m: A to C $$1/\alpha_G=\Sigma\{(1/\alpha_{kA})\times LUTm(P,Q)\}+\Sigma\{(1/\alpha_{kB})\times LUTm(MAXP-P,Q)\} \quad (18\text{-}2)$$

$(1/\alpha_{kA})$: light source drive value of the luminance correction target block on the first half side of the light sources $(1/\alpha_{kB})$: light source drive value of the luminance correction target block on the second half side of the light sources LUTm(P,Q),LUTm(MAXP−P,Q): lookup table data of each light source m: A to C With this processing, the display device 10 can invert the lookup tables LUTA to LUTC with respect to the center line in the light source array direction LY to use them. The display device 10 may create and store therein the lookup tables LUTD, LUTE, and LUTF corresponding to the respective light sources in the second light source group and use them for calculation instead of the lookup tables LUTA, LUTB, and LUTC.

The method for omitting creation of the half of the lookup tables is applicable to a display device including a sidelight light source only at a position facing an incident surface (e.g., E1) on one side surface of the light guide plate 54 as illustrated in FIG. 16, for example. The method is also applicable to a display device including sidelight light sources (the first sidelight light source 52A and the second sidelight light source 52B) at positions facing incident surfaces (e.g., E1 and E2) on both side surfaces of the light guide plate 54 as illustrated in FIG. 3.

Figure 26:
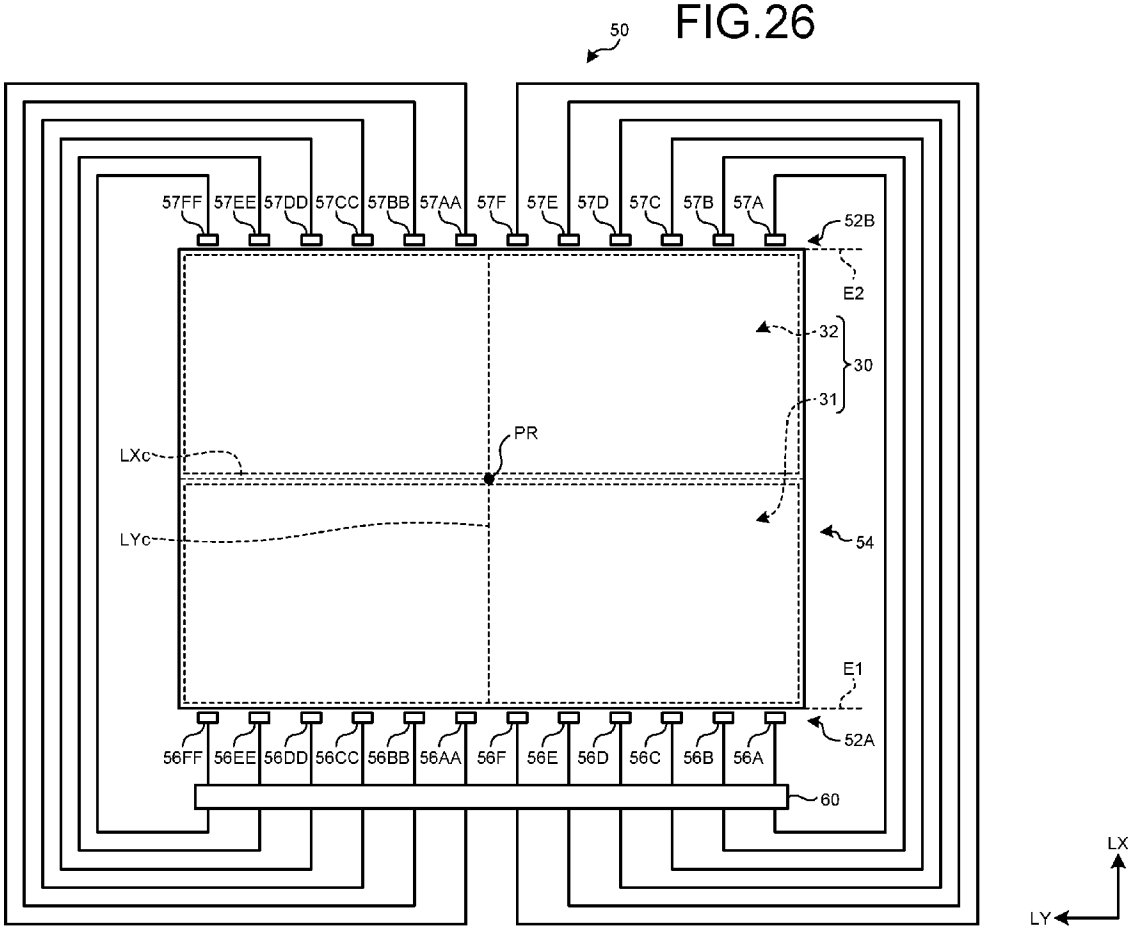
FIG. 26 is a diagram for explaining the light guide plate and the sidelight light source according to another example of the present embodiment.

While the image display panel 30 and the planar light source device 50 (light guide plate 54) have the length longer in the light incident direction LX than in the light source array direction LY in the example described above, the present embodiment is not limited thereto. The image display panel 30 and the planar light source device 50 (light guide plate 54) may have the length longer in the light source array direction LY than in the light incident direction LX or the same length in the light source array direction LY and in the light incident direction LX. FIG. 26 is a diagram for explaining the light guide plate and the sidelight light sources according to another example of the present embodiment. As illustrated in FIG. 26, the planar light source device 50 includes the first sidelight light source 52A and the second sidelight light source 52B. The light-source-data storage unit 25 serving as the control unit stores therein the lookup tables LUTA to LUTF of the light sources 56A to 56F, respectively, arranged on a first side with respect to a center line LYc of the light guide plate 54 in the light source array direction LY. The following describes an example where the display device 10 inverts the lookup tables in a manner line-symmetric with respect to the center line LYc in the configuration illustrated in FIG. 26.

The light-source-drive-value calculating unit 24 reads out the information of the lookup tables LUTF, LUTE, LUTD, LUTC, LUTB, and LUTA of the light sources 56F, 56E, 56D, 56C, 56B, and 56A, inverting the information of the lookup tables LUTF, LUTE, LUTD, LUTC, LUTB, and LUTA in a manner line-symmetric with respect to the center line LYc, the light sources 56F, 56E, 56D, 56C, 56B, and 56A being arranged in line-symmetric with a plurality of light sources 56AA, 56BB, 56CC, 56DD, 56EE, and 56FF with respect to the center line LYc, respectively. The light-source-drive-value calculating unit 24 handles the inverted and read-out information as information on the intensity distribution of light output to the plane of the image display panel 30 from the light sources 56AA, 56BB, 56CC, 56DD, 56EE, and 56FF arranged on a second side with respect to the center line LYc. While expressions used for the operation described above are omitted, the light-source-drive-value calculating unit 24 performs coordinate transformation similarly to the calculation represented by the expressions (15-2), (16-2), (17-2), and (18-2). The light-source-drive-value calculating unit 24 thus inverts the lookup tables of the first sidelight light source 52A. The light-source-data storage unit 25 stores therein the lookup tables LUTA to LUTF of the respective light sources arranged on a first side with respect to the center line LYc in the light source array direction LY. Because the light sources arranged on the second side are line-symmetric with those arranged on the first side with respect to the center line LYc, the light-source-data storage unit 25 does not necessarily store therein the lookup tables of the respective light sources arranged on the second side. Thus, the light-source-data storage unit 25 stores (holds), in the lookup tables, not the information on the second side with respect to the center line LYc in the light source array direction LY but the information on the first side out of pieces of information on the luminance of the pixels 48 in the image display panel 30. The light-source-drive-value calculating unit 24 reads out the information on the first side, inverting the information in a manner line-symmetric with respect to the center line LYc. The light-source-drive-value calculating unit 24 uses the read-out information as the information on the second side. This configuration can significantly reduce the storage capacity of the lookup tables.

The planar light source device 50 according to the example of the present embodiment can further reduce the lookup tables. The light guide plate 54, for example, is provided with the light sources 56A to 56F and the light sources 57A to 57F in a manner line-symmetric with respect to the center line LXc in the light incident direction LX. The light-source-drive-value calculating unit 24 refers to the lookup tables LUTA to LUTF of the light sources 56A to 56F, respectively, arranged on a first side with respect to the center line LXc in the light incident direction LX. Whereas, the light-source-drive-value calculating unit 24 reads out the lookup tables LUTA to LUTF, inverting the lookup tables LUTA to LUTF in a manner line-symmetric with respect to the center line LXc in the light incident direction LX and refers to the inverted information as information on the light sources 57A to 57F, respectively, arranged on a second side.

The light source 56A is arranged in point-symmetric with the light source 57FF with respect to a center point PR at which the center line LXc intersects with the center line LYc. The light-source-drive-value calculating unit 24 reads out the lookup table LUTA of the light source 56A, inverting the lookup table LUTA in a manner point-symmetric with respect to the center point PR. The light-source-drive-value calculating unit 24 refers to the inverted information as information on the light source 57FF. The light source 56B is arranged in point-symmetric with the light source 57EE with respect to the center point PR. The light-source-drive-value calculating unit 24 reads out the lookup table LUTB of the light source 56B, inverting the lookup table LUTB in a manner point-symmetric with the light source 57EE with respect to the center point PR. The light-source-drive-value calculating unit 24 refers to the inverted information as information on the light source 57EE. Similarly, the light-source-drive-value calculating unit 24 reads out the lookup tables LUTC, LUTD, LUTE, and LUTF of the light sources 56C, 56D, 56E, and 56F, inverting the lookup tables LUTC, LUTD, LUTE, and LUTF in a manner point-symmetric with respect to the center point PR because the light sources 56C, 56D, 56E, and 56F are arranged in point-symmetric with the light sources 57DD, 57CC, 57BB, and 57AA, respectively, with respect to the center point PR. The light-source-drive-value calculating unit 24 refers to the inverted information as information on the light sources 57DD, 57CC, 57BB, and 57AA. As described above, the light-source-drive-value calculating unit 24 reads out the lookup tables LUTA to LUTF of the light sources 56A to 56F, inverting in a manner in line-symmetric with respect to the center line LXc in the light incident direction LX and with respect to the center line LYc in the light source array direction LY (that is, inverting in a dyad symmetric manner) and refers to them as the information on the light sources 57AA to 57FF, respectively.

Specifically, the light sources included in one of the two sidelight light sources are divided into two light source groups at the center position (center line LYc) in the light source array direction LY, and the lookup tables corresponding to the light sources included in one of the two light source groups are stored. This configuration enables calculation of the light source drive value and the luminance of all the light sources. In other words, the display device 10 simply needs to store therein lookup tables corresponding to one-fourth of all the light sources included in the two sidelight light sources. With this configuration, the display device 10 can reduce the storage capacity required to store therein the lookup tables to one-fourth of the storage capacity required to store therein the lookup tables of the respective light sources.

Figure 31:
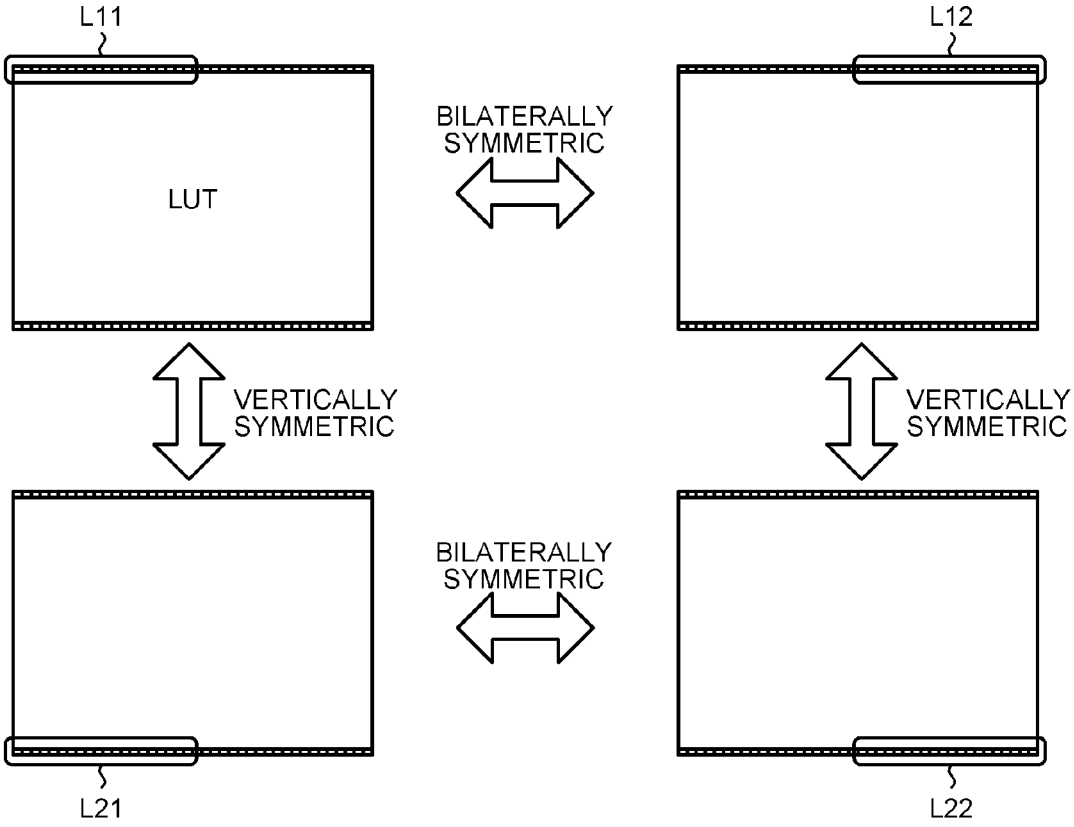
FIG. 31 is a diagram for explaining a reference method of dividing, into two groups, a plurality of light sources included in one of two sidelight light sources at the center position (center line) in the light source array direction, and storing and referring to lookup tables corresponding to light sources included in one of the two groups.

FIG. 31 illustrates the positions of a first light source group of the first sidelight light source 52A (hereinafter, referred to as a first sidelight light source L11) and a second light source group thereof (referred to as a first sidelight light source L12) in a case where the first sidelight light source 52A is divided into two light source groups at the center position (center line LYc) in the light source array direction LY. FIG. 31 also illustrates the positions of a first light source group of the second sidelight light source 52B (referred to as a second sidelight light source L21) and a second light source group thereof (referred to as a second sidelight light source L22) in a case where the second sidelight light source 52B is divided into two light source groups at the center position (center line LYc) in the light source array direction LY. In this example, only the lookup tables of the light sources corresponding to the first sidelight light source L11 are stored.

The first sidelight light source L12 is line-symmetric (bilaterally symmetric in FIG. 31) with the first sidelight light source L11 with respect to the center line LYc in the light source array direction LY. The second sidelight light source L21 is line-symmetric (vertically symmetric in FIG. 31) with the first sidelight light source L11 with respect to the center line LXc in the light incident direction LX. The second sidelight light source L22 is line-symmetric (bilaterally symmetric in FIG. 31) with the second sidelight light source L21 with respect to the center line LYc in the light source array direction LY. In other words, the second sidelight light source L22 is point-symmetric with the first sidelight light source L11 with respect to the center point PR at which the center line LXc intersects with the center line LYc. FIG. 31 does not illustrate the center line LYc, the center line LXc, or the center point PR. In the example illustrated in FIG. 31, the luminance indexes of the light incident portion Lin, the middle portion Lmid, and the outer portion Lout are calculated by the following expressions (15-3), (16-3), and (17-3), respectively.

$$\text{luminance index of } Lin = (1/\alpha_{Lin})/[\Sigma\{(1/\alpha_{i11-max}) \times LUTm(P_{Lin}, Q_{Lin})\} + \Sigma\{(1/\alpha_{i12-max}) \times LUTm(MAXP - P_{Lin}, Q_{Lin})\} + \Sigma\{(1/\alpha_{i21-max}) \times LUTm(P_{Lin}, MAXQ - Q_{Lin})\} + \Sigma\{(1/\alpha_{i22-max}) \times LUTm(MAXP - P_{Lin}, MAXQ - Q_{Lin})\}] \quad (15\text{-}3)$$

$(1/\alpha_{Lin})$: $1/\alpha$ of the block of $Lin$ $(1/\alpha_{i11-max})$: light source drive value of the first sidelight light source $L11$ $(1/\alpha_{i12-max})$: light source drive value of the first sidelight light source $L12$ $(1/\alpha_{i21-max})$: light source drive value of the first sidelight light source $L21$ $(1/\alpha_{i22-max})$: light source drive value of the first sidelight light source $L22$ $LUTm(P_{Lin}, Q_{Lin})$, $LUTm(MAXP - P_{Lin}, Q_{Lin})$, $LUTm(P_{Lin}, MAXQ - Q_{Lin})$, $LUTm(MAXP - P_{Lin}, MAXQ - Q_{Lin})$ : look up table data of each light source $m$: $A$ to $F$ $$\text{luminance index of } Lmid = (1/\alpha_{Lmid})/[\Sigma\{(1/\alpha_{i11-max}) \times LUTm(P_{Lmid}, Q_{Lmid})\} + \Sigma\{(1/\alpha_{i12-max}) \times LUTm(MAXP - P_{Lmid}, Q_{Lmid})\} + \Sigma\{(1/\alpha_{i21-max}) \times LUTm(P_{Lmid}, MAXQ - Q_{Lmid})\} + \Sigma\{(1/\alpha_{i22-max}) \times LUTm(MAXP - P_{Lmid}, MAXQ - Q_{Lmid})\}] \quad (16\text{-}3)$$

$(1/\alpha_{Lmid})$: $1/\alpha$ of the block of $Lin$ $(1/\alpha_{i11-max})$: light source drive value of the first sidelight light source $L11$ $(1/\alpha_{i12-max})$: light source drive value of the first sidelight light source $L12$ $(1/\alpha_{i21-max})$: light source drive value of the first sidelight light source $L21$ $(1/\alpha_{i22-max})$: light source drive value of the first sidelight light source $L22$ $LUTm(P_{Lmid}, Q_{Lmid})$, $LUTm(MAXP - P_{Lmid}, Q_{Lmid})$, $LUTm(P_{Lmid}, MAXQ - Q_{Lmid})$, $LUTm(MAXP - P_{Lmid}, MAXQ - Q_{Lmid})$ : look up table data of each light source $m$: $A$ to $F$ $$\text{luminance index of } Lout = (1/\alpha_{Lout})/[\Sigma\{(1/\alpha_{i11-max}) \times LUTm(P_{Lout}, Q_{Lout})\} + \Sigma\{(1/\alpha_{i12-max}) \times LUTm(MAXP - P_{Lout}, Q_{Lout})\} + \Sigma\{(1/\alpha_{i21-max}) \times LUTm(P_{Lout}, MAXQ - Q_{Lout})\} + \Sigma\{(1/\alpha_{i22-max}) \times LUTm(MAXP - P_{Lout}, MAXQ - Q_{Lout})\}] \quad (17\text{-}3)$$

$(1/\alpha_{Lout})$: $1/\alpha$ of the block of $Lin$ $(1/\alpha_{i11-max})$: light source drive value of the first sidelight light source $L11$ $(1/\alpha_{i12-max})$: light source drive value of the first sidelight light source $L12$ $(1/\alpha_{i21-max})$: light source drive value of the first sidelight light source $L21$ $(1/\alpha_{i22-max})$: light source drive value of the first sidelight light source $L22$ $LUTm(P_{Lout}, Q_{Lout})$, $LUTm(MAXP - P_{Lout}, Q_{Lout})$, $LUTm(P_{Lout}, MAXQ - Q_{Lout})$, $LUTm(MAXP - P_{Lout}, MAXQ - Q_{Lout})$ : look up table data of each light source $m$: $A$ to $F$ As represented by the expressions (15-3), (16-3), and (17-3), to use the lookup tables corresponding to the first sidelight light source L11 as the lookup tables corresponding to the first sidelight light source L12, a coordinate value (MAXP-$P_{Lin}$, $Q_{Lin}$) is used instead of the coordinate value ($P_{Lin}$, $Q_{Lin}$). To use the lookup tables corresponding to the first sidelight light source L11 as the lookup tables corresponding to the second sidelight light source L21, a coordinate value ($P_{Lin}$, MAXQ−$Q_{Lin}$) is used instead of the coordinate value ($P_{Lin}$, $Q_{Lin}$). To use the lookup tables corresponding to the first sidelight light source L11 as the lookup tables corresponding to the second sidelight light source L22, a coordinate value (MAXP−$P_{Lin}$, MAXQ−$Q_{Lin}$) is used instead of the coordinate value ($P_{Lin}$, $Q_{Lin}$). This format is also applicable to the coordinate value ($P_{Lmid}$, $Q_{Lmid}$) and the coordinate value ($P_{Lout}$, $Q_{Lout}$).

At step S21, $1/\alpha_b$ of the luminance correction target block is calculated by the following expression (18-3).

$$1/\alpha_G = \Sigma\{(1/\alpha_{k11}) \times LUTm(P, Q)\} + \Sigma\{(1/\alpha_{k12}) \times LUTm(MAXP - P, Q)\} + \Sigma\{(1/\alpha_{k21}) \times LUTm(P, MAXQ - Q)\} + \Sigma\{(1/\alpha_{k22}) \times LUTm(MAXP - P, MAXQ - Q)\} \quad (18\text{-}3)$$

$(1/\alpha_{k11})$: light source drive value of the luminance correction target block on the first sidelight light source $L11$ side $(1/\alpha_{k12})$: light source drive value of the luminance correction target block on the first sidelight light source $L12$ side $(1/\alpha_{k21})$: light source drive value of luminance correction target block on the the first sidelight light source $L21$ side $(1/\alpha_{k22})$: light source drive value of luminance correction target block on the the first sidelight light source $L22$ side $LUTm(P, Q)$, $LUTm(MAXP - P, Q)$, $LUTm(P, MAXQ - Q)$, $LUTm(MAXP - P, MAXQ - Q)$: look up table data of each light source $m$: $A$ to $F$ Also in calculation of the representative luminance, it is necessary to perform the coordinate transformation described above. In other words, it is necessary to incorporate the calculation of coordinate transformation into the expression (10). As described above, the representative luminance is calculated by multiplying light source currents by data of the lookup tables of the respective light sources and calculating the sum of the values resulting from the multiplication. To use the lookup tables corresponding to the first sidelight light source L11 as those corresponding to the first sidelight light source L12, the second sidelight light source L21, and the second sidelight light source L22, the light-source-drive-value calculating unit 24 simply needs to calculate the representative luminance using the expression for multiplying the light source currents by data of the lookup tables of the respective light sources (the lookup tables of the first sidelight light source L11) and calculating the sum of the values resulting from the multiplication for the first sidelight light sources L11 and L12 and the second sidelight light sources L21 and L22. The light source current of the first sidelight light source L12 is multiplied by data of the coordinate value (MAXP−P, Q) in the lookup tables instead of the coordinate value (P, Q). The light source current of the second sidelight light source L21 is multiplied by data of the coordinate value (P, MAXQ−Q) in the lookup tables instead of the coordinate value (P, Q). The light source current of the second sidelight light source L22 is multiplied by data of the coordinate value (MAXP−P, MAXQ−Q) in the lookup tables instead of the coordinate value (P, Q).

As described above, the planar light source device 50 according to another example of the present embodiment includes the first sidelight light source 52A and the second sidelight light source 52B. The light-source-data storage unit 25 serving as the control unit stores therein lookup tables of first light sources of the first sidelight light source 52A, the first light sources being arranged on the first side with respect to the center line LYc in the light source array direction LY. The light-source-drive-value calculating unit 24 reads the information of the lookup tables of the first light sources of the first sidelight light source 52A as information on the intensity distribution of light output from a plurality of second light sources of the first sidelight light source 52A to the plane of the image display panel 30, the second light sources being arranged on the second side with respect to the center line LYc, the first light sources being arranged in line-symmetric with the second light sources with respect to the center line LYc. The light-source-drive-value calculating unit 24 reads the information of the lookup tables of the first light sources of the first sidelight light source 52A as information on the intensity distribution of light output from a plurality of third light sources of the second sidelight light source 52B to the plane of the image display panel 30, the third light sources being arranged on the first side with respect to the center line LYc and arranged in line-symmetric with the first light sources with respect to the center line LXc. The light-source-drive-value calculating unit 24 reads the information of the lookup tables of the first light sources of the first sidelight light source 52A as information on the intensity distribution of light output from a plurality of fourth light sources of the second sidelight light source 52B to the plane of the image display panel 30, the fourth light sources being arranged on the second side with respect to the center line LYc and arranged in point-symmetric with the first light sources with respect to the center point PR at which the center line LXc intersects with the center line LYc. As a result, the light-source-drive-value calculating unit 24 replaces complicated arithmetic processing with simple reference processing of the lookup tables, thereby reducing the operation amount. This configuration can significantly reduce the capacity of the lookup tables to be stored in advance.

The planar light source device 50 illustrated in FIG. 3 may include the first sidelight light source 52A and the second sidelight light source 52B and use the lookup table LUTA alone as information on the intensity distribution of light output from the other light sources to the plane of the image display panel 30. The light sources 56A, 56F, 57A, and 57F are arranged at the ends of the light guide plate 54 in the light source array direction LY and susceptible to the effects of members around the light guide plate 54. The display device 10 may store therein and read a lookup table shared by the light sources 56B to 56E and 57B to 57E. In this case, the display device 10 may perform the following processing according to a first modification of the present embodiment on the light sources 56A, 56F, 57A, and 57F arranged at the ends of the light guide plate 54 in the light source array direction LY.

First Modification

Figure 27:
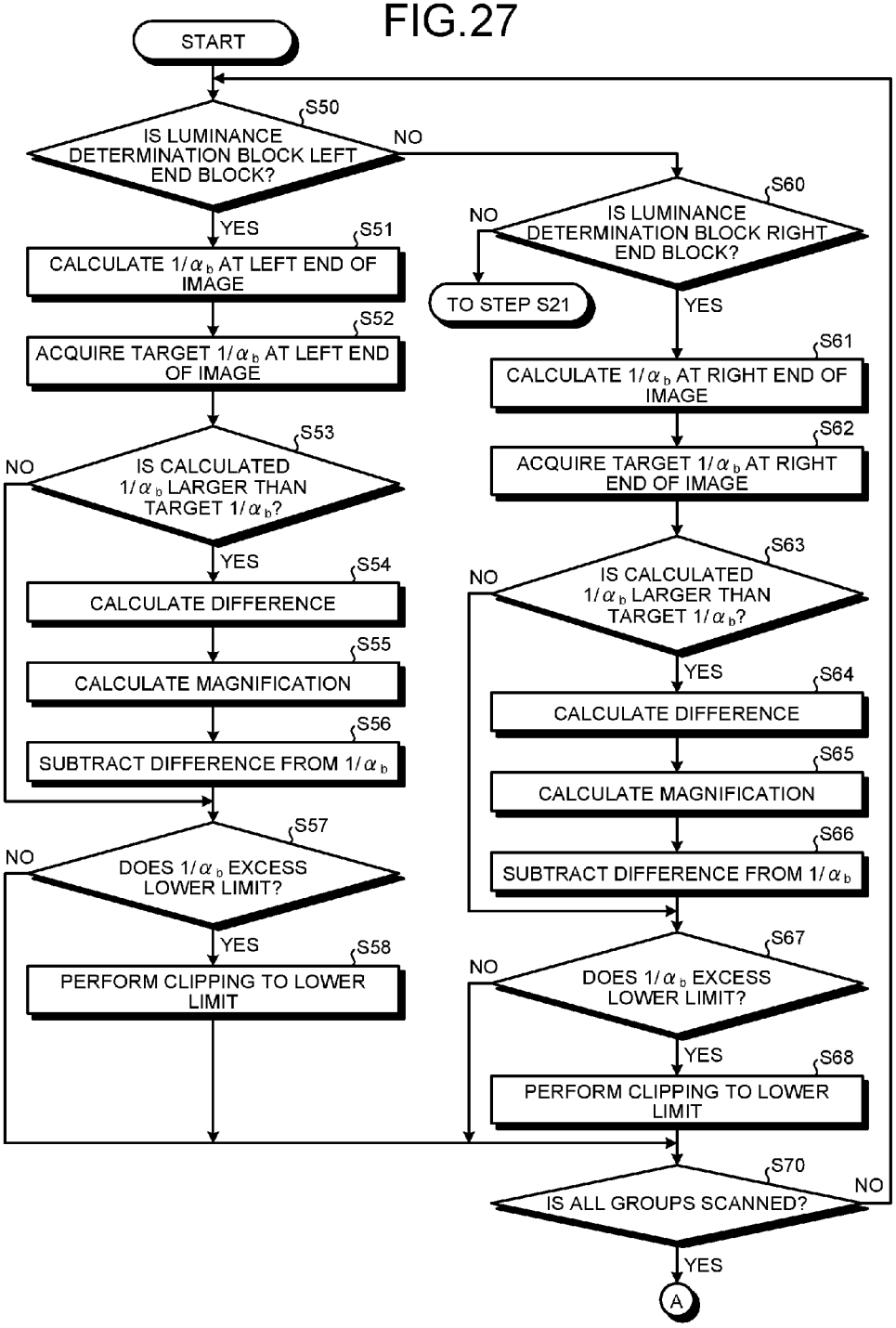
FIG. 27 is a flowchart for explaining luminance subtraction in the luminance determination blocks present at left and right ends in a light source array direction according to the present embodiment.

FIG. 27 is a flowchart for explaining luminance subtraction in the luminance determination blocks present at left and right ends in the light source array direction according to the present embodiment. As described above, light is reflected by both end surfaces in the light source array direction LY in the light guide plate 54. As a result, the intensity distribution of light output from the light sources 56A and 56F arranged closer to both end surfaces in the light source array direction LY is different from that of light output from the light source 56C, for example, arranged between the light sources 56A and 56F.

To address this, the modification according to the present embodiment performs a processing routine illustrated in FIG. 27 between Step S20 and Step S21 in FIG. 14. As illustrated in FIG. 27, if the image analyzing unit 23 determines that the luminance determination block in the group of interest is the left end block in the light source array direction LY (Yes at Step S50), the light-source-drive-value calculating unit 24 performs the processing at Step S51. Because the processing at Step S51 and Step S52 is substantially the same as that at Step S21 and Step S22 described above, explanation thereof will be omitted.

At Step S53, the light-source-drive-value calculating unit 24 determines whether the calculated $1/\alpha_b$ of the block in the group of interest is larger than the target $1/\alpha_b$ of the group of interest. If the calculated $1/\alpha_b$ is larger than the target $1/\alpha_b$ of the group of interest (Yes at Step S53), the light-source-drive-value calculating unit 24 performs the processing from Step S54 to Step S56. By contrast, if the calculated $1/\alpha_b$ is equal to or smaller than the target $1/\alpha_b$ of the group of interest (No at Step S53), the light-source-drive-value calculating unit 24 skips the processing from Step S54 to Step S56. Because the processing at Step S54 and Step S55 is substantially the same as that at Step S24 and Step S25 described above, explanation thereof will be omitted. At Step S56, the light-source-drive-value calculating unit 24 subtracts the difference calculated at Step S54 from $1/\alpha_b$.

If $1/\alpha_b$ falls below a lower limit (Yes at Step S57), the light-source-drive-value calculating unit 24 performs clipping for replacing $1/\alpha_b$ with the lower limit (Step S58). By contrast, if $1/\alpha_b$ does not fall below the lower limit (No at Step S57), the light-source-drive-value calculating unit 24 skips the processing at Step S58 and performs the processing at Step S70.

By contrast, if the luminance determination block in the group of interest is not the left end block in the light source array direction LY (No at Step S50), the image analyzing unit 23 performs the processing at Step S60. At Step S60, the image analyzing unit 23 determines whether the luminance determination block in the group of interest is the right end block in the light source array direction LY. If the luminance determination block in the group of interest is not the right end block in the light source array direction LY (No at Step S60), the light-source-drive-value calculating unit 24 performs the processing at Step S21 illustrated in FIG. 14. By contrast, if the luminance determination block in the group of interest is the right end block in the light source array direction LY (Yes at Step S60), the light-source-drive-value calculating unit 24 performs the processing at Step S61. Because the processing from Step S61 to Step S68 is substantially the same as that from Step S51 to Step S58 described above, explanation thereof will be omitted.

At Step S70, the light-source-drive-value calculating unit 24 determines whether all the groups are specified as the group of interest and subjected to the processing (whether scanning thereof is completed). If scanning of all the groups is not completed (No at Step S70), the light-source-drive-value calculating unit 24 specifies the next group as a group of interest, and the image analyzing unit 23 performs the processing at Step S50 again. By contrast, if scanning of all the groups is completed (Yes at Step S70), the light-source-drive-value calculating unit 24 finishes the process illustrated in FIG. 27 and the processing illustrated in FIG. 14.

The light-source-drive-value calculating unit 24 identifies the luminance determination block having the highest luminance in the light incident direction LX out of the luminance determination blocks present at left and right ends in the light source array direction LY in the image display panel 30. The light-source-drive-value calculating unit 24 controls the light source lighting amount of each light source so as to fall below the luminance of the identified luminance determination block. With this operation, the display device 10 suppresses the luminance at left and right ends in the light source array direction LY in the image display panel 30, thereby reducing the power consumption.

In FIG. 27, the left end block and the right end block are processed separately by different processing steps. Because the left end block and the right end block are line-symmetric with respect to the center line in the light source array direction LY, the light-source-drive-value calculating unit 24 may use the data of a lookup table corresponding to the left end block in the light source array direction LY out of the lookup tables at Steps S61 and S62, for example. With this operation, the light-source-drive-value calculating unit 24 can perform calculation of the right end block in the same manner as calculation of the left end block at Steps S51 and S52, thereby correcting the luminance.

The first modification is applicable to a display device including a sidelight light source only at a position facing an incident surface (e.g., E1) on one side surface of the light guide plate 54 (refer to FIG. 16). The first modification is also applicable to a display device including sidelight light sources (the first sidelight light source 52A and the second sidelight light source 52B) at positions facing incident surfaces (e.g., E1 and E2) on both side surfaces of the light guide plate 54 (refer to FIG. 3). In other words, the first modification is applicable to both of a case where an image is displayed by turning on one of the first sidelight light source 52A and the second sidelight light source 52B and a case where an image is displayed by turning on both of the first sidelight light source 52A and the second sidelight light source 52B.

Second Modification

FIG. 28 is a diagram for explaining the light source lighting amount of the light sources according to the present embodiment. FIG. 29 is a diagram for explaining the duty ratio of the light sources according to the present embodiment. Let us assume a case where the luminance determination blocks are identified (flagged) as illustrated in FIG. 16, and the light sources have the light source lighting amounts illustrated in FIG. 28, for example. In this case, the luminance is higher only at the position of the outer portion Lout out of the luminance determination blocks in the column corresponding to the light source 56D, and the other portions are made dark. If the distribution of the light source lighting amount of the light source 56D exceeds 100%, the image may possibly deteriorate. As illustrated in FIG. 29, the display device 10 according to a second modification of the present embodiment satisfies the conditions for original display luminance when the peak current of the light sources is increased by twice and all the light sources have lighting distribution of 50%. The second modification is applicable to a display device including a sidelight light source only at a position facing an incident surface (e.g., E1) on one side surface of the light guide plate 54 (refer to FIG. 16). The second modification is also applicable to a display device including sidelight light sources (the first sidelight light source 52A and the second sidelight light source 52B) at positions facing incident surfaces (e.g., E1 and E2) on both side surfaces of the light guide plate 54 (refer to FIG. 3). While FIG. 28 does not illustrate the light source lighting amount of the light sources in the second sidelight light source 52B, the second modification can also control the light sources in the second sidelight light source 52B in the same manner. In other words, the second modification is applicable to both of a case where an image is displayed by turning on one of the first sidelight light source 52A and the second sidelight light source 52B and a case where an image is displayed by turning on both of the first sidelight light source 52A and the second sidelight light source 52B.

In the description above, the center lines LXc and LYc are the center lines of the light guide plate 54. In a case where center lines of a valid area in the light guide plate 54 are different from the center lines of the light guide plate 54, the center lines LXc and LYc correspond to the center lines of the valid area in the light guide plate 54.

In FIGS. 3 and 26, the first sidelight light source 52A and the second sidelight light source 52B are arranged at the upper and lower ends (in the vertical direction) with the image display panel 30 sandwiched therebetween. Alternatively, the first sidelight light source 52A and the second sidelight light source 52B may be arranged at the left and right ends (in the horizontal direction) with the image display panel 30 sandwiched therebetween.

The present invention naturally provides advantageous effects clearly defined by the description in the present specification or appropriately conceivable by those skilled in the art out of other advantageous effects provided by the aspects described in the present embodiment.

What is claimed is:

1. A display device comprising:

an image display panel;

a planar light source comprising a light guide plate that irradiates the image display panel from a back surface of the image display panel and includes a first side surface serving as a first incident surface and a second side surface serving as a second incident surface and opposite to the first side surface, a first sidelight light source that is disposed at a position facing the first incident surface of the light guide plate and includes a plurality of light sources, and a second sidelight light source that is disposed at a position facing the second incident surface of the light guide plate and includes a plurality of light sources; and a controller configured to control luminance of the light sources of the first sidelight light source individually and luminance of the light sources of the second sidelight light source individually, wherein the controller is configured to divide an entire display surface of the image display panel into a first display surface and a second display surface, wherein the controller is configured to set first luminance determination blocks by dividing the first display surface into a plurality of portions in a light source array direction in which the light sources of the first and second sidelight light sources are aligned and in a light incident direction orthogonal to the light source array direction, identify a first highest luminance block having highest luminance out of the first luminance determination blocks present at the same position in the light source array direction in an image to be displayed based on information of an input signal of the image, identify a first luminance correction target block to be a target of luminance correction out of the first luminance determination blocks present at the same position in the light source array direction based on the first highest luminance block and luminance information on the light sources, and control light source lighting amounts of the respective light sources so as to satisfy luminance of the identified first luminance correction target block, and wherein the controller is configured to set second luminance determination blocks by dividing the second display surface into a plurality of portions in the light source array direction and the light incident direction, identify a second highest luminance block having highest luminance out of the second luminance determination blocks present at the same position in the light source array direction in the image to be displayed based on information in the input signal of the image, identify a second luminance correction target block to be a target of luminance correction out of the second luminance determination blocks present at the same position in the light source array direction based on the second highest luminance block and the luminance information on the light sources, and control the light source lighting amounts of the respective light sources so as to satisfy luminance of the identified second luminance correction target block, wherein the luminance information on the light sources indicates light intensity distribution of light sources obtained when light sources included in one of the first sidelight light source and the second sidelight light source are turned on individually, and wherein the controller is configured to perform coordinate transformation so as to obtain luminance information in which the luminance information on the light sources are inverted in a manner line symmetric with respect to a center line of the light guide plate in the light incident direction to use the luminance information on the light sources as light intensity distribution of light sources included in the other of the first sidelight light source and the second sidelight light source.

2. The display device according to claim 1, wherein the controller is configured to temporarily determine light source drive values of the respective light sources based on the information on the input signal, correct the temporarily determined light source drive values using the luminance information on the light sources such that the luminance of each of the first and second luminance correction target blocks satisfies target luminance, and control the light source lighting amounts of the light sources using the respective corrected light source drive values.

3. The display device according to claim 2, wherein the controller is configured to correct the temporarily determined light source drive values in a predetermined order, and wherein the controller is configured to correct, after correcting at least one of the temporarily determined light source drive values, the remaining ones of the temporarily determined light source drive values using the at least one corrected light source drive value.

4. A display device comprising:

an image display panel;

a planar light source comprising a light guide plate that irradiates the image display panel from a back surface of the image display panel and includes a first side surface serving as a first incident surface and a second side surface serving as a second incident surface and opposite to the first side surface, a first sidelight light source that is disposed at a position facing the first incident surface of the light guide plate and includes a plurality of light sources, and a second sidelight light source that is disposed at a position facing the second incident surface of the light guide plate and includes a plurality of light sources; and a controller configured to control luminance of the light sources of the first sidelight light source individually and luminance of the light sources of the second sidelight light source individually, wherein the controller is configured to divide an entire display surface of the image display panel into a first display surface and a second display surface, wherein the controller is configured to set first luminance determination blocks by dividing the first display surface into a plurality of portions in a light source array direction I n which the light sources of the first and second sidelight light sources are aligned and in a light incident direction orthogonal to the light source array direction, identify a first highest luminance block having highest luminance out of the first luminance determination blocks present at the same position in the light source array direction in an image to be displayed based on information of an input signal of the image, identify a first luminance correction target block to be a target of luminance correction out of the first luminance determination blocks present at the same position in the light source array direction based on the first highest luminance block and luminance information on the light sources, and control light source lighting amounts of the respective light sources so as to satisfy luminance of the identified first luminance correction target block, and wherein the controller is configured to set second luminance determination blocks by dividing the second display surface into a plurality of portions in the light source array direction and the light incident direction, identify a second highest luminance block having highest luminance out of the second luminance determination blocks present at the same position in the light source array direction in the image to be displayed based on information in the input signal of the image, identify a second luminance correction target block to be a target of luminance correction out of the second luminance determination blocks present at the same position in the light source array direction based on the second highest luminance block and the luminance information on the light sources, and control the light source lighting amounts of the respective light sources so as to satisfy luminance of the identified second luminance correction target block, wherein the luminance information on the light sources indicates light intensity distribution of light sources obtained when light sources included in a first light source group of two light source groups are turned on individually, the two light source group being obtained by dividing light sources included in one of the first sidelight light source and the second sidelight light source into two groups at a first center line of the light guide plate in the light source array direction, wherein the controller is configured to perform coordinate transformation so as to obtain luminance information in which the luminance information on the light sources are inverted in a manner line-symmetric with respect to the first center line to use the luminance information on the light sources as light intensity distribution of light sources included in a second light source group of the two light source groups, wherein the controller is configured to perform coordinate transformation so as to obtain luminance information in which the luminance information on the light sources are inverted in a manner line-symmetric with respect to a second center line of the light guide plate in the light incident direction to use the luminance information on the light sources as light intensity distribution of light sources that are present at the same position in the light source array direction as the first light source group and included in the other of the first sidelight light source and the second sidelight light source, and wherein performs the controller is configured to perform coordinate transformation so as to obtain luminance information in which the luminance information on the light sources are inverted in a manner point-symmetric with respect to a center point at which the first center line intersects with the second center line to use the luminance information on the light sources as light intensity distribution of light sources that are present at the same position in the light source array direction as the second light source group of the two light source groups and included in the other of the first sidelight light source and the second sidelight light source.

5. The display device according to claim 4, wherein the controller is configured to temporarily determine light source drive values of the respective light sources based on the information on the input signal, correct the temporarily determined light source drive values using the luminance information on the light sources such that the luminance of each of the first and second luminance correction target blocks satisfies target luminance, and control the light source lighting amounts of the light sources using the respective corrected light source drive values.

6. The display device according to claim 5, wherein the controller is configured to correct the temporarily determined light source drive values in a predetermined order, and wherein the controller is configured to correct, after correcting at least one of the temporarily determined light source drive values, the remaining ones of the temporarily determined light source drive values using the at least one corrected light source drive value.

7. A display device comprising:

an image display panel;

a planar light source comprising a light guide plate that irradiates the image display panel from a back surface of the image display panel and includes a first side surface serving as a first incident surface and a second side surface serving as a second incident surface and opposite to the first side surface, a first sidelight light source that is disposed at a position facing the first incident surface of the light guide plate and includes a plurality of light sources, and a second sidelight light source that is disposed at a position facing the second incident surface of the light guide plate and includes a plurality of light sources; and a controller configured to control luminance of the light sources of the first sidelight light source individually and luminance of the light sources of the second sidelight light source individually, wherein the controller is configured to divide an entire display surface of the image display panel into a first display surface and a second display surface, the first display surface being more affected by light output from the first sidelight light source than by light output from the second sidelight light source, the second display surface being more affected by light output from the second sidelight light source than by light output from the first sidelight light source, wherein the controller is configured to divide the first display surface into a plurality of first regions corresponding to the light sources included in the first sidelight light source, set a plurality of first luminance determination blocks for each first region by dividing the first region into a plurality of portions in a light incident direction along which light from the corresponding light source of the first sidelight light source is incident on the first region, identify a first highest luminance block having highest luminance out of the first luminance determination blocks in each first region in an image to be displayed based on information of an input signal of the image, identify a first luminance correction target block to be a target of luminance correction out of the first luminance determination blocks in each first region based on the first highest luminance block and luminance information on the light sources, and control a light source lighting amount of each light source of the first sidelight light source so as to satisfy luminance of the identified first luminance correction target block of the first region corresponding to the light source, and wherein the controller is configured to divide the second display surface into a plurality of second regions corresponding to the light sources included in the second sidelight light source, set a plurality of second luminance determination blocks for each second region by dividing the second region into a plurality of portions in a light incident direction along which light from the corresponding light source of the second sidelight light source is incident on the second region, identify a second highest luminance block having highest luminance out of the second luminance determination blocks in each second region in the image to be displayed based on information of the input signal of he image, identify a second luminance correction target block to be a target of luminance correction out of the second luminance determination blocks in each second region based on the second highest luminance block and the luminance information on the light sources, and control a light source lighting amount of each light source of the second sidelight light source so as to satisfy luminance of the identified second luminance correction target block of the second region corresponding to the light source, using the light source lighting amount of at least one of the light sources of the first sidelight light source, the at least one light source including a light source located directly opposite to the light source corresponding to the second region.

8. The display device according to claim 7, wherein the controller is configured to temporarily determine light source drive values of the respective light sources based on the information on the input signal, correct the temporarily determined light source drive values using the luminance information on the light sources such that the luminance of each of the first and second luminance correction target blocks satisfies target luminance, and control the light source lighting amounts of the light sources using the respective corrected light source drive values.

9. The display device according to claim 7, wherein the controller is configured to correct the temporarily determined light source drive values in a predetermined order, and wherein the controller is configured to correct, after correcting at least one of the temporarily determined light source drive values, the remaining ones of the temporarily determined light source drive values using the at least one corrected light source drive value.

10. The display device according to claim 7, wherein the luminance information on the light sources indicates light intensity distribution of light sources obtained when at least a part of the light sources included in the first sidelight light source and the second sidelight light source is turned on individually.

11. The display device according to claim 7, wherein the luminance information on the light sources indicates light intensity distribution of the light sources obtained when the light sources included in the first sidelight light source and the second sidelight light source are turned on individually.

* * * * *